US009552819B2

(12) United States Patent
Thompson et al.

(10) Patent No.: US 9,552,819 B2
(45) Date of Patent: Jan. 24, 2017

(54) MULTIPLET-BASED MATRIX MIXING FOR HIGH-CHANNEL COUNT MULTICHANNEL AUDIO

(71) Applicant: DTS, Inc., Calabasas, CA (US)

(72) Inventors: Jeffrey Kenneth Thompson, Bothell, WA (US); Zoran Fejzo, Los Angeles, CA (US)

(73) Assignee: DTS, Inc., Calabassas, CA (US)

( * ) Notice: Subject to any disclaimer, the term of this patent is extended or adjusted under 35 U.S.C. 154(b) by 0 days.

(21) Appl. No.: 14/555,324

(22) Filed: Nov. 26, 2014

(65) Prior Publication Data

US 2015/0170657 A1 Jun. 18, 2015

Related U.S. Application Data

(63) Continuation-in-part of application No. 14/447,516, filed on Jul. 30, 2014, now Pat. No. 9,338,573.

(Continued)

(51) Int. Cl.
*H04S 3/02* (2006.01)
*G10L 19/008* (2013.01)

(52) U.S. Cl.
CPC ..... *G10L 19/008* (2013.01); *H04S 3/02* (2013.01); *H04S 2400/03* (2013.01)

(58) Field of Classification Search
CPC ..... G10L 19/008; H04S 3/02; H04S 3/008; H04S 2400/01; H04S 2400/03; H04S 2400/07; H04S 2400/13; H04S 2420/03
See application file for complete search history.

(56) References Cited

U.S. PATENT DOCUMENTS 5,291,557 A 3/1994 Davis et al.
5,319,713 A 6/1994 Waller, Jr. et al.
(Continued)

FOREIGN PATENT DOCUMENTS

WO 2010097748 A1 9/2010
WO 2013006338 A2 1/2013
WO 2014160576 A2 10/2014

OTHER PUBLICATIONS

International Search Report and Written Opinion in corresponding Application, mailed Feb. 25, 2015; PCT Application No. PCT/US2014/06773, 71 pages.

(Continued)

*Primary Examiner* — Mark Fischer
(74) *Attorney, Agent, or Firm* — Blake Welcher; William Johnson; Craig Fischer

(57) ABSTRACT

A multiplet-based spatial matrixing codec and method for reducing channel counts (and thus bitrates) of high-channel count (seven or more channels) multichannel audio, optimizing audio quality by enabling tradeoffs between spatial accuracy and basic audio quality, and converting audio signal formats to playback environment configurations. An initial N channel count is reduced to M channels by spatial matrix mixing to a lower number of channels using multiplet pan laws. The multiplet pan laws include doublet, triplet, and quadruplet pan laws. For example, using a quadruplet pan law one of the N channels can be downmixed to four of the M channels to create a quadruplet channel. Spatial information as well and audio content is contained in the multiplet channels. During upmixing the downmixed channel is extracted from the multiplet channels using the corresponding multiplet pan law. The extracted channel then is rendered at any location within a playback environment.

20 Claims, 20 Drawing Sheets

Related U.S. Application Data

(60) Provisional application No. 61/909,841, filed on Nov. 27, 2013.

(56) References Cited

U.S. PATENT DOCUMENTS

| | | | |
|---|---|---|---|
| 5,638,452 | A | 6/1997 | Waller, Jr. |
| 5,771,295 | A | 6/1998 | Waller, Jr. |
| 5,870,480 | A | 2/1999 | Griesinger |
| 6,507,658 | B1 | 1/2003 | Abel et al. |
| 6,665,407 | B1 | 12/2003 | Dicker et al. |
| 7,003,467 | B1 | 2/2006 | Smith et al. |
| 7,283,634 | B2 | 10/2007 | Smith |
| 7,283,684 | B1 | 10/2007 | Keenan |
| 7,391,870 | B2 | 6/2008 | Herre et al. |
| 7,933,415 | B2 | 4/2011 | Breebaart |
| 8,385,556 | B1 | 2/2013 | Warner et al. |
| 2003/0235317 | A1 | 12/2003 | Baumgarte |
| 2005/0052457 | A1 | 3/2005 | Muncy et al. |
| 2006/0009225 | A1 | 1/2006 | Herre et al. |
| 2006/0115100 | A1 | 6/2006 | Faller |
| 2008/0205676 | A1 | 8/2008 | Merimaa et al. |
| 2011/0103592 | A1 | 5/2011 | Kim et al. |
| 2011/0249822 | A1 | 10/2011 | Jaillet et al. |
| 2013/0216047 | A1 | 8/2013 | Kuech et al. |
| 2016/0219387 | A1 | 7/2016 | Ward et al. |

OTHER PUBLICATIONS

Chan Jun Chun, Yong Guk Kim, Jong Yeol Yang, and Hong Kook Kim, "Real-Time Conversion of Stereo Audio to 5.1 Channel Audio for Providing Realistic Sounds," International Journal of Signal Processing, Image Processing and Pattern Recognition vol. 2, No. 4, Dec. 2009, Gwangju, Korea.

Mingsian R. Bai and Geng-You Shih, "Upmixing and Downmixing Two-channel Stereo Audio for Consumer Electronics," IEEE Transaction on Consumer Electronics, Aug. 2007, pp. 1011-1019, vol. 53, Issue: 3, IEEE, New Jersey, USA.

Julia Jakka, "Binaural to Multichannel Audio Upmix," Helsinki University of Technology, Jun. 6, 2005, Aalto, Finland.

Merce Serra and Olaf Korte, "Experiencing Multichannel Sound in Automobiles: Sources, Formats and Reproduction Modes," Fraunhofer Institute for Integrated Circuits IIS, Version 2012, Jul. 2012, Erlangen, Germany.

David Griesinger, "Multichannel matrix surround decoders for two-eared listeners," Journal of The Audio Engineering Society, Nov. 1, 1996, Los Angeles, CA, USA, Preprint #4402, 21 pages.

Roger Dressler, "Dolby Surround Pro Logic II Decoder Principles of Operation," (2000) Dolby Laboratories, Inc., San Francisco, CA, USA, pp. 1-7.

Kenneth Gundry, A New Active Matrix Decoder for Surround Sound, AES 19th International Conference, Jun. 1, 2001, New York, NY, USA, pp. 552-559.

John M. Eargle, "Multichannel Stereo Matrix Systems: An Overview," Journal of the Audio Engineering Society, Jul. 1, 1971, New York, NY, USA.

David Griesinger, "Progress in 5-2-5 Matrix Systems," Audio Engineering Society, 103rd Convention, Sep. 26-29, 1997, New York, NY, USA.

Roger Dressler, "Dolby Surround Pro Logic Decoder Principles of Operation," 1993, Dolby Laboratories, Inc., San Francisco, California, USA.

Pulkki, Spatial Sound Generation and Perception by Amplitude Panning Techniques, Scientific Article. 2001 [retrieved on Feb. 3, 2015]. Retrieved from the internet <URL: https://aaltodoc.aalto.fi/bitsream/handle/123456789/2345/isbn9512255324.pdf?sequence=1>.

International Search Report and The Written Opinion in PCT Application No. PCT/US2014/048975, mailed Jul. 30, 2014.

International Search Report and The Written Opinion in corresponding PCT Application No. PCT/US2014/067763, mailed on Feb. 25, 2015.

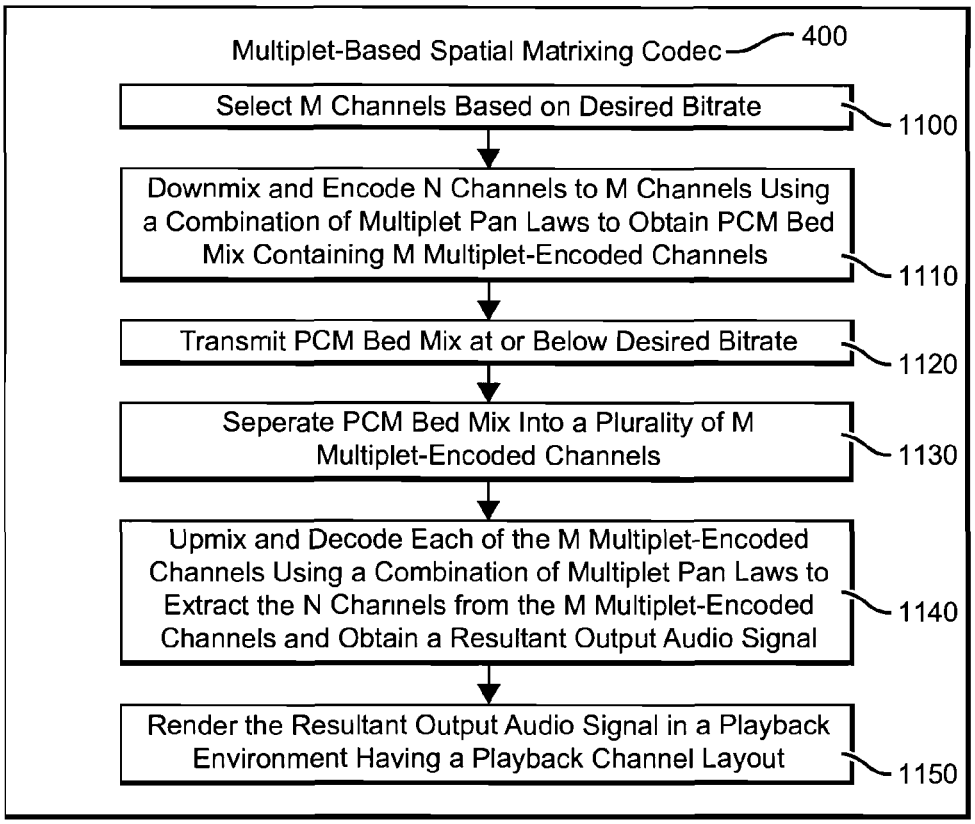
FIG. 11
FIG. 12
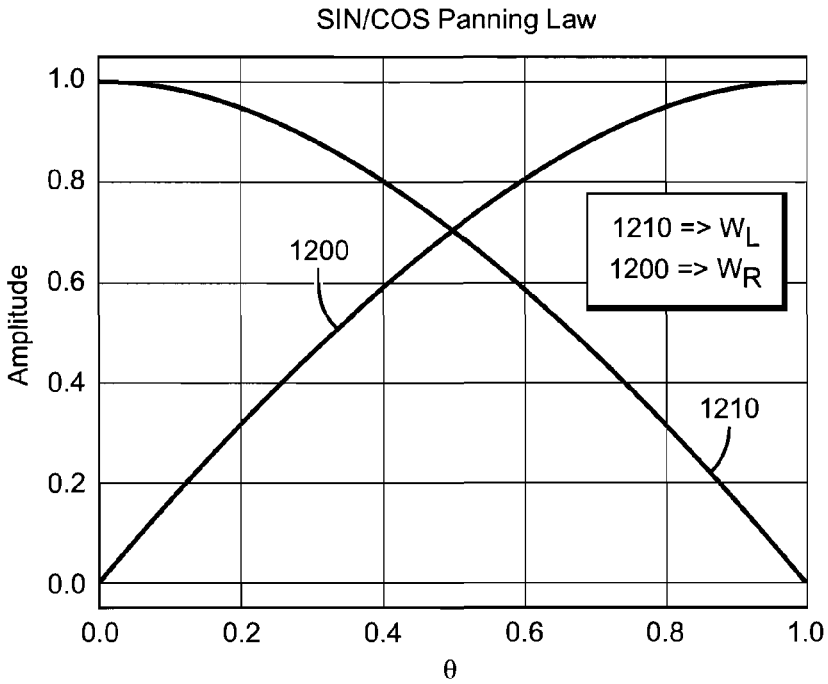

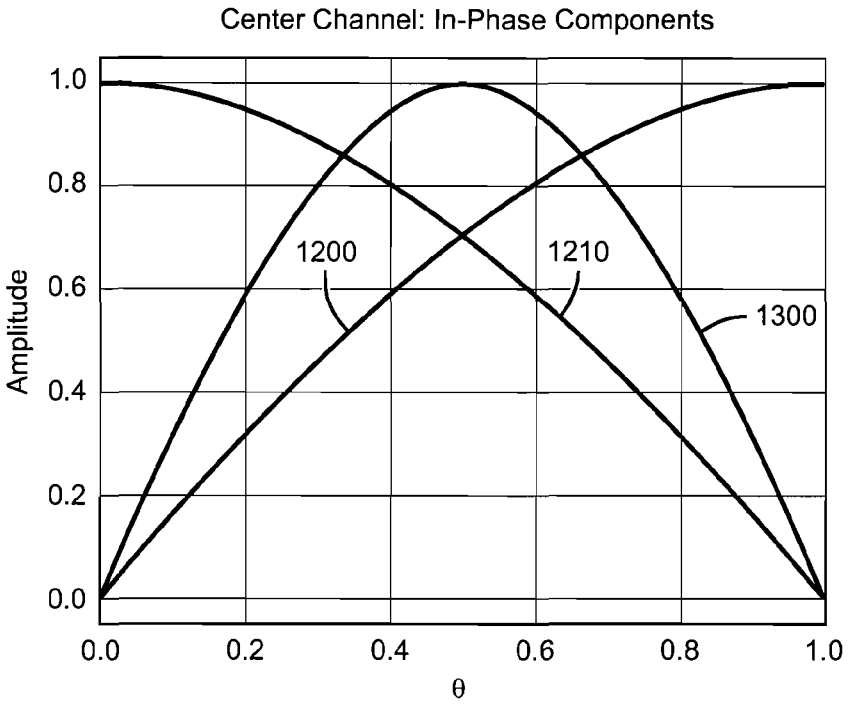
FIG. 13
FIG. 14
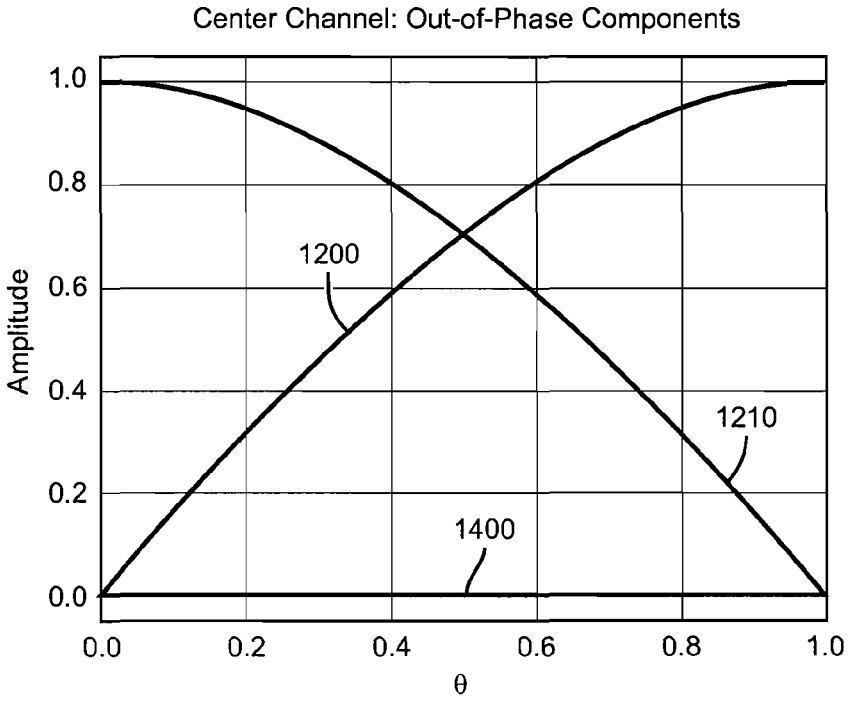

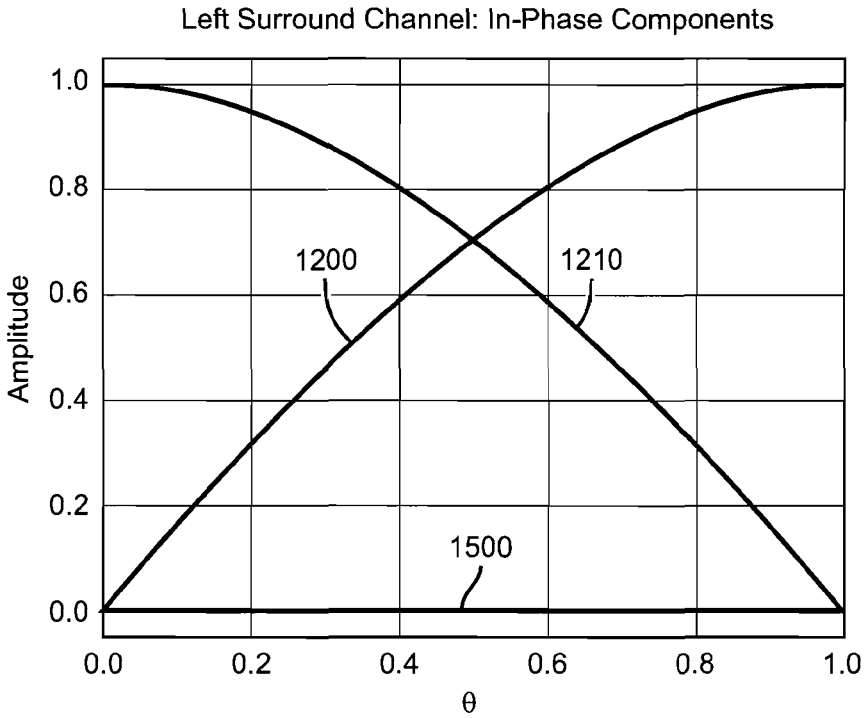
FIG. 15
FIG. 16
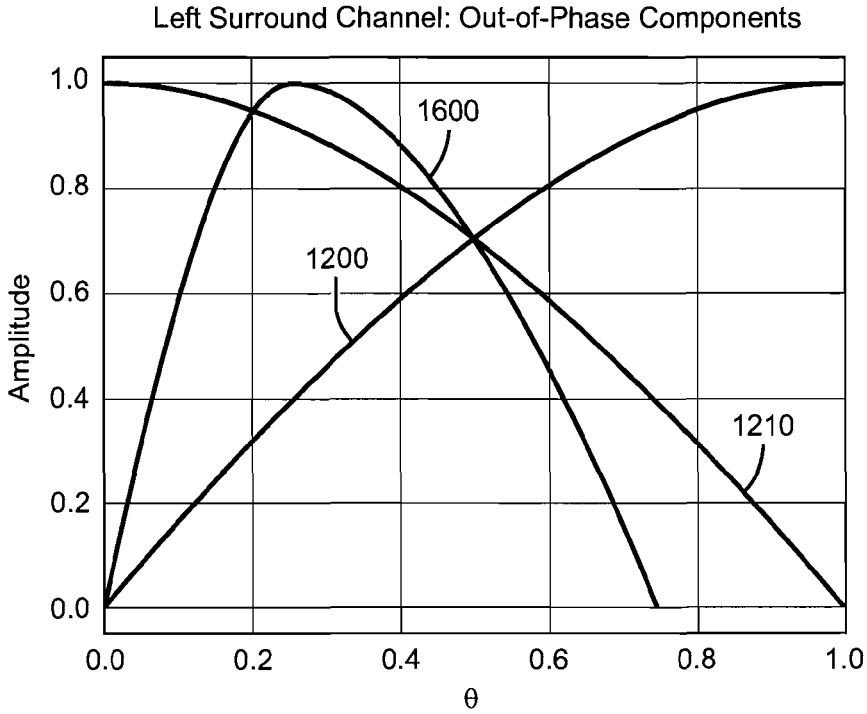

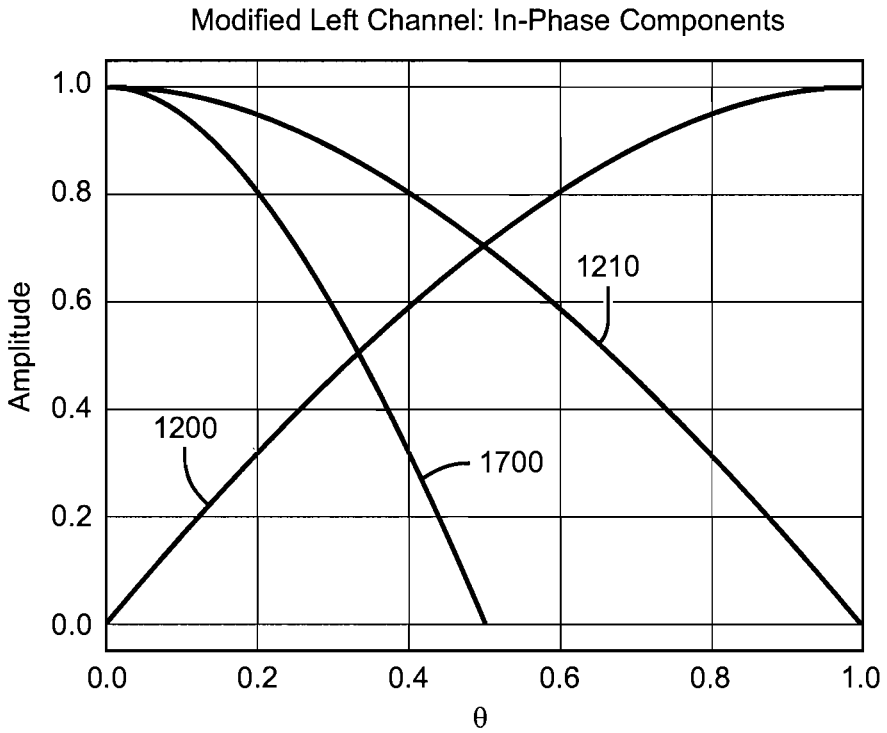
FIG. 17
FIG. 18
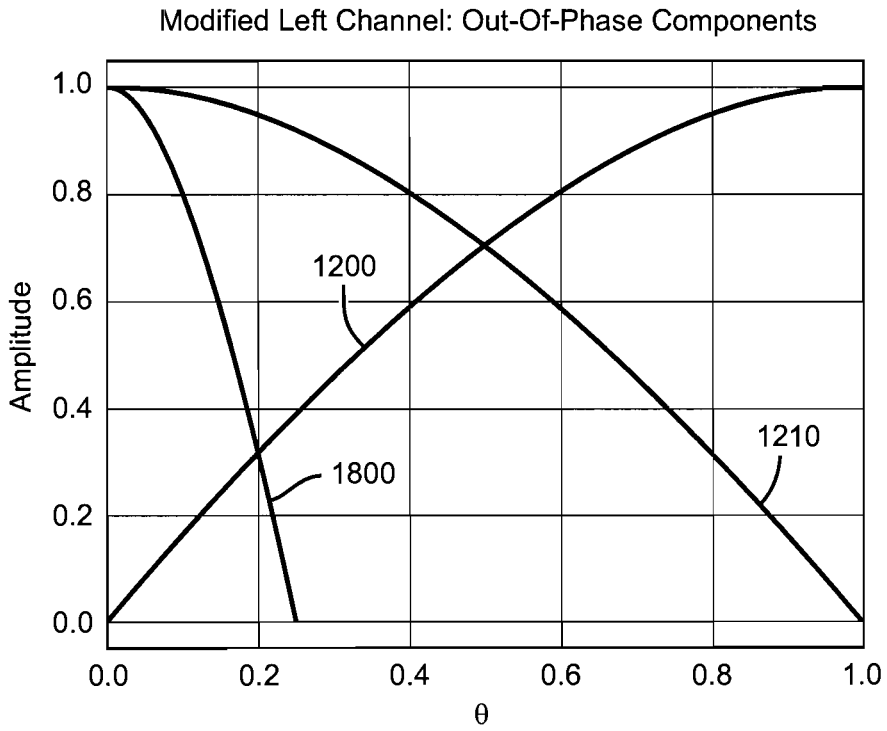

| Mapping of matrixing pairs (in rare cases triplets and quadruplets) for any speakers in the input layout that is not present in the surviving layout. For speakers present in the surviving layout only the corresponding speaker is selected. | | | | | | | | |
|---|---|---|---|---|---|---|---|---|
| All possible speakers in any Input Layout | | | | | | | | |
| Surviving Layouts After Matrixing | | | C | L | R | Ls/Lss | Rs/Rss | Cs |
| | For Inputs without heights | (LR+Cs).x | L-R | L | R | L-Cs | R-Cs | Cs |
| | | (C+LR+Cs).x | C | L | R | L-Cs | R-Cs | Cs |
| | | 5.x | C | L | R | Ls | Rs | Ls-Rs |
| | For Inputs with heights in front only | (LR+Cs+Ch).x | L-R | L | R | L-Cs | R-Cs | Cs |
| | | (C+LR+Cs+Ch).x | C | L | R | L-Cs | R-Cs | Cs |
| | | (C+LR+Cs+LhRh).x | C | L | R | L-Cs | R-Cs | Cs |
| | | 5.x+LhRh | C | L | R | Ls | Rs | Ls-Rs |
| | For Inputs with encircling heights | (LR+LsRs+Ch).x | L-R | L | R | Ls | Rs | Ls-Rs |
| | | 5.x+Ch | C | L | R | Ls | Rs | Ls-Rs |
| | | 5.x+Ch+Chr | C | L | R | Ls | Rs | Ls-Rs |
| | | 5.x+LhRh+Chr | C | L | R | Ls | Rs | Ls-Rs |
| | | 7.x+Ch+Chr | C | L | R | Lss | Rss | Lsr-Rsr |
| | | 7.x+LhRh+Chr | C | L | R | Lss | Rss | Lsr-Rsr |
| | For Inputs with encircling heights and overhead | (LR+LsRs+Oh).x | L-R | L | R | Ls | Rs | Ls-Rs |
| | | 5.x+Oh | C | L | R | Ls | Rs | Ls-Rs |
| | | 5.x+Ch+Chr | C | L | R | Ls | Rs | Ls-Rs |
| | | 5.x+LhRh+Chr | C | L | R | Ls | Rs | Ls-Rs |
| | | 5.x+LhRh+Chr+Oh | C | L | R | Ls | Rs | Ls-Rs |
| | | 7.x+LhRh+Chr | C | L | R | Lss | Rss | Lsr-Rsr |
| | | 7.x+LhRh+RrRhr | C | L | R | Lss | Rss | Lsr-Rsr |
| | For Inputs with encircling heights, overhead and bottom fronts | (LR+LsRs+Oh).x | L-R | L | R | Ls | Rs | Ls-Rs |
| | | (LR+LsRs+Oh+Cb).x | L-R | L | R | Ls | Rs | Ls-Rs |
| | | 5.x+Oh+Cb | C | L | R | Ls | Rs | Ls-Rs |
| | | 5.x+Ch+Chr+Cb | C | L | R | Ls | Rs | Ls-Rs |
| | | 5.x+LhRh+Chr+Cb | C | L | R | Ls | Rs | Ls-Rs |
| | | 5.x+LhRh+Chr+Oh+Cb | C | L | R | Ls | Rs | Ls-Rs |
| | | 7.x+LhRh+Chr+Cb | C | L | R | Lss | Rss | Lsr-Rsr |
| | | 7.x+LhRh+Chr+LbRb | C | L | R | Lss | Rss | Lsr-Rsr |
| | | 7.x+LhRh+LhrRhr+LbRb | C | L | R | Lss | Rss | Lsr-Rsr |

*FIG. 25*

| Mapping of matrixing pairs (in rare cases triplets and quadruplets) for any speakers in the input layout that is not present in the surviving layout. For speakers present in the surviving layout only the corresponding speaker is selected. | | | | | | | | |
|---|---|---|---|---|---|---|---|---|
| All possible speakers in any Input Layout | | | | | | | | |
| Surviving Layouts After Matrixing | | | Lsr | Rsr | Lw | Rw | Lc | Rc |
| | For Inputs without heights | (LR+Cs).x | Cs | Cs | L-Cs | R-Cs | L-R | L-R |
| | | (C+LR+Cs).x | Cs | Cs | L | R | C-L | C-R |
| | | 5.x | Ls-Rs | Ls-Rs | L-Ls | R-Rs | C-L | C-R |
| | For Inputs with heights in front only | (LR+Cs+Ch).x | Cs | Cs | L-Cs | R-Cs | L-R | L-R |
| | | (C+LR+Cs+Ch).x | Cs | Cs | L | R | C-L | C-R |
| | | (C+LR+Cs+LhRh).x | Cs | Cs | L | R | C-L | C-R |
| | | 5.x+LhRh | Ls-Rs | Ls-Rs | L-Ls | R-Rs | C-L | C-R |
| | For Inputs with encircling heights | (LR+LsRs+Ch).x | Ls-Rs | Ls-Rs | L-Ls | R-Rs | L-R | L-R |
| | | 5.x+Ch | Ls-Rs | Ls-Rs | L-Ls | R-Rs | C-L | C-R |
| | | 5.x+Ch+Chr | Ls-Rs | Ls-Rs | L-Ls | R-Rs | C-L | C-R |
| | | 5.x+LhRh+Chr | Ls-Rs | Ls-Rs | L-Ls | R-Rs | C-L | C-R |
| | | 7.x+Ch+Chr | Lsr | Rsr | L-Lss | R-Rss | C-L | C-R |
| | | 7.x+LhRh+Chr | Lsr | Rsr | L-Lss | R-Rss | C-L | C-R |
| | For Inputs with encircling heights and overhead | (LR+LsRs+Oh).x | Ls-Rs | Ls-Rs | L-Ls | R-Rs | L-R | L-R |
| | | 5.x+Oh | Ls-Rs | Ls-Rs | L-Ls | R-Rs | C-L | C-R |
| | | 5.x+Ch+Chr | Ls-Rs | Ls-Rs | L-Ls | R-Rs | C-L | C-R |
| | | 5.x+LhRh+Chr | Ls-Rs | Ls-Rs | L-Ls | R-Rs | C-L | C-R |
| | | 5.x+LhRh+Chr+Oh | Ls-Rs | Ls-Rs | L-Ls | R-Rs | C-L | C-R |
| | | 7.x+LhRh+Chr | Lsr | Rsr | L-Lss | R-Rss | C-L | C-R |
| | | 7.x+LhRh+RrRhr | Lsr | Rsr | L-Lss | R-Rss | C-L | C-R |
| | For Inputs with encircling heights, overhead and bottom fronts | (LR+LsRs+Oh).x | Ls-Rs | Ls-Rs | L-Ls | R-Rs | L-R | L-R |
| | | (LR+LsRs+Oh+Cb).x | Ls-Rs | Ls-Rs | L-Ls | R-Rs | L-R | L-R |
| | | 5.x+Oh+Cb | Ls-Rs | Ls-Rs | L-Ls | R-Rs | C-L | C-R |
| | | 5.x+Ch+Chr+Cb | Ls-Rs | Ls-Rs | L-Ls | R-Rs | C-L | C-R |
| | | 5.x+LhRh+Chr+Cb | Ls-Rs | Ls-Rs | L-Ls | R-Rs | C-L | C-R |
| | | 5.x+LhRh+Chr+Oh+Cb | Ls-Rs | Ls-Rs | L-Ls | R-Rs | C-L | C-R |
| | | 7.x+LhRh+Chr+Cb | Lsr | Rsr | L-Lss | R-Rss | C-L | C-R |
| | | 7.x+LhRh+Chr+LbRb | Lsr | Rsr | L-Lss | R-Rss | C-L | C-R |
| | | 7.x+LhRh+LhrRhr+LbRb | Lsr | Rsr | L-Lss | R-Rss | C-L | C-R |

*FIG. 26*

| Mapping of matrixing pairs (in rare cases triplets and quadruplets) for any speakers in the input layout that is not present in the surviving layout. For speakers present in the surviving layout only the corresponding speaker is selected. | | | | | | | | |
|---|---|---|---|---|---|---|---|---|
| All possible speakers in any Input Layout | | | | | | | | |
| Surviving Layouts After Matrixing | | | Ch | Lh | Rh | Chr | Lhr | Rhr |
| | For Inputs without heights | (LR+Cs).x | N/A | N/A | N/A | N/A | N/A | N/A |
| | | (C+LR+Cs).x | N/A | N/A | N/A | N/A | N/A | N/A |
| | | 5.x | N/A | N/A | N/A | N/A | N/A | N/A |
| | For Inputs with heights in front only | (LR+Cs+Ch).x | Ch | L-Ch | R-Ch | N/A | N/A | N/A |
| | | (C+LR+Cs+Ch).x | Ch | L-Ch | R-Ch | N/A | N/A | N/A |
| | | (C+LR+Cs+LhRh).x | Lh-Rh | Lh | Rh | N/A | N/A | N/A |
| | | 5.x+LhRh | Lh-Rh | Lh | Rh | N/A | N/A | N/A |
| | For Inputs with encircling heights | (LR+LsRs+Ch).x | Ch | L-Ch | R-Ch | Ls-Rs | Ls-Ch | Rs-Ch |
| | | 5.x+Ch | Ch | L-Ch | R-Ch | Ls-Rs | Ls-Ch | Rs-Ch |
| | | 5.x+Ch+Chr | Ch | L-Ch | R-Ch | Chr | Ls-Chr | Rs-Chr |
| | | 5.x+LhRh+Chr | Lh-Rh | Lh | Rh | Chr | Ls-Chr | Rs-Chr |
| | | 7.x+Ch+Chr | Ch | L-Ch | R-Ch | Chr | Lsr-Chr | Rsr-Chr |
| | | 7.x+LhRh+Chr | Lh-Rh | Lh | Rh | Chr | Lsr-Chr | Rsr-Chr |
| | For Inputs with encircling heights and overhead | (LR+LsRs+Oh).x | L-R-Oh | L-Oh | R-Oh | Ls-Rs-Oh | Ls-Oh | Rs-Oh |
| | | 5.x+Oh | C-Oh | L-Oh | R-Oh | Ls-Rs-Oh | Ls-Oh | Rs-Oh |
| | | 5.x+Ch+Chr | Ch | L-Ch | R-Ch | Chr | Ls-Chr | Rs-Chr |
| | | 5.x+LhRh+Chr | Lh-Rh | Lh | Rh | Chr | Ls-Chr | Rs-Chr |
| | | 5.x+LhRh+Chr+Oh | Lh-Rh | Lh | Rh | Chr | Ls-Chr | Rs-Chr |
| | | 7.x+LhRh+Chr | Lh-Rh | Lh | Rh | Chr | Lsr-Chr | Rsr-Chr |
| | | 7.x+LhRh+RrRhr | Lh-Rh | Lh | Rh | Lhr-Rhr | Lhr | Rhr |
| | For Inputs with encircling heights, overhead and bottom fronts | (LR+LsRs+Oh).x | L-R-Oh | L-Oh | R-Oh | Ls-Rs-Oh | Ls-Oh | Rs-Oh |
| | | (LR+LsRs+Oh+Cb).x | L-R-Oh | L-Oh | R-Oh | Ls-Rs-Oh | Ls-Oh | Rs-Oh |
| | | 5.x+Oh+Cb | C-Oh | L-Oh | R-Oh | Ls-Rs-Oh | Ls-Oh | Rs-Oh |
| | | 5.x+Ch+Chr+Cb | Ch | L-Ch | R-Ch | Chr | Ls-Chr | Rs-Chr |
| | | 5.x+LhRh+Chr+Cb | Lh-Rh | Lh | Rh | Chr | Ls-Chr | Rs-Chr |
| | | 5.x+LhRh+Chr+Oh+Cb | Lh-Rh | Lh | Rh | Chr | Ls-Chr | Rs-Chr |
| | | 7.x+LhRh+Chr+Cb | Lh-Rh | Lh | Rh | Chr | Lsr-Chr | Rsr-Chr |
| | | 7.x+LhRh+Chr+LbRb | Lh-Rh | Lh | Rh | Chr | Lsr-Chr | Rsr-Chr |
| | | 7.x+LhRh+LhrRhr+LbRb | Lh-Rh | Lh | Rh | Lhr-Rhr | Lhr | Rhr |

FIG. 27

| Mapping of matrixing pairs (in rare cases triplets and quadruplets) for any speakers in the input layout that is not present in the surviving layout. For speakers present in the surviving layout only the corresponding speaker is selected. | | | | | | | | |
|---|---|---|---|---|---|---|---|---|
| All possible speakers in any Input Layout | | | | | | | | |
| Surviving Layouts After Matrixing | | | Oh | Lhs | Rhs | Cb | Lb | Rb |
| | For Inputs without heights | (LR+Cs).x | N/A | N/A | N/A | N/A | N/A | N/A |
| | | (C+LR+Cs).x | N/A | N/A | N/A | N/A | N/A | N/A |
| | | 5.x | N/A | N/A | N/A | N/A | N/A | N/A |
| | For Inputs with heights in front only | (LR+Cs+Ch).x | N/A | N/A | N/A | N/A | N/A | N/A |
| | | (C+LR+Cs+Ch).x | N/A | N/A | N/A | N/A | N/A | N/A |
| | | (C+LR+Cs+LhRh).x | N/A | N/A | N/A | N/A | N/A | N/A |
| | | 5.x+LhRh | N/A | N/A | N/A | N/A | N/A | N/A |
| | For Inputs with encircling heights | (LR+LsRs+Ch).x | N/A | Ls-Ch | Rs-Ch | N/A | N/A | N/A |
| | | 5.x+Ch | N/A | Ls-Ch | Rs-Ch | N/A | N/A | N/A |
| | | 5.x+Ch+Chr | N/A | L-Chr | R-Chr | N/A | N/A | N/A |
| | | 5.x+LhRh+Chr | N/A | Lh-Chr | Rh-Chr | N/A | N/A | N/A |
| | | 7.x+Ch+Chr | N/A | Lss-Chr | Rss-Chr | N/A | N/A | N/A |
| | | 7.x+LhRh+Chr | N/A | Lss-Chr | Rss-Chr | N/A | N/A | N/A |
| | For Inputs with encircling heights and overhead | (LR+LsRs+Oh).x | Oh | Ls-Oh | Rs-Oh | N/A | N/A | N/A |
| | | 5.x+Oh | Oh | Ls-Oh | Rs-Oh | N/A | N/A | N/A |
| | | 5.x+Ch+Chr | Ch-Chr | Ch-Chr | Ch-Chr | N/A | N/A | N/A |
| | | 5.x+LhRh+Chr | Lh-Rh-Chr | Lh-Chr | Rs-Chr | N/A | N/A | N/A |
| | | 5.x+LhRh+Chr+Oh | Oh | Ls-Oh | Rs-Oh | N/A | N/A | N/A |
| | | 7.x+LhRh+Chr | Lh-Rh-Chr | Lss-Chr | Rss-Chr | N/A | N/A | N/A |
| | | 7.x+LhRh+RrRhr | Lh-Rh-Lhr-Rhr | Lh-Lhr | Rh-Rhr | N/A | N/A | N/A |
| | For Inputs with encircling heights, overhead and bottom fronts | (LR+LsRs+Oh).x | Oh | Ls-Oh | Rs-Oh | L-R | L | R |
| | | (LR+LsRs+Oh+Cb).x | Oh | Ls-Oh | Rs-Oh | Cb | L-Cb | R-Cb |
| | | 5.x+Oh+Cb | Oh | Ls-Oh | Rs-Oh | Cb | L-Cb | R-Cb |
| | | 5.x+Ch+Chr+Cb | Ch-Chr | Ch-Chr | Ch-Chr | Cb | L-Cb | R-Cb |
| | | 5.x+LhRh+Chr+Cb | Lh-Rh-Chr | Lh-Chr | Rh-Chr | Cb | L-Cb | R-Cb |
| | | 5.x+LhRh+Chr+Oh+Cb | Oh | Ls-Oh | Rs-Oh | Cb | L-Cb | R-Cb |
| | | 7.x+LhRh+Chr+Cb | Lh-Rh-Chr | Lss-Chr | Rss-Chr | Cb | L-Cb | R-Cb |
| | | 7.x+LhRh+Chr+LbRb | Lh-Rh-Chr | Lss-Chr | Rss-Chr | Lb-Rb | Lb | Rb |
| | | 7.x+LhRh+LhrRhr+LbRb | Lh-Rh-Lhr-Rhr | Lh-Lhr | Rh-Rhr | Lb-Rb | Lb | Rb |

FIG. 28

MULTIPLET-BASED MATRIX MIXING FOR HIGH-CHANNEL COUNT MULTICHANNEL AUDIO

CROSS-REFERENCE TO RELATED APPLICATIONS

This application claims the benefit of U.S. Provisional Patent Application Ser. No. 61/909,841 filed on Nov. 27, 2013, entitled "MULTIPLET-BASED MATRIX MIXING FOR HIGH-CHANNEL COUNT MULTICHANNEL AUDIO", and U.S. patent application Ser. No. 14/447,516, filed on Jul. 30, 2014, entitled "MATRIX DECODER WITH CONSTANT-POWER PAIRWISE PANNING", the entire contents of both of which are hereby incorporated herein by reference.

BACKGROUND

Many audio reproduction systems are capable of recording, transmitting, and playing back synchronous multichannel audio, sometimes referred to as "surround sound." Though entertainment audio began with simplistic monophonic systems, it soon developed two-channel (stereo) and higher channel-count formats (surround sound) in an effort to capture a convincing spatial image and sense of listener immersion. Surround sound is a technique for enhancing reproduction of an audio signal by using more than two audio channels. Content is delivered over multiple discrete audio channels and reproduced using an array of loudspeakers (or speakers). The additional audio channels, or "surround channels," provide a listener with an immersive listening experience.

Surround sound systems typically have speakers positioned around the listener to give the listener a sense of sound localization and envelopment. Many surround sound systems having only a few channels (such as a 5.1 format) have speakers positioned in specific locations in a 360-degree arc about the listener. These speakers also are arranged such that all of the speakers are in the same plane as each other and the listener's ears. Many higher-channel count surround sound systems (such as 7.1, 11.1, and so forth) also include height or elevation speakers that are positioned above the plane of the listener's ears to give the audio content a sense of height. Often these surround sound configurations include a discrete low-frequency effects (LFE) channel that provides additional low-frequency bass audio to supplement the bass audio in the other main audio channels. Because this LFE channel requires only a portion of the bandwidth of the other audio channels, it is designated as the ".X" channel, where X is any positive integer including zero (such as in 5.1 or 7.1 surround sound).

Ideally surround sound audio is mixed into discrete channels and those channels are kept discrete through playback to the listener. In reality, however, storage and transmission limitations dictate that the file size of the surround sound audio be reduced to minimize storage space and transmission bandwidth. Moreover, two-channel audio content is typically compatible with a larger variety of broadcasting and reproduction systems as compared to audio content having more than two channels.

Matrixing was developed to address these needs. Matrixing involves "downmixing" an original signal having more than two discrete audio channels into a two-channel audio signal. The additional channels over two channels are downmixed according to a pre-determined process to generate a two-channel downmix that includes information from all of the audio channels. The additional audio channels may later be extracted and synthesized from the two-channel downmix using an "upmix" process such that the original channel mix can be recovered to some level of approximation. Upmixing receives the two-channel audio signal as input and generates a larger number of channels for playback. This playback is an acceptable approximation of the discrete audio channels of the original signal.

Several upmixing techniques use constant-power panning. The concept of "panning" is derived from motion pictures and specifically the word "panorama." Panorama means to have a complete visual view of a given area in every direction. In the audio realm, audio can be panned in the stereo field so that the audio is perceived as being positioned in physical space such that all the sounds in a performance are heard by a listener in their proper location and dimension. For musical recordings, a common practice is to place the musical instruments where they would be physically located on a real stage. For example, stage-left instruments are panned left and stage-right instruments are panned right. This idea seeks to replicate a real-life performance for the listener during playback.

Constant-power panning maintains constant signal power across audio channels as the input audio signal is distributed among them. Although constant-power panning is widespread, current downmixing and upmixing techniques struggle to preserve and recover the precise panning behavior and localization present in an original mix. In addition, some techniques are prone to artifacts, and all have limited ability to separate independent signals that overlap in time and frequency but originate from different spatial directions.

For example, some popular upmixing techniques use voltage-controlled amplifiers to normalize both input channels to approximately the same level. These two signals then are combined in an ad-hoc manner to produce the output channels. Due to this ad-hoc approach, however, the final output has difficulty achieving desired panning behaviors and includes problems with crosstalk and at best approximates discrete surround-sound audio.

Other types of upmixing techniques are precise only in a few panning locations but are imprecise away from those locations. By way of example, some upmixing techniques define a limited number of panning locations where upmixing results in precise and predictable behavior. Dominance vector analysis is used to interpolate between a limited number of pre-defined sets of dematrixing coefficients at the precise panning location points. Any panning location falling between the points use interpolation to find the dematrixing coefficient values. Due to this interpolation, panning locations falling between the precise points can be imprecise and adversely affect audio quality.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments of the multiplet-based spatial matrixing codec and method reduce channel counts (and thus bitrates) of high-channel count (seven or more channels) multichannel audio. In addition, embodiments of the codec and method optimize audio quality by enabling tradeoffs between spatial accuracy and basic audio quality, and convert audio signal formats to playback environment configurations. This is achieved in part by determining a target bitrate and the number of channels that the bitrate will support (or surviving channels). The remainder of the channels (the non-surviving channels) are downmixed onto multiplets of the surviving channels. This could be a pair (or doublet) of channels, a triplet of channels, a quadruplet of channels, or any higher order multiplet of channels.

For example, a fifth non-surviving channel may be downmixed onto four other surviving channels. During upmix the fifth channel is extracted from the four other channels and rendering in a playback environment. Those encoded four channels are further configured and combined in various ways for backwards compatibility with existing decoders, and then compressed using either lossy or lossless bitrate compression. The decoder is provided with the encoded four encoded audio channels as well as the relevant metadata enabling proper decoding back to the original source speaker layout (such as an 11.x layout).

For the decoder to properly decode a channel-reduced signal, the decoder must be informed of the layouts, parameters, and coefficients that were used in the encoding process. For example, if the encoder encoded an 11.2-channel base-mix to a 7.1-channel-reduced signal, then information describing the original layout, the channel-reduced layout, the contributing downmix channels, and the downmix coefficients will be transmitted to the decoder to enable proper decoding back to the original 11.2-channel count layout. This type of information is provided in the data structure of the bitstream. When information of this nature is provided and used to reconstruct the original signal, the codec is operating in metadata mode.

The codec and method can also be used as a blind up-mixer for legacy content in order to create an output channel layout that matches the listening layout of the playback environment. The difference in the blind upmix use-case is that the codec configures the signal processing modules based on layout and signal assumptions instead of a known encoding process. Thus, the codec is operating in blind mode when it does not have or use explicit metadata information.

The multiplet-based spatial matrixing codec and method described herein is an attempt to address a number of interrelated problems arising when mixing, delivering, and reproducing multi-channel audio having many channels, in a way that gives due regard to backward compatibility and flexibility of mixing or rendering techniques. It will be appreciated by those with skill in the field that a myriad of spatial arrangements are possible for sound sources, microphones, or speakers; and that the speaker arrangement owned by the end consumer may not be perfectly predictable to the artist, engineer, or distributor of entertainment audio. Embodiments of the codec and method also addresses the need to achieve a functional and practical compromise between data bandwidth, channel count, and quality that is more workable for large channel counts.

The multiplet-based spatial matrixing codec and method are designed to reduce channel counts (and thus bit-rates), optimize audio quality by enabling tradeoffs between spatial accuracy and basic audio quality, and convert audio signal formats to playback environment configurations. Accordingly, embodiments of the codec and method use a combination of matrixing and discrete channel compression to create and playback a multichannel mix having N channels from a base-mix having M channels (and LFE channels), where N is larger than M and where both N and M are larger than two. This technique is especially advantageous when N is large, for example in the range 10 to 50 and includes height channels as well as surround channels; and when it is desired to provide a backward compatible base mix such as a 5.1 or 7.1 surround mix.

Given a sound mix comprising base channels (such as 5.1 or 7.1) and additional channels, the invention uses a combination of pairwise, triplet, and quadruplet based matrix rules in order to mix additional channels into the base channels in a manner that will allow a complementary upmix, said upmix capable of recovering the additional channels with clarity and definition, together with a convincing illusion of a spatially defined sound source for each additional channel. Legacy decoders are enabled to decode the base mix, while newer decoders are enabled by embodiments of the codec and method to perform an upmix that separates additional channels (such as height channels).

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DRAWINGS DESCRIPTION

Referring now to the drawings in which like reference numbers represent corresponding parts throughout:

FIG. 11 is a flow diagram illustrating the general operation of embodiments of the multiplet-based spatial matrixing codec and method shown in FIG. 4.

FIG. 12 illustrates the panning weights as a function of the panning angle ($\theta$) for the Sin/Cos panning law.

FIG. 13 illustrates panning behavior corresponding to an in-phase plot for a Center output channel.

FIG. 14 illustrates panning behavior corresponding to an out-of-phase plot for the Center output channel.

FIG. 15 illustrates panning behavior corresponding to an in-phase plot for a Left Surround output channel.

FIG. 16 illustrates two specific angles corresponding to downmix equations where the Left Surround and Right Surround channels are discretely encoded and decoded.

FIG. 17 illustrates panning behavior corresponding to an in-phase plot for a modified Left output channel.

FIG. 18 illustrates panning behavior corresponding to an out-of-phase plot for the modified Left output channel.

FIGS. 25-28 are lookup tables that dictate the mapping of matrix multiplets for any speakers in the input layout that is not present in the surviving layout

DETAILED DESCRIPTION

In the following description of embodiments of a multiplet-based spatial matrixing codec and method reference is made to the accompanying drawings. These drawings shown by way of illustration specific examples of how embodiments of the multiplet-based spatial matrixing codec and method may be practiced. It is understood that other embodiments may be utilized and structural changes may be made without departing from the scope of the claimed subject matter.

I. Terminology

Following are some basic terms and concepts used in this document. Note that some of these terms and concepts may have slightly different meanings than they do when used with other audio technologies.

This document discusses both channel-based audio and object-based audio. Music or soundtracks traditionally are created by mixing a number of different sounds together in a recording studio, deciding where those sounds should be heard, and creating output channels to be played on each individual speaker in a speaker system. In this channel-based audio, the channels are meant for a defined, standard speaker configuration. If a different speaker configuration is used, the sounds may not end up where they are intended to go or at the correct playback level.

In object-based audio, all of the different sounds are combined with information or metadata describing how the sound should be reproduced, including its position in a three-dimensional (3D) space. It is then up to the playback system to render the object for the given speaker system so that the object is reproduced as intended and placed at the correct position. With object-based audio, the music or soundtrack should sound essentially the same on systems with different numbers of speakers or with speakers in different positions relative to the listener. This methodology helps preserve the true intent of the artist.

Figure 1:
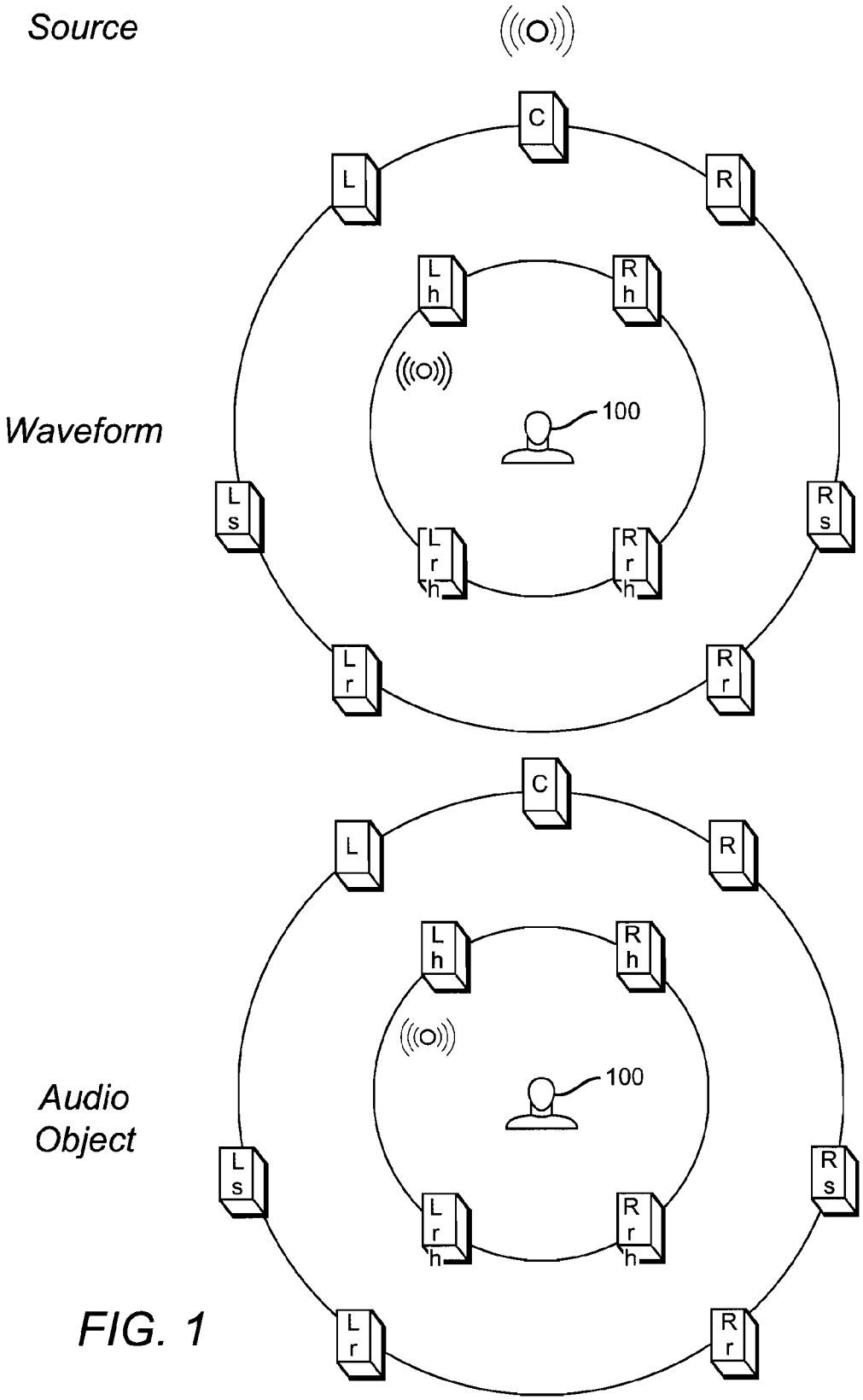
FIG. 1 is a diagram illustrating the difference between the terms "source," "waveform," and "audio object."

FIG. 1 is a diagram illustrating the difference between the terms "source," "waveform," and "audio object." As shown in FIG. 1, the term "source" is used to mean a single sound wave that represents either one channel of a bed mix or the sound of one audio object. When a source is assigned a specific position in a 3D space, the combination of that sound and its position in 3D space is called a "waveform." An "audio object" (or "object") is created when a waveform is combined with other metadata (such as channel sets, audio presentation hierarchies, and so forth) and stored in the data structures of an enhanced bitstream. The "enhanced bitstream" contains not only audio data but also spatial data and other types of metadata. An "audio presentation" is the audio that ultimately comes out of embodiments of the multiplet-based spatial matrixing decoder.

The phrase "gain coefficient" is an amount by which the level of an audio signal is adjusted to increase or decrease its volume. The term "rendering" indicates a process to transform a given audio distribution format to the particular playback speaker configuration being used. Rendering attempts to recreate the playback spatial acoustical space as closely to the original spatial acoustical space as possible given the parameters and limitations of the playback system and environment.

When either surround or elevated speakers are missing from the speaker layout in the playback environment, then audio objects that were meant for these missing speakers may be remapped to other speakers that are physically present in the playback environment. In order to enable this functionality, "virtual speakers" can be defined that are used in the playback environment but are not directly associated with an output channel. Instead, their signal is rerouted to physical speaker channels by using a downmix map.

Figure 2:
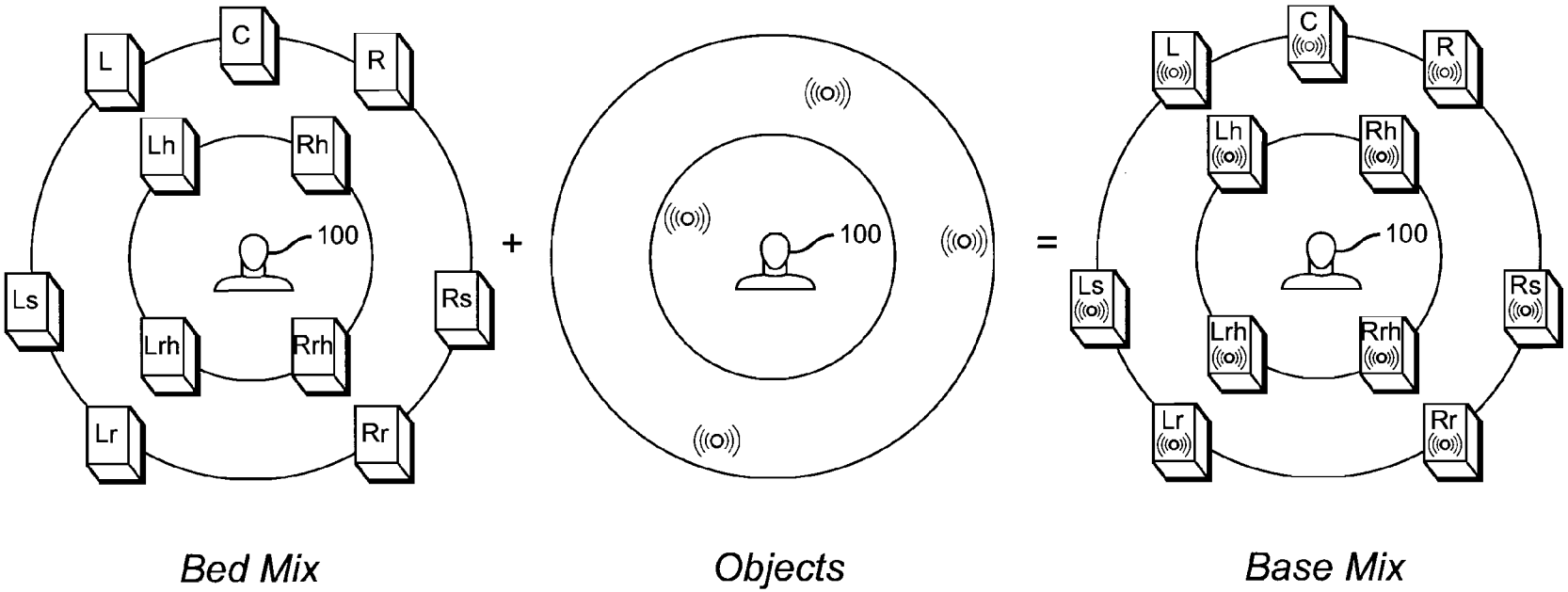
FIG. 2 is an illustration of the difference between the terms "bed mix," "objects," and "base mix."

FIG. 2 is an illustration of the difference between the terms "bed mix," "objects," and "base mix." Both "bed mix" and "base mix" refer to channel-based audio mixes (such as 5.1, 7.1, 11.1, and so forth) that may be contained in an enhanced bitstream either as channels or as channel-based objects. The difference between the two terms is that a bed mix does not contain any of the audio objects contained in the bitstream. A base mix contains the complete audio presentation presented in channel-based form for a standard speaker layout (such as 5.1, 7.1, and so forth). In the base mix, any objects that are present are mixed into the channel mix. This is illustrated in FIG. 2, which shows that the base mix include both the bed mix and any audio objects.

As used in this document, the term "multiplet" means a grouping of a plurality of channels that has a signal panned onto it. For example, one type of multiplet is a "doublet," whereby a signal is panned onto two channels. Similarly, another type of multiplet is a "triplet," whereby a signal is panned onto three channels. When a signal is panned onto four channels, the resulting multiplet is called a "quadruplet." The multiplet can include a grouping of two or more channels including five channels, six channels, seven channels, and so forth, onto which a signal is panned. For pedagogical purposes this document only discusses the doublet, triplet, and quadruplet cases. However, it should be noted that the principles taught herein can be expanded to multiplets containing five or more channels.

Embodiments of the multiplet-based spatial matrixing codec and method, or aspects thereof, are used in a system for delivery and recording of multichannel audio, especially when large numbers of channels are to be transmitted or recorded. As used in this document, "high-channel count" multichannel audio means that there are seven or more audio channels. For example, in one such system a multitude of channels are recorded and are assumed to be configured in a known playback geometry having L channels disposed at ear level around the listener, P channels disposed around a height ring disposed at higher than ear level, and optionally a center channel at or near the Zenith above the listener (where L and P are positive integers larger than 1).

Figure 3:
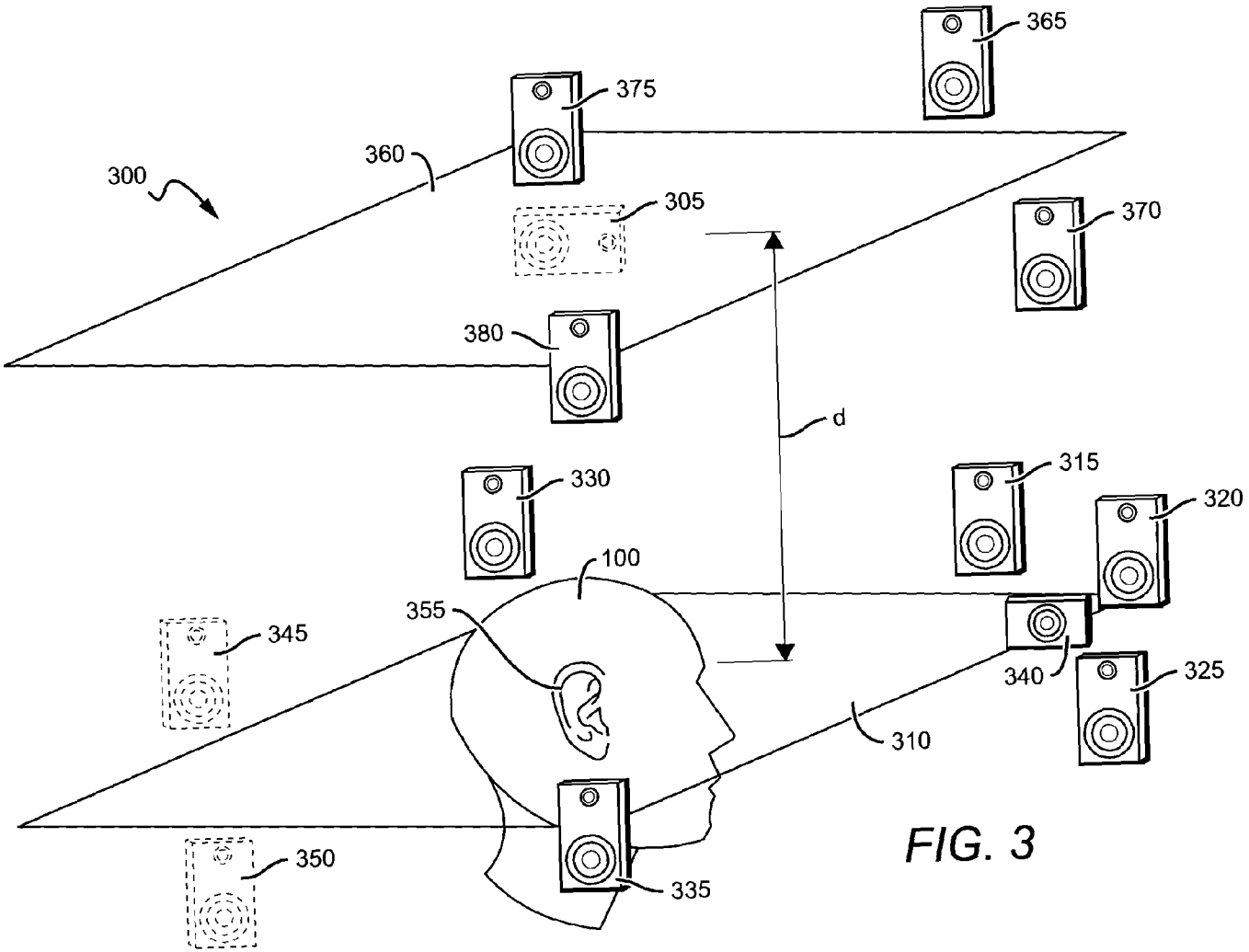
FIG. 3 is an illustration of the concept of a content creation environment speaker layout having L number of speakers in the same plane as the listener's ears and P number of speakers disposed around a height ring that is higher that the listener's ear.

FIG. 3 is an illustration of the concept of a content creation environment speaker (or channel) layout 300 having L number of speakers in the same plane as the listener's ears and P number of speakers disposed around a height ring that is higher than the listener's ear. As shown in FIG. 3, the listener 100 is listening to content that is mixed on the content creation environment speaker layout 300. The content creation environment speaker layout 300 is an 11.1 layout with an optional overhead speaker 305. An L plane 310 containing the L number of speakers in the same plane as the listener's ears includes a left speaker 315, a center speaker 320, a right speaker 325, a left surround speaker 330, and a right surround speaker 335. The 11.1 layout shown also includes a low-frequency effects (LFE or "subwoofer") speaker 340. The L plane 310 also includes a surround back left speaker 345 and a surround back right speaker 350. Each of the listener's ears 355 are also located in the L plane 310.

The P (or height) plane 360 contains a left front height speaker 365 and a right front height speaker 370. The P plane 360 also includes a left surround height speaker 375 and a right surround height speaker 380. The optional overhead speaker 305 is shown located in the P plane 360. Alternatively, the optional overhead speaker 305 may be located above the P plane 360 at a zenith of the content creation environment. The L plane 310 and the P plane 360 are separated by a distance d.

Although an 11.1 content creation environment speaker layout 300 (along with an optional overhead speaker 305) is shown in FIG. 3, embodiments of the multiplet-based spatial matrixing codec and method can be generalized such that content could be mixed in high-channel count environments containing seven or more audio channels. Moreover, it should be noted that in FIG. 3 the speakers in the content creation environment speaker layout 300 and the listener's head and ears are not to scale with each other. In particular, the listener's head and ears are shown larger than scale to illustrate the concept that each of the speakers and the listener's ears are in the same horizontal plane as the L plane 310.

The speakers in the P plane 360 may be arranged according to various conventional geometries, and the presumed geometry is known to a mixing engineer or recording artist/engineer. According to embodiments of the multiplet-based spatial matrixing codec and method, the (L+P) channel count is reduced by a novel method of matrix mixing to a lower number of channels (for example, (L+P) channels mapped onto L channels only). The reduced-count channels are then encoded and compressed by known methods that preserve the discrete nature of the reduced-count channels.

On decoding, the operation of embodiments of the codec and method depends upon the decoder capabilities. In legacy decoders the reduced-count (L) channels are reproduced, having the P channels mixed therein. In a more advanced decoder, the full consort of (L+P) channels are recoverable by upmixing and routed each to a corresponding one of the (L+P) speakers.

In accordance with the invention, both upmixing and downmixing operations (matrixing/dematrixing) include a combination of multiplet pan laws (such as pairwise, triplet, and quadruplet pan laws) to place the perceived sound sources, upon reproduction, closely corresponding to the presumed locations intended by the recording artist or engineer. The matrixing operation (channel layout reduction) can be applied to the bed mix channels in: (a) a bed mix plus object composition of the enhanced bitstream; (b) a channel-based only composition of the enhanced bitstream. In addition, the matrixing operation can be applied to stationary objects (objects that are not moving around) and after dematrixing still achieve sufficient object separation that will allow independent level modifications and rendering for individual objects; or (c) applying the matrixing operation to channel-based objects.

II. System Overview

Embodiments of the multiplet-based spatial matrixing codec and method reduce high-channel count multichannel audio and bitrates by panning certain channels onto multiplets of remaining channels. This serves to optimize audio quality by enabling tradeoffs between spatial accuracy and basic audio quality. Embodiments of the codec and method also convert audio signal formats to playback environment configurations.

Figure 4:
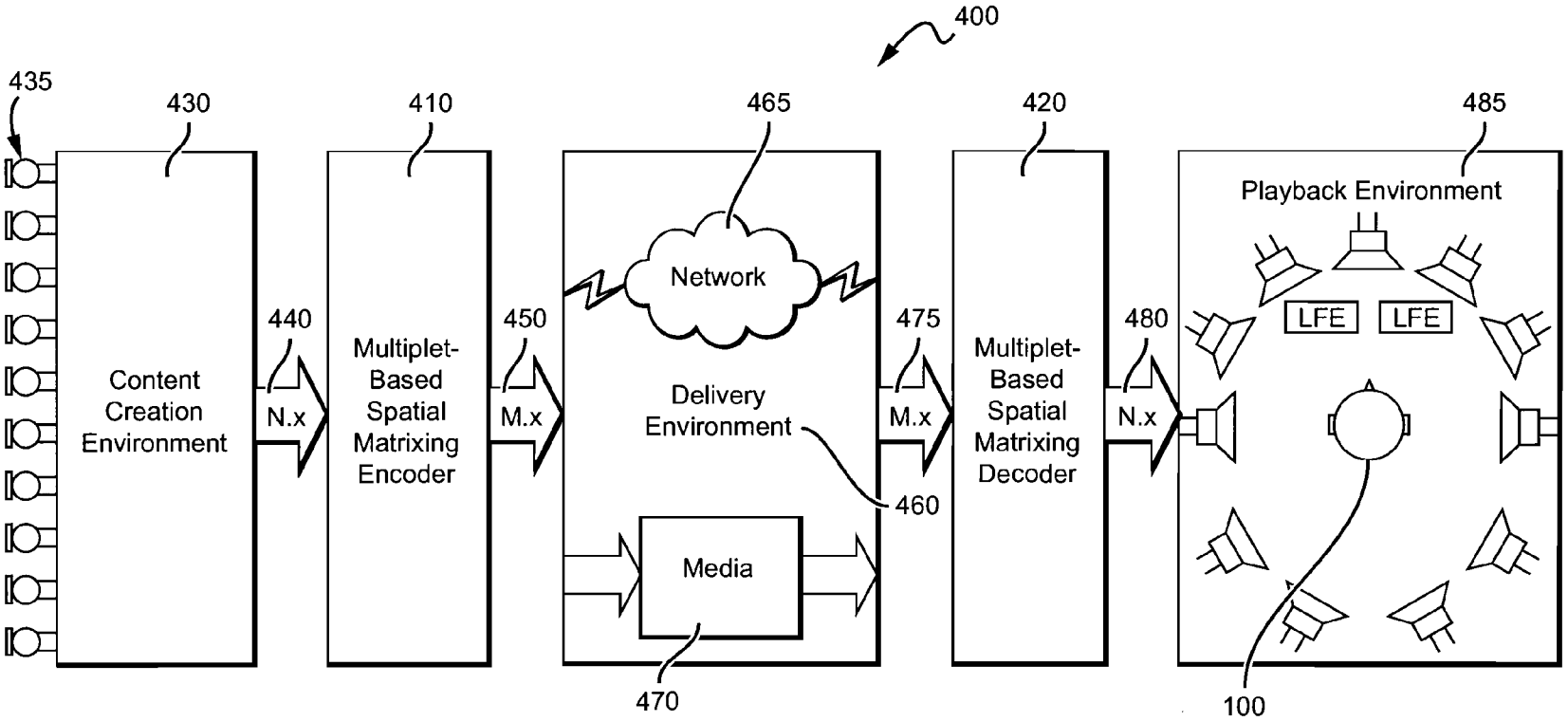
FIG. 4 is a block diagram illustrating a general overview of embodiments of the multiplet-based spatial matrixing codec and method.

FIG. 4 is a block diagram illustrating a general overview of embodiments of the multiplet-based spatial matrixing codec 400 and method. Referring to FIG. 4, the codec 400 includes a multiplet-based spatial matrixing encoder 410 and a multiplet-based spatial matrixing decoder 420. Initially, audio content (such as musical tracks) is created in a content creation environment 430. This environment 430 may include a plurality of microphones 435 (or other sound-capturing devices) to record audio sources. Alternatively, the audio sources may already be a digital signal such that it is not necessary to use a microphone to record the source. Whatever the method of creating the sound, each of the audio sources is mixed into a final mix as the output of the content creation environment 430.

The content creator selects an N.x base mix that best represents the creator's spatial intent, where N represents the number of regular channels and x represents the number of low-frequency channels. Moreover, N is a positive integer greater than 1, and x is a non-negative integer. For example, in an 11.1 surround system, N=11 and x=1. This of course is subject to a maximum number of channels, such that $N+x \leq MAX$, where MAX is a positive integer representing the maximum number of allowable channels.

In FIG. 4, the final mix is an N.x mix 440 such that each of the audio sources is mixed into N+x number of channels. The final N.x mix 440 then is encoded and downmixed using the multiplet-based spatial matrixing encoder 410. The encoder 410 is typically located on a computing device having one or more processing devices. The encoder 410 encodes and downmixes the final N.x mix into an M.x mix 450 having M regular channels and x low-frequency channels, where M is a positive integer greater than 1, and M is less than N.

The M.x 450 downmix is delivered for consumption by a listener through a delivery environment 460. Several delivery options are available, including streaming delivery over a network 465. Alternatively, the M.x 450 downmix may be recorded on a media 470 (such as optical disk) for consumption by the listener. In addition, there are many other delivery options not enumerated here that may be used to deliver the M.x 450 downmix.

The output of the delivery environment is an M.x stream 475 that is input to the multiplet-based spatial matrixing decoder 420. The decoder 420 decodes and upmixes the M.x stream 475 to obtain a reconstructed N.x content 480. Embodiments of the decoder 420 are typically located on a computing device having one or more processing devices.

Embodiments of the decoder 420 extract the PCM audio from the compressed audio stored in the M.x stream 475. The decoder 420 used is based upon which audio compression scheme was used to compress the data. Several types of audio compression schemes may be used in the M.x stream, including lossy compression, low-bitrate coding, and lossless compression.

The decoder 420 decodes each channel of the M.x stream 475 and expands them into discrete output channels represented by the N.x output 480. This reconstructed N.x output 480 is reproduced in a playback environment 485 that includes a playback speaker (or channel) layout. The playback speaker layout may or may not be the same as the content creation speaker layout. The playback speaker layout shown in FIG. 4 is an 11.2 layout. In other embodiments, the playback speaker layout may be headphones such that the speakers are merely virtual speakers from which sound appears to originate in the playback environment 485. For example, the listener 100 may be listening to the reconstructed N.x mix through headphones. In this situation, the speakers are not actual physical speakers but sounds appear to originate from different spatial locations in the playback environment 485 corresponding, for example, to an 11.2 surround sound speaker configuration.

Backward-Incompatible Embodiments of the Encoder

Figure 5:
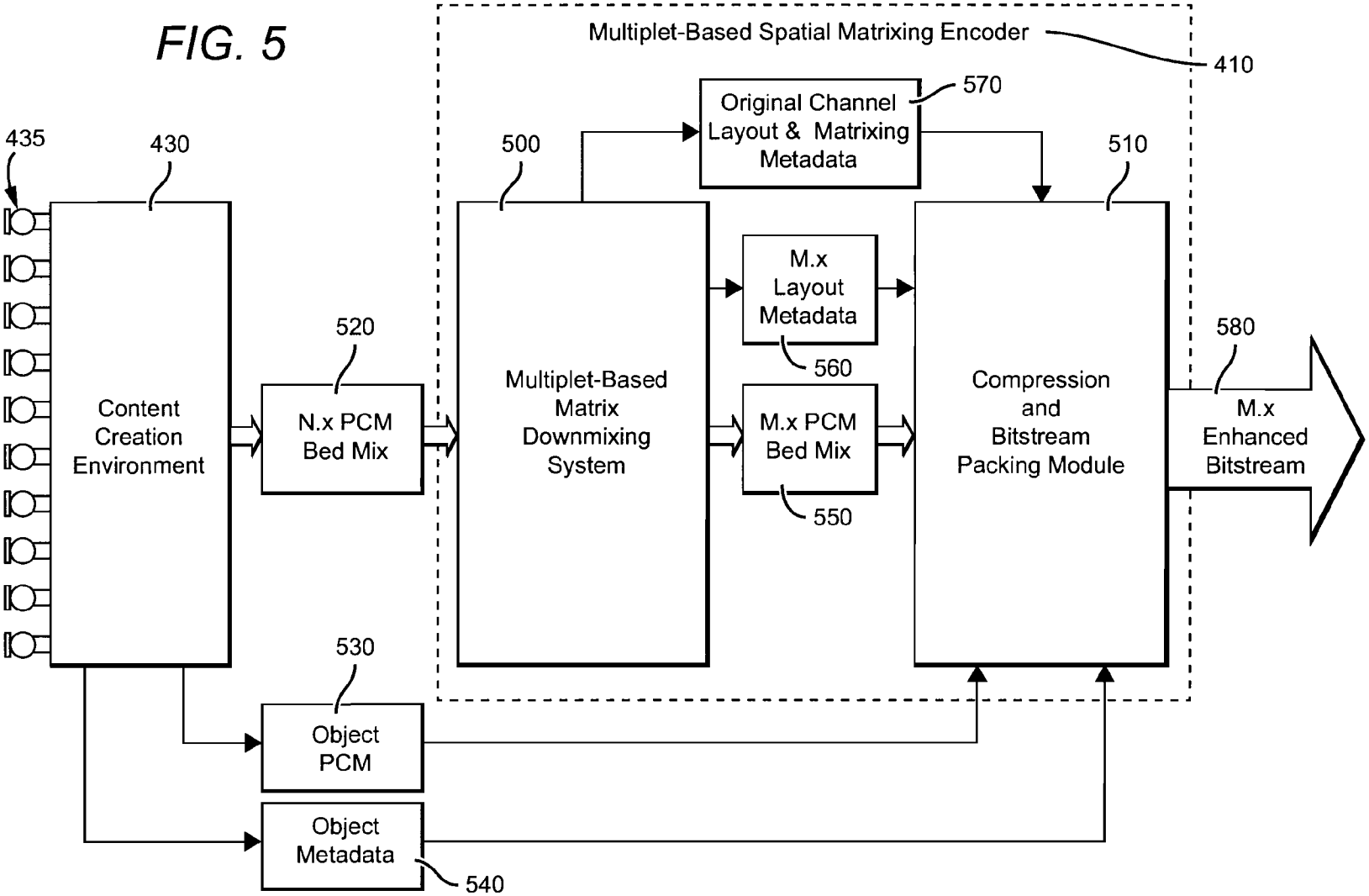
FIG. 5 is a block diagram illustrating the details of non-legacy embodiments of the multiplet-based spatial matrixing encoder shown in FIG. 4.

FIG. 5 is a block diagram illustrating the details of non-legacy embodiments of the multiplet-based spatial matrixing encoder 410 shown in FIG. 4. In these non-legacy embodiments, the encoder 410 does not encode the content such that backward compatibility is maintained with legacy decoders. Moreover, embodiments of the encoder 410 make use of various types of metadata that is contained in a bitstream along with audio data. As shown in FIG. 5, the encoder 410 includes a multiplet-based matrix mixing system 500 and a compression and bitstream packing module 510. The output from the content creation environment 430 includes an N.x pulse-code modulation (PCM) bed mix 520, which contains the channel-based audio information, and the object-based audio information, which includes an object PCM data 530 and associated object metadata 540. It should be noted that in FIGS. 5-8 the hollow arrows indicate time-domain data while the solid arrows indicate spatial data. For example, the arrow from the N.x PCM bed mix 520 to the multiplet-based matrix mixing system 500 is a hollow arrow and indicates time-domain data. The arrow from the content creation environment 430 to the object PCM 530 is a solid arrow and indicates spatial data.

The N.x PCM bed mix 520 is input to the multiplet-based matrix mixing system 500. The system 500 processes the N.x PCM bed mix 520, as explained in detail below, and reduces the channel count of the N.x PCM bed mix to an M.x PCM bed mix 550. In addition, the system 500 output assorted information, including an M.x layout metadata 560, which is data about the spatial layout of the M.x PCM bed mix 550. The system 500 also outputs information about the original channel layout and matrixing metadata 570. The original channel layout is spatial information about the layout of the original channels in the content creation environment 430. The matrixing metadata contains information about the different coefficients used during the downmixing. In particular, it contains information about how the channels were encoded into the downmix so that the decoder knows the correct way to upmix.

As shown in FIG. 5, the object PCM 530, the object metadata 540, the M.x PCM bed mix 550, the M.x layout metadata 560, and the original channel layout and matrixing metadata 570 all are input to the compression and bitstream packing module 510. The module 510 takes this information, compresses it, and packs it into an M.x enhanced bitstream 580. The bitstream is referred to as enhanced because in addition to audio data it also contains spatial and other types of metadata.

Embodiments of the multiplet-based matrix mixing system 500 reduce the channel count by examining such variables as a total available bitrate, minimum bitrate per channel, a discrete audio channel, and so forth. Based on these variables, the system 500 takes the original N channels and downmixes them to M channels. The number M is dependent on the data rate. By way of example, if N equals 22 original channels and the available bitrate is 500 Kbits/second, then the system 500 may determine that M has to be 8 in order to achieve the bitrate and encode the content. This means that there is only enough bandwidth to encode 8 audio channels. These 8 channels then will be encoded and transmitted.

The decoder 420 will know that these 8 channels came from an original 22 channels, and we upmix those 8 channels back up to 22 channels. Of course there will be some level of spatial fidelity lost in order to achieve the bitrate. For example, assume that the given minimum bitrate per channel is 32 Kbits/channel. If the total bitrate is 128 bits/second, then 4 channels could be encoded at 32 Kbits/channel. In another example, suppose that the input to the encoder 410 is an 11.1 base mix, the given bitrate is 128 kbits/second, and the minimum bitrate per channel is 32 Kbits/second. This means that the codec 400 and method would take those 11 original channels and downmix them to 4 channels, transmit the 4 channels, and at the decode side upmix those 4 channels back to 11 channels.

Backward-Incompatible Embodiments of the Decoder

Figure 6:
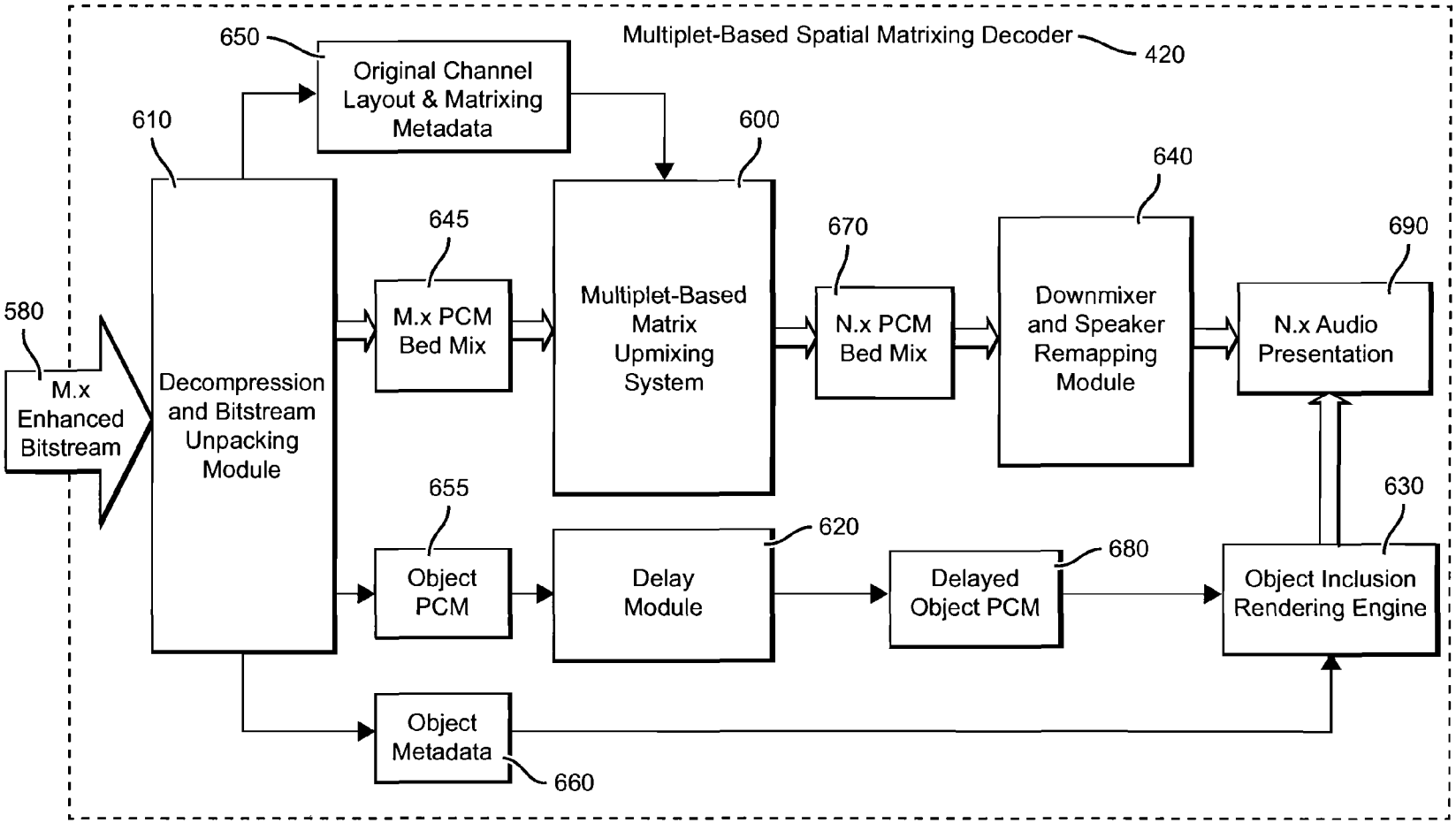
FIG. 6 is a block diagram illustrating the details of non-legacy embodiments of the multiplet-based spatial matrixing decoder shown in FIG. 4.

The M.x enhanced bitstream 580 is delivered to a receiving device containing the decoder 420 for rendering. FIG. 6 is a block diagram illustrating the details of non-legacy embodiments of the multiplet-based spatial matrixing decoder shown in FIG. 4. In these non-legacy embodiments, the decoder 420 does not retain backward compatibility with previous types of bitstreams and cannot decode them. As shown in FIG. 6, the decoder 420 includes a multiplet-based matrix upmixing system 600, a decompression and bitstream unpacking module 610, a delay module 620, an object inclusion rendering engine 630, and a downmixer and speaker remapping module 640.

As shown in FIG. 6, the input to the decoder 420 is the M.x enhanced bitstream 580. The decompression and bitstream unpacking module 610 then unpack and decompress the bitstream 580 back into PCM signals (including the bed mix and audio objects) and associated metadata. The output from the module 610 is an M.x PCM bed mix 645. In addition, the original (N.x) channel layout and the matrixing metadata 650 (including the matrixing coefficients), the object PCM 655, and the object metadata 660 are output from the module 610.

The M.x PCM bed mix 645 is processed by the multiplet-based matrix upmixing system 600 and upmixed. The multiplet-based matrix upmixing system 600 is discussed further below. The output of the system 600 is an N.x PCM bed mix 670, which is in the same channel (or speaker) layout configuration as the original layout. The N.x PCM bed mix 670 is processed by the downmixer and speaker remapping module 640 to map the N.x bed mix 670 into the listener's playback speaker layout. For example, if N=22 and M=11, then the 22 channels would be downmixed to 11 channels by the encoder 410. The decoder 420 then would take the 11 channels and upmix them back to 22 channels. But if the listener has only a 5.1 playback speaker layout, then the module 640 would downmix those 22 channels and remap them to the playback speaker layout for playback by the listener.

The downmixer and speaker remapping module 640 is responsible for adapting the content stored in the bitstream 580 to a given output speaker configuration. Theoretically, the audio can be formatted for any arbitrary playback speaker layout. The playback speaker layout is selected by the listener or the system. Based on this selection, the decoder 420 selects the channel sets that need to be decoded and determines whether speaker remapping and downmixing must be performed. The selection of output speaker layout is performed using an application programming interface (API) call.

When the intended playback loudspeaker layout does not match the actual playback loudspeaker layout of the playback environment 485 (or listening space), the overall impression of an audio presentation may be compromised. In order to optimize the audio presentation quality in a number of popular speaker configurations, the M.x enhanced bitstream can contain loudspeaker remapping coefficients.

There are two modes of operation for embodiments of the downmixer and speaker remapping module 640. First, a "direct mode" whereby the decoder 420 configures the spatial remapper to produce the originally-encoded channel layout over the given output speaker configuration as closely as possible. Second, a "non-direct mode" whereby embodiments of the decoder will convert the content to the selected output channel configuration, regardless of the source configuration.

The object PCM 655 gets delayed by the delay module 620 so that there is some level of latency while the M.x PCM bed mix 645 is processed by the multiplet-based matrix upmixing system 600. The output of the delay module 620 is delayed object PCM 680. This delayed object PCM 680 and the object metadata 660 are summed and rendered by the object inclusion rendering engine 630.

The object inclusion rendering engine 630 and an object removal rendering engine (discussed below) are the main engines for performing 3D object-based audio rendering. The primary job of these rendering engines is to add or subtract registered audio objects to or from a base mix. Each object comes with information dictating its position in a 3D space, including its azimuth, elevation, distance, gain, and a flag dictating if the object should be allowed to snap to the nearest speaker location. Object rendering performs the necessary processing to place the object at the position indicated. The rendering engines support both point and extended sources. A point source sounds as though it is coming from one specific spot in space, whereas extended sources are sounds with "width", a "height", or both.

The rendering engines use a spherical coordinate system representation. If an authoring tool in the content creation environment 430 represents the room as a shoe box, then transformation from concentric boxes to concentric spheres and back can be performed under the hood within an authoring tool. In this manner placement of sources on the walls maps to the placement of the sources on the unit sphere.

The bed mix from the downmixer and speaker remapping module and the output from the object inclusion rendering engine 630 are combined to provide an N.x audio presentation 690. The N.x audio presentation 690 is output from the decoder 420 and played back on the playback speaker layout (not shown).

It should be noted that some of the modules of the decoder 420 may be optional. For example, the multiplet-based matrix upmixing system 600 is not needed if N.M. Similarly, the downmix and speaker remapping module 640 are not needed if N.M. And the object inclusion rendering engine 630 is not needed if there are no objects in the M.x enhanced bitstream and the signal is only a channel-based signal.

Backward-Compatible Embodiments of the Encoder

Figure 7:
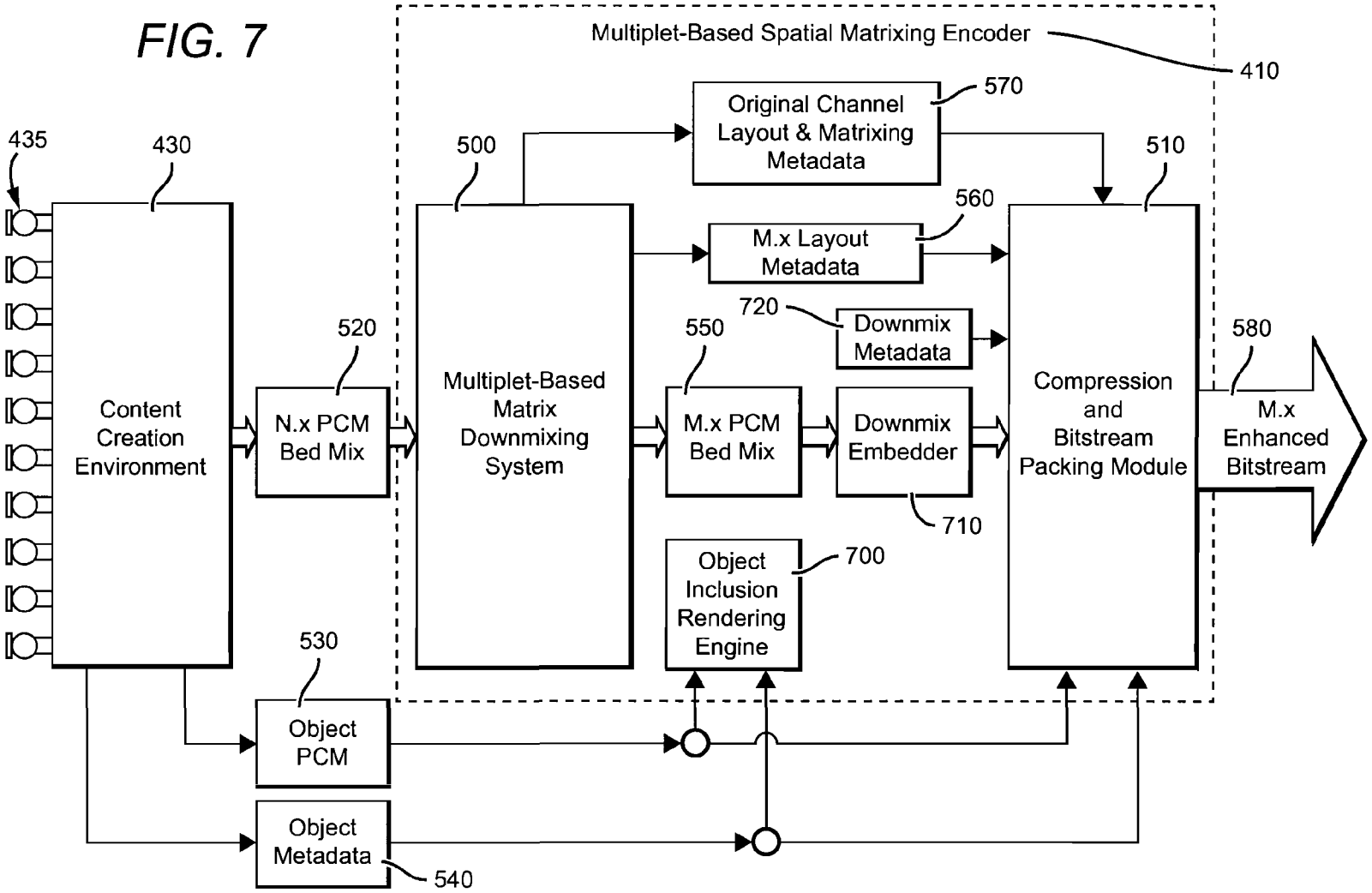
FIG. 7 is a block diagram illustrating the details of backward-compatible embodiments of the multiplet-based spatial matrixing encoder shown in FIG. 4.

FIG. 7 is a block diagram illustrating the details of legacy embodiments of the multiplet-based spatial matrixing encoder 410 shown in FIG. 4. In these legacy embodiments, the encoder 410 encodes the content such that backward compatibility is maintained with legacy decoders. Many components are the same as the backward-incompatible embodiments. Specifically, the multiplet-based matrix mixing system 500 still downmixes the N.x PCM bed mix 520 into the M.x PCM bed mix 550. The encoder 410 takes the object PCM 530 and object metadata 540 and mixes them into the M.x PCM bed mix 550 to create an embedded downmix. This embedded downmix is decodable by a legacy decoder. In these backward-compatible embodiments the embedded downmix include both the M.x bed mix and the objects to create a legacy downmix that legacy decoders can decode.

As shown in FIG. 7, the encoder 410 includes an object inclusion rendering engine 700 and a downmix embedder 710. For the purposes of backward compatibility, any audio information stored in audio objects is also mixed into the M.x bed mix 550 to create a base mix that legacy decoders can use. If the decoder system can render objects, then the objects must be removed from the base mix so that they are not doubly reproduced. The decoded objects are rendered to an appropriate bed mix specifically for this purpose and then subtracted from the base mix.

The object PCM 530 and the object metadata 540 are input to the engine 700 and are mixed with the M.x PCM bed mix 550. The result goes to the downmix embedder 710 that creates an embedded downmix. This embedded downmix, downmix metadata 720, M.x layout metadata 560, original channel layout and matrixing metadata 570, the object PCM 530, and the object metadata 540 are compressed and packed into a bitstream by the compression and bitstream packing module 510. The output is a backward-compatible M.x enhanced bitstream 580.

Backward-Compatible Embodiments of the Decoder

Figure 8:
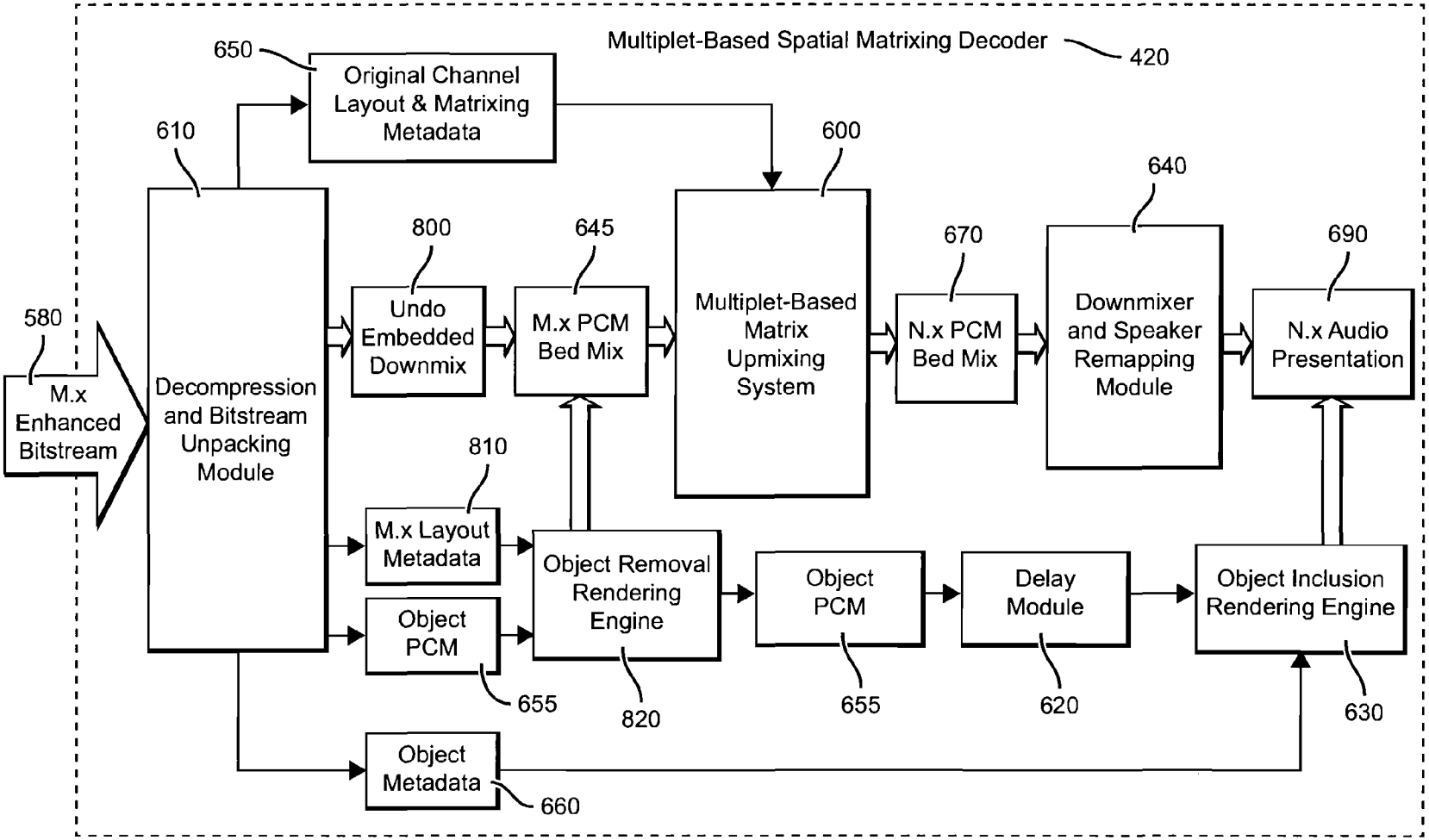
FIG. 8 is a block diagram illustrating the details of backward-compatible embodiments of the multiplet-based spatial matrixing decoder shown in FIG. 4.

The backward-compatible M.x enhanced bitstream 580 is delivered to a receiving device containing the decoder 420 for rendering. FIG. 8 is a block diagram illustrating the details of backward-compatible embodiments of the multiplet-based spatial matrixing decoder 420 shown in FIG. 4. In these backward-compatible embodiments, the decoder 420 retains backward compatibility with previous types of bitstreams to enable the decoder 420 to decode them.

The backward-compatible embodiments of the decoder 420 are similar to the non-backward compatible embodiments shown in FIG. 6 except that there is an object removal portion. These backward-compatible embodiments deal with legacy issues of the codec where it is desirable to provide a bitstream that legacy decoders can still decode. In these cases, the decoder 420 removes the objects from the embedded downmix and then upmixes to obtain the original upmix.

As shown in FIG. 8, the decompression and bitstream unpacking module 610 outputs the original channel layout and matrixing coefficients 650, the object PCM 655, and the object metadata 660. The output of the module 610 also undoes the embedded downmixing 800 of the embedded downmix to obtain the M.x PCM bed mix 645. This basically separates the channels and the objects from each other.

After encoding, the new, smaller channel layout may still have too many channels to store in the portion of the bitstream used by legacy decoders. In these cases, as noted above with reference to FIG. 7, an additional embedded downmix is performed to ensure that the audio from the channels not supported in older decoders is included in the backwards compatible mix. The extra channels present are downmixed into the backwards compatible mix and transmitted separately. When the bitstream is decoded for a speaker output format that will support more channels than the backwards compatible mix, the audio from the extra channels is removed from the mix and the discrete channels are used instead. This operation of undoing the embedded downmix 800 occurs before upmixing.

The output of the module 610 also includes M.x layout metadata 810. The M.x layout metadata 810 and the object PCM 655 are used by an object removal rendering engine 820 to render the removed objects into the M.x PCM bed mix 645. The object PCM 655 is also run through the delay module 620 and into the object inclusion rendering engine 630. The engine 630 takes the object metadata 660 the delayed object PCM 655 and renders the objects and N.x bed mix 670 into an N.x audio presentation 690 for playback on the playback speaker layout (not shown).

III. System Details

The system details of components of embodiments of the multiplet-based spatial matrixing codec and method will now be discussed. It should be noted that only a few of the several ways in which the modules, systems, and codecs may be implemented are detailed below. Many variations are possible from that which is shown in FIGS. 9 and 10.

Figure 9:
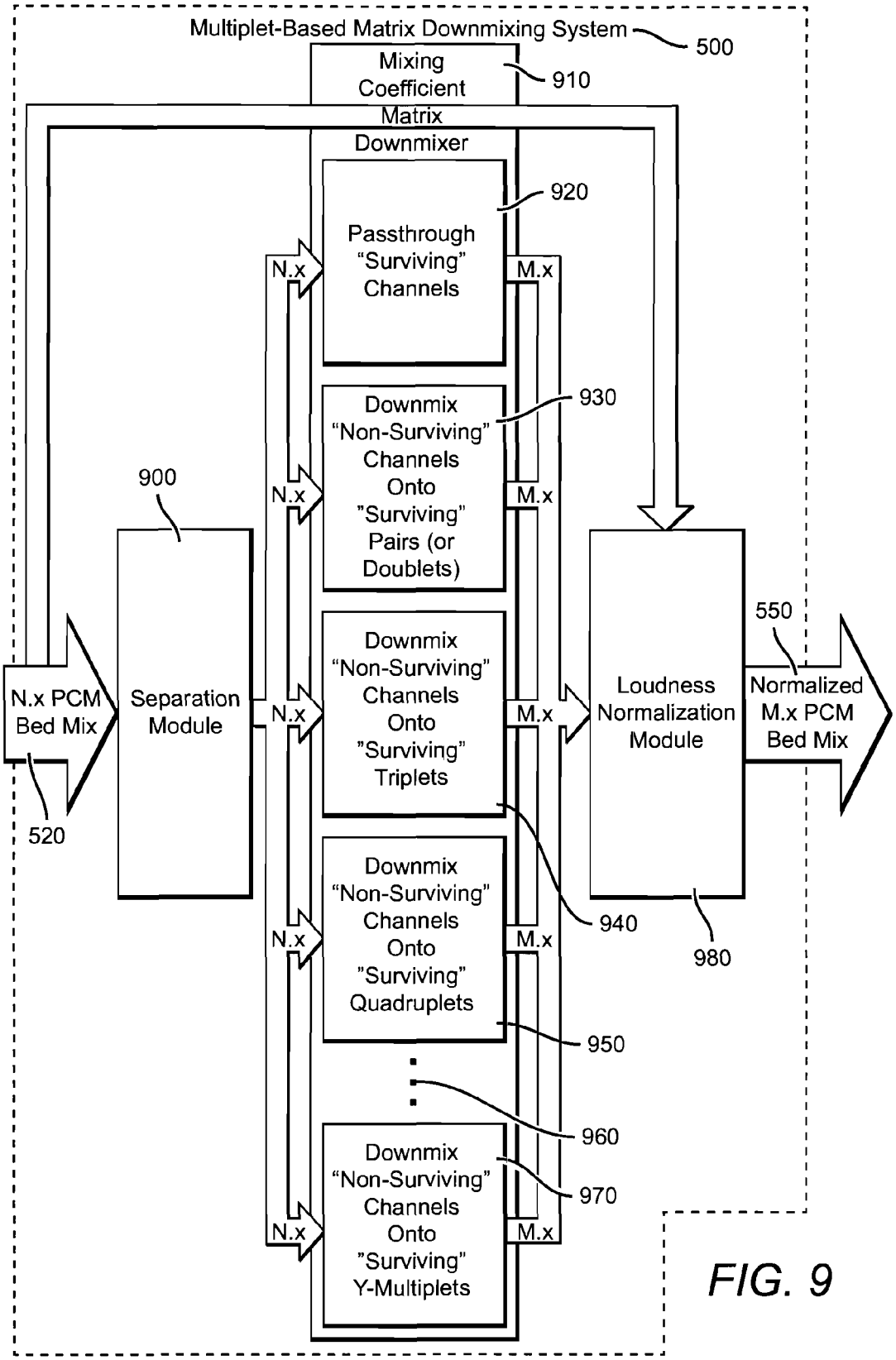
FIG. 9 is a block diagram illustrating details of exemplary embodiments of the multiplet-based matrix downmixing system shown in FIGS. 5 and 7.
Figure 10:
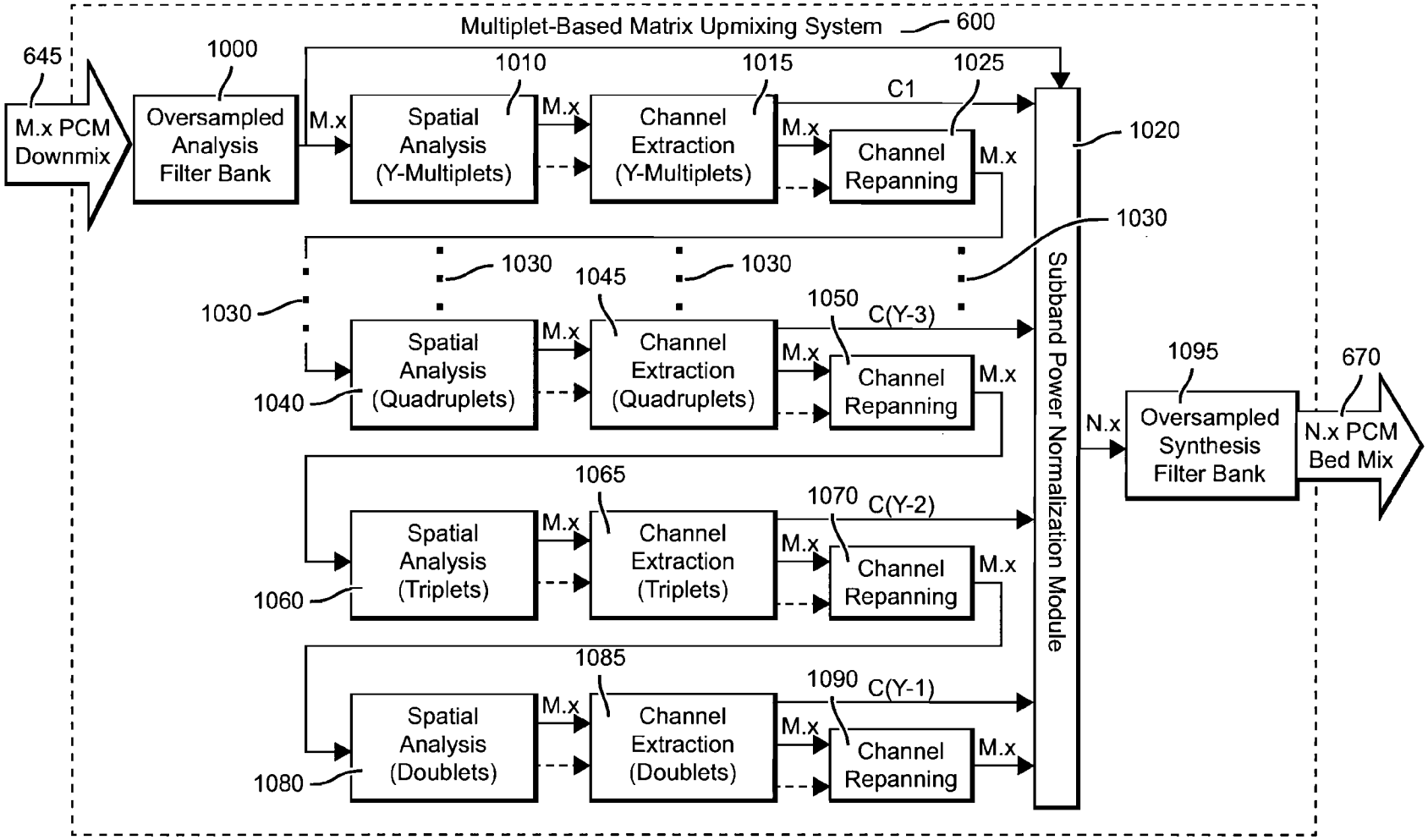
FIG. 10 is a block diagram illustrating details of exemplary embodiments of the multiplet-based matrix upmixing system shown in FIGS. 6 and 8.

FIG. 9 is a block diagram illustrating details of exemplary embodiments of the multiplet-based matrix downmixing system 500 shown in FIGS. 5 and 7. As shown in FIG. 9, the N.x PCM bed mix 520 is input to the system 500. The system includes a separation module that determines the number of channels that the input channels will be downmixed onto and which input channels are surviving channels and non-surviving channels. The surviving channels are the channels that are retained and the non-surviving channels are the input channels that are downmixed onto multiplets of the surviving channels.

The system 500 also includes a mixing coefficient matrix downmixer 910. The hollow arrows in FIG. 9 indicate that the signal is a time-domain signal. The downmixer 910 takes surviving channels 920 and passes them through without processing. Non-surviving channels are downmixed onto multiplets based on proximity. In particular, some non-surviving channels may be downmixed onto surviving pairs (or doublets) 930. Some non-surviving channels may be downmixed onto surviving triplets 940 of surviving channels. Some non-surviving channels may be downmixed onto surviving quadruplets 950 of surviving channels. This can continue for multiplets of any Y, where Y is a positive integer greater than 2. For example, if Y=8 then a non-surviving channel may be downmixed onto a surviving octuplet of surviving channels. This is shown in FIG. 9 by the ellipsis 960. It should noted that some, all, or any combination of multiplets may be used to downmix the N.x PCM bed mix 520.

The resultant M.x downmix from the downmixer 910 goes into a loudness normalization module 980. The normalization process is discussed more in detail below. The N.x PCM bed mix 520 is used to normalize the M.x downmix and the output is a normalized M.x PCM bed mix 550.

FIG. 10 is a block diagram illustrating details of exemplary embodiments of the multiplet-based matrix upmixing system 600 shown in FIGS. 6 and 8. In FIG. 10 the thick arrows represent time-domain signals and the dashed arrows represent subband-domain signals. As shown in FIG. 10, the M.x PCM bed mix 645 is input to the system 600. The M.x PCM bed mix 645 is processed by an oversampled analysis filter bank 1000 to obtain the various non-surviving channels that were downmixed to surviving channel Y-multiplets. In the first pass, a spatial analysis is performed on the Y-multiplets 1010 to obtain spatial information such as the radius and angle in space of the non-surviving channel. Next, the non-surviving channel is extracted from the Y-multiplets of surviving channels 1015. This first recaptured channel, C1, then is input to a subband power normalization module 1020. The channels involved in this pass then are repanned 1025.

These passes continue through each of the Y number of multiplets, as indicated by the ellipses 1030. The passes then continue sequentially until each of the Y-multiplets has been processed. FIG. 10 shows that the spatial analysis is performed on the quadruplets 1040 to obtain spatial information such as the radius and angle in space of the non-surviving channel downmixed to the quadruplets. Next, the non-surviving channel is extracted from the quadruplets of surviving channels 1045. The extracted channel, C(Y-3), is then input to the subband power normalization module 1020. The channels involved in this pass then are repanned 1050.

In the next pass the spatial analysis is performed on the triplets 1060 to obtain spatial information such as the radius and angle in space of the non-surviving channel downmixed to the triplets. Next, the non-surviving channel is extracted from the triplets of surviving channels 1065. The extracted channel, C(Y-2), is then input to the module 1020. The channels involved in this pass then are repanned 1070. Similarly, in the last pass the spatial analysis is performed on the doublets 1080 to obtain spatial information such as the radius and angle in space of the non-surviving channel downmixed to the doublets. Next, the non-surviving channel is extracted from the doublets of surviving channels 1085. The extracted channel, C(Y−1), is then input to the module 1020. The channels involved in this pass then are repanned 1090.

Each of the channels then are processed by the module 1020 to obtained a N.x upmix. This N.x upmix is processed by the oversampled synthesis filter bank 1095 to combine them into the N.x PCM bed mix 670. As shown in FIGS. 6 and 8, the N.x PCM bed mix then is input to the downmixer and speaker remapping module 640.

IV. Operational Overview

Embodiments of the multiplet-based spatial matrixing codec 400 and method are spatial encoding and decoding technologies that reduce channel counts (and thus bitrates), optimize audio quality by enabling tradeoffs between spatial accuracy and basic audio quality, and convert audio signal formats to playback environment configurations.

Embodiments of the encoder 410 and decoder 420 have two primary use-cases. A first use-case is the metadata use-case where embodiments of the multiplet-based spatial matrixing codec 400 and method are used to encode high-channel count audio signals onto a lower number of channels. In addition, this use-case includes decoding of the lower number of channels in order to recover an accurate approximation of the original high-channel count audio. A second use case is the blind upmix use-case that performs blind upmixing of legacy content in standard mono, stereo, or multi-channel layouts (such as 5.1 or 7.1) to 3D layouts consisting of both horizontal and elevated channel locations.

Metadata Use-Case

The first use-case for embodiments of the codec 400 and method is as a bitrate reduction tool. One example scenario where the codec 400 and method may be used for bitrate reduction is when the available bitrate per channel is below the minimum bitrate per channel supported by the codec 400. In this scenario, embodiments of the codec 400 and method may be used reduce the number of encoded channels, thus enabling a higher bitrate allocation for the surviving channels. These channels need to be encoded with sufficiently high bitrate to prevent unmasking of artifacts after dematrixing.

In this scenario the encoder 410 may use matrixing for bit-rate reduction dependent on one or more of the following factors. One factor is the minimum bitrate per channel required for discrete channel encoding (designated as MinBR_Discr). Another factor is the minimum bit-rate per channel required for matrixed channel encoding (designated as MinBR_Mtrx). Still another factor is the total available bit-rate (designated as BR_Tot).

Whether the encoder 410 engages (when (M<N) matrixing or not (when M=N) is decided based on the following formula:

$$M = \begin{cases} N, & \frac{\text{BR_Tot}}{N} \geq \text{MinBr_Discr} \\ \left\lfloor \frac{\text{BR_Tot}}{\text{MinBR_Mtrx}} \right\rfloor, & o.w. \end{cases}$$

In addition, the original channel layout and metadata describing the matrixing procedure is carried in the bitstream. Moreover, the value of the MinBR_Mtrx is chosen to be sufficiently high (for each respective codec technology) to prevent unmasking of artifacts after dematrixing.

On the decoder 420 side, upmixing is performed just to bring the format to the original N.x layout or some proper sub-set of the N.x layout. There is upmixing is needed for further format conversion. It is assumed that the spatial resolution carried in the original N.x layout is the intended spatial resolution, hence any further format conversion will consist of just downmixing and possible speaker remapping. In the case of a channel-based only stream, the surviving M.x layout may be used directly (without applying dematrixing) as a starting point for the derivation of a desired downmix K.x (K<M) at the decoder side (M, N are integers with N larger than M).

Another example scenario where the codec 400 and method may be used for bitrate reduction is when the original high-channel count layout has high spatial accuracy (such as 22.2) and the available bitrate is sufficient to encode all channels discretely, but not sufficient enough to provide a near-transparent basic audio quality level. In this scenario, embodiments of the codec 400 and method may be used to optimize overall performance by slightly sacrificing spatial accuracy, but in return allowing an improvement in basic audio quality. This is achieved by converting the original layout to a layout with less channels, sufficient spatial accuracy (such as 11.2), and allocating all of the bitpool to surviving channels to provide bring basic audio quality to a higher level while not having a great impact on the spatial accuracy.

In this example, the encoder 410 uses matrixing as a tool to optimize overall quality by slightly sacrificing spatial accuracy but in return allowing an improvement in basic audio quality. The surviving channels are chosen to best preserve the original spatial accuracy with a minimum number of encoded channels. In addition, the original channel layout and metadata describing the matrixing procedure is carried in the stream.

The encoder 410 selects a bitrate per channel that may be sufficiently high to allow object inclusion into the surviving layout, as well as further downmix embedding. Moreover, either M.x or an associated embedded downmix may be directly playable on a 5.1/7.1 systems.

The decoder 420 in this example uses upmixing is performed just to bring the format to the original N.x layout or some proper sub-set of the N.x layout. No further format conversion is needed. It is assumed that the spatial resolution carried in the original N.x layout is the intended spatial resolution, hence any further format conversion will consist of just downmixing and possibly speaker remapping.

For the above scenarios, the encoding and method described herein may be applied to a channel-based format or to the base-mix channels in an object plus base-mix format. The corresponding decoding operation will bring the channel-reduced layout back to the original high-channel count layout.

For channel-reduced signal to be property decoded, the decoder 420 described herein must be informed of the layouts, parameters, and coefficients that were used in the encoding process. The codec 400 and method defines a bitstream syntax for communicating such information from the encoder 410 to the decoder 420. For example, if the encoder 410 encoded a 22.2-channel base-mix to an 11.2-channel-reduced signal, then information describing the original layout, the channel-reduced layout, the contributing downmix channels, and the downmix coefficients will be transmitted to the decoder 420 to enable proper decoding back to the original 22.2-channel count layout.

Blind Upmix Use-Case

The second use-case for embodiments of the codec 400 and method is to perform blind upmixing of legacy content. This capability allows the codec 400 and method to convert legacy content to 3D layouts including horizontal and elevated channels matching the loudspeaker locations of the playback environment 485. Blind upmixing can be performed on standard layouts such as mono, stereo, 5.1, 7.1, and others.

General Overview

FIG. 11 is a flow diagram illustrating the general operation of embodiments of the multiplet-based spatial matrixing codec 400 and method shown in FIG. 4. The operation begins by selecting M number of channels to include in a downmixed output audio signal (box 1100). This selection is based on a desired bitrate, as described above. It should be noted that N and M are non-zero positive integers and N is greater than M.

Next, the N channels are downmixed and encoded to M channels using a combination of multiplet pan laws to obtain PCM bed mix containing M multiplet-encoded channels (box 1110). The method then transmits PCM bed mix at or below the desired bitrate over a network (box 1120). The PCM bed mix is received and separated into the plurality of M number of multiplet-encoded channels (box 1130).

The method then upmixes and decodes each of the M multiplet-encoded channels using a combination of multiplet pan laws to extract the N channels from the M multiplet-encoded channels and obtain a resultant output audio signal having N channels (box 1140). This resultant output audio signal is rendered in a playback environment having a playback channel layout (box 1150).

Embodiments of the codec 400 and method, or aspects thereof, is used in a system for delivery and recording of multichannel audio, especially when large numbers of channels are to be transmitted or recorded (more than 7). For example, in one such system a multitude of channels are recorded and are assumed to be configured in a known playback geometry having L channels disposed at ear level around the listener, P channels disposed around a height ring disposed at higher than ear level, and optionally a center channel at or near the Zenith above the listener (where L and P are arbitrary integers larger than 1). The P channels may be arranged according to various conventional geometries, and the presumed geometry is known to a mixing engineer or recording artist/engineer. According to the invention, the L plus P channel count is reduced by a novel method of matrix mixing to a lower number of channels (for example, L+P mapped onto L only). The reduced-count channels are then encoded and compressed by known methods that preserve the discrete nature of the reduced-count channels.

On decoding, the operation of the system depends upon the decoder capabilities. In legacy decoders the reduced count (L) channels are reproduced, having the P channels mixed therein. In a more advanced decoder according to the invention, the full consort of L+P channels are recoverable by upmixing and routed each to a corresponding one of the L+P speakers.

In accordance with the invention, both upmixing and downmixing operations (matrixing/dematrixing) include a combination of pairwise, triplet, and preferably quadruplet pan laws to place the perceived sound sources, upon reproduction, closely corresponding to the presumed locations intended by the recording artist or engineer.

The matrixing operation (channel layout reduction) can be applied to the base-mix channels in a) a base-mix+object composition of the stream or b) a channel-based only composition of the stream.

In addition, the matrixing operation can be applied to the stationary objects (objects that are not moving around) and after dematrixing still achieve sufficient object separation that will allow level modifications for individual

V. Operational Details

The operational details of embodiments of the multiplet-based spatial matrixing codec 400 and method now will be discussed.

V.A. Downmix Architecture

In an exemplary embodiment of the multiplet-based matrix downmixing system 500, the system 500 accepts an N-channel audio signal and outputs an M-channel audio signal, where N and M are integers and N is greater than M. The system 500 may be configured using knowledge of the content creation environment (original) channel layout, the downmixed channel layout, and mixing coefficients that describe the mixing weights that each original channel will contribute to each downmixed channel. For example, the mixing coefficients may be defined by a matrix C of size M×N, where the rows correspond to the output channels and the columns correspond to the input channels, such as:

$$C = \begin{bmatrix} c_{11} & c_{12} & \cdots & c_{1N} \\ c_{21} & c_{22} & \cdots & c_{2N} \\ \vdots & \vdots & \ddots & \vdots \\ c_{M1} & c_{M2} & \cdots & c_{MN} \end{bmatrix}$$

In some embodiments the system 500 may then perform the downmixing operation as:

$$y_i[n] = \sum_{j=1}^{N} c_{ij} \cdot x_j[n],\ 1 \le i \le M$$

where $x_j[n]$ is the j-th channel of the input audio signal where $1 \le j \le N$, $y_i[n]$ is the i-th channel of the output audio signal where $1 \le i \le M$, and $c_{ij}$ is the mixing coefficient corresponding to the ij entry of matrix C.

Loudness Normalization

Some embodiments of the system 500 also include a loudness normalization module 980, shown in FIG. 9. The loudness normalization process is designed to normalize the perceived loudness of the downmixed signal to that of the original signal. While the mixing coefficients of matrix C are commonly chosen to preserve power for a single original signal component, for example a standard sin/cos panning law will preserve power for a single component, for more complex signal material the power preservation properties will not hold. Because the downmix process combines audio signals in the amplitude domain and not the power domain, the resulting signal power of the downmixed signal is unpredictable and signal-dependent. Furthermore, it may be desirable to preserve perceived loudness of the downmixed audio signal instead of signal power since loudness is a more relevant perceptual property.

The loudness normalization process is performed by comparing the ratio of the input loudness to the downmixed loudness. The input loudness is estimated via the following equation:

$$L_{in} = \sqrt{\sum_{j=1}^{N} (h_j[n] * x_j[n])^2}$$

where $L_{in}$ is the input loudness estimate, $h_j[n]$ is a frequency weighting filter such as a "K" frequency weighting filter as described in the ITU-R BS.1770-3 loudness measurement standard, and (*) denotes convolution.

As can be observed, the input loudness is essentially a root-mean-squared (RMS) measure of the frequency weighted input channels, where the frequency weighting is designed to improve correlation with the human perception of loudness. Likewise, the output loudness is estimated via the following equation:

$$L_{out} = \sqrt{\sum_{i=1}^{M} (h_i[n] * y_i[n])^2}$$

where $L_{out}$ is the output loudness estimate.

Now that estimates of both the input and output perceived loudness have been computed, we can normalize the downmixed audio signal such that the loudness of the downmixed signal will be approximately equal to the loudness of the original signal via the following normalization equation:

$$y_i'[n] = \frac{L_{in}}{L_{out}} y_i[n],\ 1 \le i \le M$$

In the above equation it can be observed that the loudness normalization process results in scaling all of the downmixed channels by the ratio of the input loudness to the output loudness.

Static Downmix

The static downmix for a given output channel $y_i[n]$:

$$y_i[n]=c_{i,1}x_1[n]+c_{i,2}x_2[n]+\ldots+c_{i,N}x_N[n]$$

where $x_j[n]$ are the input channels and $c_{i,j}$ are the downmix coefficients for output channel i and input channel j.

Per-Channel Loudness Normalization

Dynamic downmix using per-channel loudness normalization:

$$y_i'[n]=d_i[n]\cdot y_i[n]$$

where $d_i[n]$ is a channel-dependent gain given as $$d_i[n] = \sqrt{\frac{(c_{i,1}L(x_1[n]))^2 + (c_{i,2}L(x_2[n]))^2 + \ldots + (c_{i,N}L(x_N[n]))^2}{(L(y_i[n]))^2}}$$

and L(x) is a loudness estimation function such as defined in BS.1770.

Intuitively, the time-varying per-channel gains can be viewed as the ratio of the summed loudness of each input channel (weighted by the appropriate downmix coefficient) by the loudness of each statically downmixed channel.

Total Loudness Normalization

Dynamic downmix using total loudness normalization:

$$y_i''[n]=g[n]\cdot y_i'[n]$$

where g[n] is a channel-independent gain given as $$g[n] = \sqrt{\frac{(L(x_1[n]))^2 + (L(x_2[n]))^2 + \ldots + (L(x_N[n]))^2}{(L(y_1'[n]))^2 + (L(y_2'[n]))^2 + \ldots + (L(y_M'[n]))^2}}$$

Intuitively, the time-varying channel-independent gain can be viewed as the ratio of the summed loudness of the input channels by the summed loudness of the downmixed channels.

V.B. Upmix Architecture

In exemplary embodiments of the multiplet-based matrix upmixing system 600 shown in FIG. 6, the system 600 accepts an M-channel audio signal and outputs an N-channel audio signal, where M and N are integers and N is greater than M. In some embodiments the system 600 will target an output channel layout that is the same as the original channel layout as processed by a downmixer. In some embodiments the upmix processing is performed in the frequency-domain with the inclusion of analysis and synthesis filter banks. Performing the upmix processing in the frequency-domain allows for separate processing on a plurality of frequency bands. Processing multiple frequency bands separately allows the upmixer to handle situations where different frequency bands are simultaneously emanating from different locations in a sound field. Note however that it is also possible to perform the upmix processing on the broadband time-domain signals.

After the input audio signal has been converted to a frequency-domain representation, spatial analysis is performed on any quadruplet channel sets upon which surplus channels have been matrixed following the quadruplet mathematical framework previously described herein. Based on the quadruplet spatial analysis, output channels are extracted from the quadruplet sets, again following the previously described quadruplet framework. The extracted channels correspond to the surplus channels that were originally matrixed onto the quadruplet sets in the downmixing system 500. The quadruplet sets are then re-panned appropriately based on the extracted channels, again following the previously described quadruplet framework.

After quadruplet processing has been performed, the downmixed channels are passed to triplet processing modules where spatial analysis is performed on any triplet channel sets upon which surplus channels have been matrixed following the triplet mathematical framework previously described herein. Based on the triplet spatial analysis, output channels are extracted from the triplet sets, again following the previously described triplet framework. The extracted channels correspond to the surplus channels that were originally matrixed onto the triplet sets in the downmixing system 500. The triplet sets are then re-panned appropriately based on the extracted channels, again following the previously described triplet framework.

After triplet processing has been performed, the downmixed channels are passed to pairwise processing modules where spatial analysis is performed on any pairwise channel sets upon which surplus channels have been matrixed following the pairwise mathematical framework previously described herein. Based on the pairwise spatial analysis, output channels are extracted from the pairwise sets, again following the previously described pairwise framework. The extracted channels correspond to the surplus channels that were originally matrixed onto the pairwise sets in the downmixing system 500. The pairwise sets are then re-panned appropriately based on the extracted channels, again following the previously described pairwise framework.

At this point, the N-channel output signal has been generated (in the frequency-domain) and consists of all of the extracted channels from the quadruplet, triplet, and pairwise sets as well as the re-panned downmixed channels. Before converting the channels back to the time-domain, some embodiments of the upmixing system 600 may perform a subband power normalization which is designed to normalize the total power within each output subband to that of each input downmixed subband. The total power of each input downmixed subband can be estimated as:

$$P_{in}[m, k] = \sqrt{\sum_{i=1}^{M} |Y_i[m, k]|^2}$$

where $Y_i[m,k]$ is the i-th input downmixed channel in the frequency-domain, $P_{in}[m,k]$ is the subband total downmixed power estimate, m is the time index (possibly decimated due to the filter bank structure), and k is the subband index.

Similarly, the total power of each output subband can be estimated as:

$$P_{out}[m,k] = \sqrt{\sum_{j=1}^{N} |Z_j[m,k]|^2}$$

where $Z_j[m,k]$ is the j-th output channel in the frequency-domain and $P_{out}[m,k]$ is the subband total output power estimate.

Now that estimates of both the input and output subband powers have been computed, we can normalize the output audio signal such that the power of the output signal per subband will be approximately equal to the power of the input downmixed signal per subband via the following normalization equation:

$$Z'_j[m,k] = \frac{P_{in}[m,k]}{P_{out}[m,k]} Z_j[m,k],\ 1 \le j \le N$$

In the above equation it can be observed that the subband power normalization process results in scaling all of the output channels by the ratio of the input power to the output power per subband. If the upmixer is not performed in the frequency-domain, then a loudness normalization process may be performed instead of the subband power normalization process similar to that as described in the downmix architecture.

Once all output channels have been generated and subband powers have been normalized, the frequency-domain output channels are sent to a synthesis filter bank module which converts the frequency-domain channels back to time-domain channels.

V.C. Mixing, Panning, and Upmix Laws

The actual matrix downmixing and complementary upmixing in accordance with embodiments of the codec 400 and method are performed using a combination of pairwise, triplet, and preferably also quadruplet mixing laws, depending on speaker configuration. In other words, if in recording/mixing a particular speaker is to be eliminated or virtualized by downmixing, a decision is applied whether the position is a case of: a) on or near a line segment between a pair of surviving speakers, b) within a triangle defined by 3 surviving channel/speakers, or c) within a quadrilateral defined by four channel speakers, each disposed at a vertex.

This last case is advantageous for matrixing a height channel disposed at the zenith, for example. Also note that in other embodiments of the codec 400 and method the matrixing could be extended beyond quadruplet channel sets if the geometry of the original and downmixed channel layouts required it, such as to quintuplet or sextuplet channel sets.

In some embodiments of the codec 400 and method, the signal in each audio channel is filtered into a plurality of subbands, for example perceptually relevant frequency bands such as "Bark bands." This may advantageously be done by a band of quadrature mirror filters or by polyphase filters, followed optionally by decimation to reduce the required number of samples in each subband (known in the art). Following filtering, the matrix downmix analysis should be performed independently in each perceptually significant subband in each coupled set of audio channels (pair, triplet, or quad). Each coupled set of subbands is then analyzed and processed preferably by the equations and methods set forth below to provide an appropriate downmix, from which the original discrete subband channel set can be recovered by performing a complementary upmix in each subband-channel-set at a decoder.

The following discussion sets forth the preferred method, in accordance with embodiments of the codec 400 and method, for downmixing (and complementary upmixing) N to M channels (and vice versa) where each of the surplus channels is mixed either to a channel pair (doublet), triplet, or quadruplet. The same equations and principles are applicable whether mixing in each subband or in wideband signal-channels.

In the decoder-upmix case, the order of operations is significant in that it is very strongly preferred, according to embodiments of the codec 400 and method, to first process quadruplet sets, then triplet sets, then channel-pairs. This can be extended to cases where there are Y-multiplets, such that the largest multiplet is processed first, followed by the next largest multiplet, and so forth. Processing the channel sets with the largest number of channels first allows the upmixer to analyze the broadest and most general channel relationships. By processing the quadruplet sets prior to the triplet or pairwise sets, the upmixer can accurately analyze the relevant signal components that are common across all channels included in the quadruplet set. After the broadest channel relationships are analyzed and processed via the quadruplet processing, the next broadest channel relationships can be analyzed and processed via the triplet processing. The most limited channel relationships, the pairwise relationships, are processed last. If the triplet or pairwise sets happened to be processed before the quadruplet sets, then although some meaningful channel relationships may be observed across the triplet or pairwise channels, those observed channel relationships would only be a subset of the true channel relationships.

As an example, consider a scenario where a given channel (call this channel A) of an original audio signal is downmixed onto a quadruplet set. At the upmixer, the quadruplet processing will be able to analyze the common signal components of channel A across that quadruplet set and extract an approximation of the original audio channel A. Any subsequent triplet or pairwise processing will be performed as expected and no further analysis or extraction will be carried out on the channel A signal components since they have already been extracted. If instead triplet processing is performed prior to the quadruplet processing (and the triplet set is a subset of the quadruplet set), then the triplet processing will analyze the common signal components of channel A across that triplet set and extract an audio signal to a different output channel (i.e. not output channel A). If the quadruplet processing is then performed after the triplet processing, then the original audio channel A will not be able to be extracted since only a portion of the channel A signal components will still exist across the quadruplet channel set (i.e. a portion of the channel A signal components have already been extracted during the triplet processing).

As explained above, processing quadruplet sets first, followed by triplet sets, followed by pairwise sets last is the preferred sequence of processing. It should be noted that although the above discussion addresses pairwise (doublet), triplet, and quadruplet sets, any number of sets are possible.

For pairwise sets a line is formed, for triplet sets a triangle is formed, and for quadruplet sets a square is formed. However, additional types of polygons are possible.

V.D. Pairwise Matrixing Case

In accordance with embodiments of the codec 400 and method, when the location of a non-surviving (or surplus) channel lies between a doublet defined by the positions of two surviving channels (or corresponding subbands in surviving channels), the channel to be downmixed should be matrixed in accordance with a set of doublet (or pairwise) channel relationships, as set forth below.

Embodiments of the multiplet-based spatial matrixing codec 400 and method calculate an inter-channel level difference between the left and right channels. This calculation is shown in detail below. Moreover, the codec 400 and method use the inter-channel level difference to compute an estimated panning angle. In addition, an inter-channel phase difference is computed by the method using the left and right input channels. This inter-channel phase difference determines a relative phase difference between the left and right input channels that indicates whether the left and right signals of the two-channel input audio signal are in-phase or out-of-phase.

Some embodiments of the codec 400 and method utilize a panning angle (θ) to determine the downmix process and subsequent upmix process from the two-channel downmix. Moreover, some embodiments assume a Sin/Cos panning law. In these situations, the two-channel downmix is calculated as a function of the panning angle as:

$$L = \pm\cos\left(\theta\frac{\pi}{2}\right)X_i$$

$$R = \pm\sin\left(\theta\frac{\pi}{2}\right)X_i$$

where $X_i$ is an input channel, L and R are the downmix channels, θ is a panning angle (normalized between 0 and 1), and the polarity of the panning weights is determined by the location of input channel $X_i$. In traditional matrixing systems it is common for input channels located in front of the listener to be downmixed with in-phase signal components (in other words, with equal polarity of the panning weights) and for output channels located behind the listener to be downmixed with out-of-phase signal components (in other words, with opposite polarity of the panning weights).

FIG. 12 illustrates the panning weights as a function of the panning angle (θ) for the Sin/Cos panning law. The first plot 1200 represents the panning weights for the right channel ($W_R$). The second plot 1210 represents the weights for the left channel ($W_L$). By way of example and referring to FIG. 12, a center channel may use a panning angle of 0.5 leading to the downmix functions:

$$L=0.707\cdot C$$

$$R=0.707\cdot C$$

To synthesize the additional audio channels from a two-channel downmix, an estimate of the panning angle (or estimated panning angle, denoted as $\hat{\theta}$) can be calculated from the inter-channel level difference (denoted as ICLD). Let the ICLD be defined as:

$$ICLD = \frac{L^2}{L^2 + R^2}$$

Assuming that a signal component is generated via intensity panning using the Sin/Cos panning law, the ICLD can be expressed as a function of the panning angle estimate:

$$ICLD = \frac{\cos^2\left(\hat{\theta}\frac{\pi}{2}\right)}{\cos^2\left(\hat{\theta}\frac{\pi}{2}\right) + \sin^2\left(\hat{\theta}\frac{\pi}{2}\right)} = \cos^2\left(\hat{\theta}\frac{\pi}{2}\right)$$

The panning angle estimate then can be expressed as a function of the ICLD:

$$\hat{\theta} = \frac{2\cdot\cos^{-1}\left(\sqrt{ICLD}\right)}{\pi}$$

The following angle sum and difference identities will be used throughout the remaining derivations:

$$\sin(\alpha\pm\beta)=\sin(\alpha)\cos(\beta)\pm\cos(\alpha)\sin(\beta)$$

$$\cos(\alpha+\beta)=\cos(\alpha)\cos(\beta)\mp\sin(\alpha)\sin(\beta)$$

Moreover, the following derivations assume a 5.1 surround sound output configuration. However, this analysis can easily be applied to additional channels.

Center Channel Synthesis

A Center channel is generated from a two-channel downmix using the following equation:

$$C=aL+bR$$

where the a and b coefficients are determined based on the panning angle estimate $\hat{\theta}$ to achieve certain pre-defined goals.

In-Phase Components

For the in-phase components of the Center channel a desired panning behavior is illustrated in FIG. 13. FIG. 13 illustrates panning behavior corresponding to an in-phase plot 1300 given by the equation:

$$C=\sin(\hat{\theta}\pi)$$

Substituting the desired Center channel panning behavior for in-phase components and the assumed Sin/Cos downmix functions yields:

$$\sin(\hat{\theta}\pi) = a\cdot\cos\left(\hat{\theta}\frac{\pi}{2}\right) + b\cdot\sin\left(\hat{\theta}\frac{\pi}{2}\right)$$

Using the angle sum identities, the dematrixing coefficients, including a first dematrixing coefficient (denoted as a) and a second dematrixing coefficients (denoted as b), can be derived as:

$$a = \sin\left(\hat{\theta}\frac{\pi}{2}\right)$$

$$b = \cos\left(\hat{\theta}\frac{\pi}{2}\right)$$

Out-of-Phase Components

For the out-of-phase components of the Center channel a desired panning behavior is illustrated in FIG. 14. FIG. 14 illustrates panning behavior corresponding to an out-of-phase plot 1400 given by the equation:

$$C=0$$

Substituting the desired Center channel panning behavior for out-of-phase components and the assumed Sin/Cos downmix functions leads to:

$$0=\sin(0)=a\cdot\cos(\hat{\theta}\frac{\pi}{2})+b\cdot-\sin(\hat{\theta}\frac{\pi}{2})$$

Using the angle sum identities, the a and b coefficients can be derived as:

$$a=\sin(\hat{\theta}\frac{\pi}{2})$$

$$b=\cos(\hat{\theta}\frac{\pi}{2})$$

Surround Channel Synthesis

The surround channels are generated from a two-channel downmix using the following equations:

$$Ls=aL-bR$$

$$Rs=aR-bL$$

where $L_S$ is the left surround channel and $R_S$ is the right surround channel. Moreover, the a and b coefficients are determined based on the estimated panning angle $\hat{\theta}$ to achieve certain pre-defined goals.

In-Phase Components

The ideal panning behavior for in-phase components of the Left Surround channel is illustrated in FIG. 15. FIG. 15 illustrates panning behavior corresponding to an in-phase plot 1500 given by the equation:

$$Ls=0$$

Substituting the desired Left Surround channel panning behavior for in-phase components and the assumed Sin/Cos downmix functions leads to:

$$0=\sin(0)=a\cdot\cos(\hat{\theta}\frac{\pi}{2})-b\cdot\sin(\hat{\theta}\frac{\pi}{2})$$

Using the angle sum identities, the a and b coefficients are derived as:

$$a=\sin(\hat{\theta}\frac{\pi}{2})$$

$$b=\cos(\hat{\theta}\frac{\pi}{2})$$

Out-of-Phase Components

The goal for the Left Surround channel for out-of-phase components is to achieve panning behavior as illustrated by the out-of-phase plot 1600 in FIG. 16. FIG. 16 illustrates two specific angles corresponding to downmix equations where the Left Surround and Right Surround channels are discretely encoded and decoded (these angles are approximately 0.25 and 0.75 (corresponding to 45° and 135°) on the out-of-phase plot 1600 in FIG. 16). These angles are referred to as:

$\theta_{Ls}$=Left Surround encoding angle (~0.25)

$\theta_{Rs}$=Right Surround encoding angle (~0.75)

The a and b coefficients for the Left Surround channel are generated via a piecewise function due to the piecewise behavior of the desired output. For $\hat{\theta}\leq\theta_{Ls}$, the desired panning behavior for the Left Surround channel corresponds to:

$$Ls=\sin\left(\frac{\hat{\theta}}{\theta_{Ls}}\frac{\pi}{2}\right)$$

Substituting the desired Left Surround channel panning behavior for out-of-phase components and the assumed Sin/Cos downmix functions leads to:

$$\sin\left(\frac{\hat{\theta}}{\theta_{Ls}}\frac{\pi}{2}\right)=a\cdot\cos(\hat{\theta}\frac{\pi}{2})-b\cdot-\sin(\hat{\theta}\frac{\pi}{2})$$

Using the angle sum identities, the a and b coefficients can be derived as:

$$a=\sin\left(\frac{\hat{\theta}}{\theta_{Ls}}\frac{\pi}{2}-\hat{\theta}\frac{\pi}{2}\right)$$

$$b=\cos\left(\frac{\hat{\theta}}{\theta_{Ls}}\frac{\pi}{2}-\hat{\theta}\frac{\pi}{2}\right)$$

For $\theta_{Ls}<\hat{\theta}\leq\theta_{Rs}$, the desired panning behavior for the Left Surround channel corresponds to:

$$Ls=\cos\left(\frac{\hat{\theta}-\theta_{Ls}}{\theta_{Rs}-\theta_{Ls}}\frac{\pi}{2}\right)$$

Substituting the desired Left Surround channel panning behavior for out-of-phase components and the assumed Sin/Cos downmix functions leads to:

$$\cos\left(\frac{\hat{\theta}-\theta_{Ls}}{\theta_{Rs}-\theta_{Ls}}\frac{\pi}{2}\right)=a\cdot\cos(\hat{\theta}\frac{\pi}{2})-b\cdot-\sin(\hat{\theta}\frac{\pi}{2})$$

Using the angle sum identities, the a and b coefficients can be derived as:

$$a=\cos\left(\frac{\hat{\theta}-\theta_{Ls}}{\theta_{Rs}-\theta_{Ls}}\frac{\pi}{2}-\hat{\theta}\frac{\pi}{2}\right)$$

$$b=-\sin\left(\frac{\hat{\theta}-\theta_{Ls}}{\theta_{Rs}-\theta_{Ls}}\frac{\pi}{2}-\hat{\theta}\frac{\pi}{2}\right)$$

For $\hat{\theta}>\theta_{Rs}$, the desired panning behavior for the Left Surround channel corresponds to:

$$Ls=0$$

Substituting the desired Left Surround channel panning behavior for out-of-phase components and the assumed Sin/Cos downmix functions leads to:

$$0=\sin(0)=a\cdot\cos(\hat{\theta}\frac{\pi}{2})-b\cdot-\sin(\hat{\theta}\frac{\pi}{2})$$

Using the angle sum identities, the a and b coefficients can be derived as:

$$a=\sin(\hat{\theta}\frac{\pi}{2})$$

$$b=-\cos(\hat{\theta}\frac{\pi}{2})$$

The a and b coefficients for the Right Surround channel generation are calculated similarly to those for the Left Surround channel generation as described above.

Modified Left and Modified Right Channel Synthesis

The Left and Right channels are modified using the following equations to remove (either fully or partially) those components generated in the Center and Surround channels:

$$L'=aL-bR$$

$$R'=aR-bL$$

where the a and b coefficients are determined based on the panning angle estimate $\hat{\theta}$ to achieve certain pre-defined goals and L' is the modified Left channel and R' is the modified Right channel.

In-Phase Components

The goal for the modified Left channel for in-phase components is to achieve panning behavior as illustrated by the in-phase plot 1700 in FIG. 17. In FIG. 17, a panning angle θ of 0.5 corresponds to a discrete Center channel. The a and b coefficients for the modified Left channel are generated via a piecewise function due to the piecewise behavior of the desired output.

For $\hat{\theta}\leq 0.5$, the desired panning behavior for the modified Left channel corresponds to:

$$L'=\cos\left(\frac{\hat{\theta}}{0.5}\frac{\pi}{2}\right)$$

Substituting the desired modified Left channel panning behavior for in-phase components and the assumed Sin/Cos downmix functions leads to:

$$\cos\left(\frac{\hat{\theta}}{0.5}\frac{\pi}{2}\right)=a\cdot\cos(\hat{\theta}\frac{\pi}{2})-b\cdot\sin(\hat{\theta}\frac{\pi}{2})$$

Using the angle sum identities, the a and b coefficients can be derived as:

$$a=\cos\left(\frac{\hat{\theta}}{0.5}\frac{\pi}{2}-\hat{\theta}\frac{\pi}{2}\right)$$

$$b=\sin\left(\frac{\hat{\theta}}{0.5}\frac{\pi}{2}-\hat{\theta}\frac{\pi}{2}\right)$$

For $\hat{\theta}>0.5$, the desired panning behavior for the modified Left channel corresponds to:

$$L'=0$$

Substituting the desired modified Left channel panning behavior for in-phase components and the assumed Sin/Cos downmix functions leads to:

$$0=\sin(0)=a\cdot\cos(\hat{\theta}\frac{\pi}{2})-b\cdot\sin(\hat{\theta}\frac{\pi}{2}).$$

Using the angle sum identities, the a and b coefficients can be derived as:

$$a=\sin(\hat{\theta}\frac{\pi}{2})$$

$$b=\cos(\hat{\theta}\frac{\pi}{2}).$$

Out-of-Phase Components

The goal for the modified Left channel for out-of-phase components is to achieve panning behavior as illustrated by the out-of-phase plot 1800 in FIG. 18. In FIG. 18, a panning angle $\theta=\theta_{Ls}$ corresponds to the encoding angle for the Left Surround channel. The a and b coefficients for the modified Left channel are generated via a piecewise function due to the piecewise behavior of the desired output.

For $\hat{\theta}\leq\theta_{Ls}$, the desired panning behavior for the modified Left channel corresponds to:

$$L'=\cos\left(\frac{\hat{\theta}}{\theta_{Ls}}\frac{\pi}{2}\right).$$

Substituting the desired modified Left channel panning behavior for out-of-phase components and the assumed Sin/Cos downmix functions leads to:

$$\cos\left(\frac{\hat{\theta}}{\theta_{Ls}}\frac{\pi}{2}\right)=a\cdot\cos(\hat{\theta}\frac{\pi}{2})-b\cdot-\sin(\hat{\theta}\frac{\pi}{2}).$$

Using the angle sum identities, the a and b coefficients can be derived as:

$$a=\cos\left(\frac{\hat{\theta}}{\theta_{Ls}}\frac{\pi}{2}-\hat{\theta}\frac{\pi}{2}\right)$$

$$b=-\sin\left(\frac{\hat{\theta}}{\theta_{Ls}}\frac{\pi}{2}-\hat{\theta}\frac{\pi}{2}\right).$$

For $\hat{\theta}>\theta_{Ls}$, the desired panning behavior for the modified Left channel corresponds to:

$L'=0.$

Substituting the desired modified Left channel panning behavior for out-of-phase components and the assumed Sin/Cos downmix functions leads to:

$$0 = \sin(0) = a \cdot \cos\left(\hat{\theta}\frac{\pi}{2}\right) - b \cdot -\sin\left(\hat{\theta}\frac{\pi}{2}\right).$$

Using the angle sum identities, the a and b coefficients can be derived as:

$$a = \sin\left(\hat{\theta}\frac{\pi}{2}\right)$$

$$b = -\cos\left(\hat{\theta}\frac{\pi}{2}\right).$$

The a and b coefficients for the modified Right channel generation are calculated similarly to those for the modified Left channel generation as described above.

Coefficient Interpolation

The channel synthesis derivations presented above are based on achieving desired panning behavior for source content that is either in-phase or out-of-phase. The relative phase difference of the source content can be determined through the Inter-Channel Phase Difference (ICPD) property defined as:

$$ICPD = \frac{\mathrm{Re}\{\Sigma L \cdot R^*\}}{\sqrt{\Sigma|L|^2}\sqrt{\Sigma|R|^2}},$$

where * denotes complex conjugation.

The ICPD value is bounded in the range [−1,1] where values of −1 indicate that the components are out-of-phase and values of 1 indicate that the components are in-phase. The ICPD property can then be used to determine the final a and b coefficients to use in the channel synthesis equations using linear interpolation. However, instead of interpolating the a and b coefficients directly, it can be noted that all of the a and b coefficients are generated using trigonometric functions of the panning angle estimate $\hat{\theta}$.

The linear interpolation is thus carried out on the angle arguments of the trigonometric functions. Performing the linear interpolation in this manner has two main advantages. First, it preserves the property that $a^2+b^2=1$ for any panning angle and ICPD value. Second, it reduces the number of trigonometric function calls required thereby reducing processing requirements.

The angle interpolation uses a modified ICPD value normalized to the range [0,1] calculated as:

$$ICPD' = \frac{ICPD + 1}{2}.$$

The channel outputs are computed as shown below.

Center Output Channel

The Center output channel is generated using the modified ICPD value, which is defined as:

$$C=aL+bR,$$

where $$a=\sin(\mathrm{ICPD}'\cdot\alpha+(1-\mathrm{ICPD}')\cdot\beta)$$

$$b=\cos(\mathrm{ICPD}'\cdot\alpha+(1\cdot\mathrm{ICPD}')\cdot\beta).$$

The first term in the argument of the sine function above represents the in-phase component of the first dematrixing coefficient, while the second term represents the out-of-phase component. Thus, α represents an in-phase coefficient and β represents an out-of-phase coefficient. Together the in-phase coefficient and the out-of phase coefficient are known as the phase coefficients.

For each output channel, embodiments of the codec 400 and method calculate the phase coefficients based on the estimated panning angle. For the Center output channel, the in-phase coefficient and the out-of-phase coefficient are given as:

$$\alpha = \hat{\theta}\frac{\pi}{2}$$

$$\beta = \hat{\theta}\frac{\pi}{2}.$$

Left Surround Output Channel

The Left Surround output channel is generated using the modified ICPD value, which is defined as:

$$Ls = aL - bR$$

$$\text{where } a = \sin(ICPD' \cdot \alpha + (1 - ICPD') \cdot \beta)$$

$$b = \cos(ICPD' \cdot \alpha + (1 - ICPD') \cdot \beta) \text{ and}$$

$$\alpha = \hat{\theta}\frac{\pi}{2}$$

$$\beta = \begin{cases} \dfrac{\hat{\theta}}{\theta_{Ls}}\dfrac{\pi}{2} - \hat{\theta}\dfrac{\pi}{2}, & \hat{\theta} \le \theta_{Ls} \\ \dfrac{\hat{\theta} - \theta_{Ls}}{\theta_{Rs} - \theta_{Ls}}\dfrac{\pi}{2} - \hat{\theta}\dfrac{\pi}{2} + \dfrac{\pi}{2}, & \theta_{Ls} < \hat{\theta} \le \theta_{Rs} \\ \pi - \hat{\theta}\dfrac{\pi}{2}, & \hat{\theta} > \theta_{Rs} \end{cases}.$$

Note that some trigonometric identities and phase wrapping properties were applied to simplify the α and β coefficients to the equations given above.

Right Surround Output Channel

The Right Surround output channel is generated using the modified ICPD value, which is defined as:

$$Rs = aR - bL$$

$$\text{where } a = \sin(ICPD' \cdot \alpha + (1 - ICPD') \cdot \beta)$$

$$b = \cos(ICPD' \cdot \alpha + (1 - ICPD') \cdot \beta) \text{ and}$$

$$\alpha = (1 - \hat{\theta})\frac{\pi}{2}$$

$$\beta = \begin{cases} \dfrac{(1-\hat{\theta})}{\theta_{Ls}}\dfrac{\pi}{2} - (1-\hat{\theta})\dfrac{\pi}{2}, & (1-\hat{\theta}) \le \theta_{Ls} \\ \dfrac{(1-\hat{\theta}) - \theta_{Ls}}{\theta_{Rs} - \theta_{Ls}}\dfrac{\pi}{2} - (1-\hat{\theta})\dfrac{\pi}{2} + \dfrac{\pi}{2}, & \theta_{Ls} < (1-\hat{\theta}) \le \theta_{Rs} \\ \pi - (1-\hat{\theta})\dfrac{\pi}{2}, & (1-\hat{\theta}) > \theta_{Rs} \end{cases}.$$

Note that the a and b coefficients for the Right Surround channel are generated similarly to the Left Surround channel, apart from using $(1-\hat{\theta})$ as the panning angle instead of $\hat{\theta}$.

Modified Left Output Channel

The modified Left output channel is generated using the modified ICPD value as follows:

$$L' = aL - bR$$

$$\text{where } a = \sin(ICPD' \cdot \alpha + (1 - ICPD') \cdot \beta)$$

$$b = \cos(ICPD' \cdot \alpha + (1 - ICPD') \cdot \beta) \text{ and}$$

$$\alpha = \begin{cases} \frac{\pi}{2} - \frac{\hat{\theta}}{0.5}\frac{\pi}{2} + \hat{\theta}\frac{\pi}{2}, & \hat{\theta} > 0.5 \\ \hat{\theta}\frac{\pi}{2}, & \hat{\theta} > 0.5 \end{cases}$$

$$\beta = \begin{cases} \frac{\hat{\theta}}{\theta_{Ls}}\frac{\pi}{2} - \hat{\theta}\frac{\pi}{2} + \frac{\pi}{2}, & \hat{\theta} > \theta_{Ls} \\ \pi - \hat{\theta}\frac{\pi}{2}, & \hat{\theta} > \theta_{Ls} \end{cases}.$$

Modified Right Output Channel

The modified Right output channel is generated using the modified ICPD value as follows:

$$R' = aR - bL$$

$$\text{where } a = \sin(ICPD' \cdot \alpha + (1 - ICPD') \cdot \beta)$$

$$b = \sin(ICPD' \cdot \alpha + (1 - ICPD') \cdot \beta) \text{ and}$$

$$\alpha = \begin{cases} \frac{\pi}{2} - \frac{(1-\hat{\theta})}{0.5}\frac{\pi}{2} + (1-\hat{\theta})\frac{\pi}{2}, & (1-\hat{\theta}) \le 0.5 \\ (1-\hat{\theta})\frac{\pi}{2}, & (1-\hat{\theta}) > 0.5 \end{cases}$$

$$\beta = \begin{cases} \frac{(1-\hat{\theta})}{\theta_{Ls}}\frac{\pi}{2} - (1-\hat{\theta})\frac{\pi}{2} + \frac{\pi}{2}, & (1-\hat{\theta}) \le \theta_{Ls} \\ \pi - (1-\hat{\theta})\frac{\pi}{2}, & (1-\hat{\theta}) > \theta_{Ls} \end{cases}.$$

Note that the a and b coefficients for the Right channel are generated similarly to the Left channel, apart from using $(1-\hat{\theta})$ as the panning angle instead of $\hat{\theta}$.

The subject matter discussed above is a system for generating Center, Left Surround, Right Surround, Left, and Right channels from a two-channel downmix. However, the system may be easily modified to generate other additional audio channels by defining additional panning behaviors.

V.E. Triplet Matrixing Case

In accordance with embodiments of the codec 400 and method, when the location of a non-surviving (or surplus) channel lies within a triangle defined by the positions of three surviving channels (or corresponding subbands in surviving channels), the channel to be downmixed should be matrixed in accordance with a set of triplet channel relationships, as set forth below.

Downmixing Case

Figure 19:
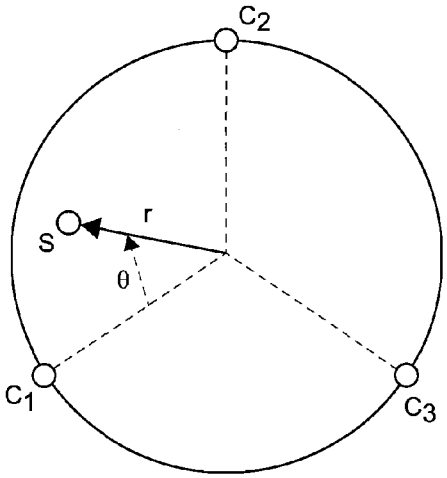
FIG. 19 is a diagram illustrating the panning of a signal source, S, onto a channel triplet.

A non-surviving channel is downmixed onto three surviving channels forming a triangle. Mathematically, a signal, S, is amplitude panned onto channel triplet $C_1/C_2/C_3$. FIG. 19 is a diagram illustrating the panning of a signal source, S, onto a channel triplet. Referring to FIG. 19, for a signal source S located between channels $C_1$ and $C_2$, it is assumed that channels $C_1/C_2/C_3$ are generated according to the following signal model:

$$C_1 = \sqrt{\sin^2\left(r\frac{\pi}{2}\right)\cos^2\left(\theta\frac{\pi}{2}\right) + \cos^2\left(r\frac{\pi}{2}\right)\left(\frac{\sqrt{3}}{3}\right)^2}\, S$$

$$C_2 = \sqrt{\sin^2\left(r\frac{\pi}{2}\right)\sin^2\left(\theta\frac{\pi}{2}\right) + \cos^2\left(r\frac{\pi}{2}\right)\left(\frac{\sqrt{3}}{3}\right)^2}\, S$$

$$C_3 = \sqrt{\cos^2\left(r\frac{\pi}{2}\right)\left(\frac{\sqrt{3}}{3}\right)^2}\, S$$

where r is the distance of the signal source from the origin (normalized to the range [0,1]) and θ is the angle of the signal source between channels $C_1$ and $C_2$ (normalized to the range [0,1]). Note that the above channel panning weights for channels $C_1/C_2/C_3$ are designed to preserve power of the signal S as it is panned onto $C_1/C_2/C_3$.

Upmixing Case

Figure 20:
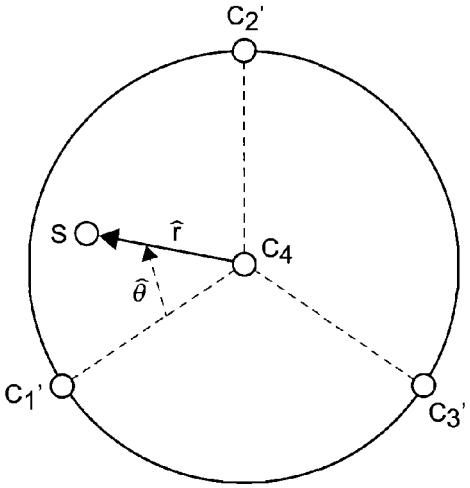
FIG. 20 is a diagram illustrating the extraction of a non-surviving fourth channel that has been panned onto a triplet.

The objective when upmixing the triplet is to obtain the non-surviving channel that was downmixed onto the triplet by creating four output channels $C_1'/C_2'/C_3'/C_4$ from the input triplet $C_1/C_2/C_3$. FIG. 20 is a diagram illustrating the extraction of a non-surviving fourth channel that has been panned onto a triplet. Referring to FIG. 20, the location of the fourth output channel $C_4$ is assumed to be at the origin, while the location of the other three output channels $C_1'/C_2'/C_3'$ is assumed identical to the input channels $C_1/C_2/C_3$. Embodiments of the multiplet-based spatial matrixing decoder 420 generate the four output channels such that the spatial location and signal energy of the original signal component S is preserved.

The original location of the sound source S is not transmitted to embodiments of the multiplet-based spatial matrixing decoder 420, and it can only be estimated from the input channels $C_1/C_2/C_3$ themselves. Embodiments of the decoder 420 are able to appropriately generate the four output channels for any arbitrary location of S. For the remainder of this section, it can be assumed that the original signal component S has unit energy (i.e. |S|=1) to simplify derivations without loss of generality.

Derive $\hat{r}$ and $\hat{\theta}$ Estimates from Channel Energies $C_1^2/C_2^2/C_3^2$ Let, $$\hat{r} = \frac{2}{\pi} \cdot \cos^{-1}\left(\sqrt{3\frac{C_3^2}{C_1^2 + C_2^2 + C_3^2}}\right)$$

$$\hat{\theta} = \frac{2}{\pi} \cdot \cos^{-1}\left(\sqrt{\frac{C_1^2 - C_3^2}{C_1^2 + C_2^2 - 2C_3^2}}\right)$$

Channel Energy Ratios

The following energy ratios will be used throughout the remainder of this section:

$$\mu_i^2 = \frac{C_i^2}{\sum_j C_j^2}$$

These three energy ratios are in the range [0,1] and sum to 1.

$C_4$ Channel Synthesis

The output channel $C_4$ will be generated via the following equation:

$$C_4 = aC_1 + bC_2 + cC_3$$

where the a, b, and c coefficients will be determined based on the estimated angle $\hat{\theta}$ and radius $\hat{r}$.

The goal is:

$$\sqrt{\sin^2(\hat{r}\tfrac{\pi}{2})\cdot 0 + \cos^2(\hat{r}\tfrac{\pi}{2})\cdot 1} = a\sqrt{\sin^2(\hat{r}\tfrac{\pi}{2})\cos^2(\hat{\theta}\tfrac{\pi}{2}) + \cos^2(\hat{r}\tfrac{\pi}{2})\left(\tfrac{\sqrt{3}}{3}\right)^2} + b\sqrt{\sin^2(\hat{r}\tfrac{\pi}{2})\sin^2(\hat{\theta}\tfrac{\pi}{2}) + \cos^2(\hat{r}\tfrac{\pi}{2})\left(\tfrac{\sqrt{3}}{3}\right)^2} + c\sqrt{\cos^2\cos^2(\hat{r}\tfrac{\pi}{2})\left(\tfrac{\sqrt{3}}{3}\right)^2}$$

Let a=da', b=db', and c=dc' where:

$$a' = \sqrt{\sin^2(\hat{r}\tfrac{\pi}{2})\cos^2(\hat{\theta}\tfrac{\pi}{2}) + \cos^2(\hat{r}\tfrac{\pi}{2})\left(\tfrac{\sqrt{3}}{3}\right)^2}$$

$$b' = \sqrt{\sin^2(\hat{r}\tfrac{\pi}{2})\sin^2(\hat{\theta}\tfrac{\pi}{2}) + \cos^2(\hat{r}\tfrac{\pi}{2})\left(\tfrac{\sqrt{3}}{3}\right)^2}$$

$$c' = \sqrt{\cos^2(\hat{r}\tfrac{\pi}{2})\left(\tfrac{\sqrt{3}}{3}\right)^2}$$

The above substitutions lead to:

$$\cos(\hat{r}\tfrac{\pi}{2}) = d\left(\sin^2(\hat{r}\tfrac{\pi}{2})\cos^2(\hat{\theta}\tfrac{\pi}{2}) + \cos^2(\hat{r}\tfrac{\pi}{2})\left(\tfrac{\sqrt{3}}{3}\right)^2\right) + d\left(\sin^2(\hat{r}\tfrac{\pi}{2})\sin^2(\hat{\theta}\tfrac{\pi}{2}) + \cos^2(\hat{r}\tfrac{\pi}{2})\left(\tfrac{\sqrt{3}}{3}\right)^2\right) + d\left(\cos^2(\hat{r}\tfrac{\pi}{2})\left(\tfrac{\sqrt{3}}{3}\right)^2\right)$$

Solving for d yields:

$$d = \cos(\hat{r}\tfrac{\pi}{2})$$

The a, b, and c coefficients are thus:

$$a = \cos(\hat{r}\tfrac{\pi}{2})\sqrt{\sin^2(\hat{r}\tfrac{\pi}{2})\cos^2(\hat{\theta}\tfrac{\pi}{2}) + \cos^2(\hat{r}\tfrac{\pi}{2})\left(\tfrac{\sqrt{3}}{3}\right)^2}$$

$$b = \cos(\hat{r}\tfrac{\pi}{2})\sqrt{\sin^2(\hat{r}\tfrac{\pi}{2})\sin^2(\hat{\theta}\tfrac{\pi}{2}) + \cos^2(\hat{r}\tfrac{\pi}{2})\left(\tfrac{\sqrt{3}}{3}\right)^2}$$

$$c = \cos(\hat{r}\tfrac{\pi}{2})\sqrt{\cos^2(\hat{r}\tfrac{\pi}{2})\left(\tfrac{\sqrt{3}}{3}\right)^2}$$

Furthermore, the final a, b, and c coefficients can be simplified to expressions consisting only of the channel energy ratios:

$$a = \sqrt{3}\mu_1\mu_3$$

$$b = \sqrt{3}\mu_2\mu_3$$

$$c = \sqrt{3}\mu_3\mu_3$$

$C_1'/C_2'/C_3'$ Channel Synthesis

Output channels $C_1'/C_2'/C_3'$ will be generated from input channels $C_1/C_2/C_3$ such that the signal components already generated in output channel $C_4$ will be appropriately "removed" from input channels $C_1/C_2/C_3$.

$C_1'$ Channel Synthesis

Let $$C_1' = aC_1 - bC_2 - cC_3$$

The goal is:

$$\sqrt{\sin^2(\hat{r}\tfrac{\pi}{2})\cos^2(\hat{\theta}\tfrac{\pi}{2}) + \cos^2(\hat{r}\tfrac{\pi}{2})\cdot 0} = a\sqrt{\sin^2(\hat{r}\tfrac{\pi}{2})\cos^2(\hat{\theta}\tfrac{\pi}{2}) + \cos^2(\hat{r}\tfrac{\pi}{2})\left(\tfrac{\sqrt{3}}{3}\right)^2} - b\sqrt{\sin^2(\hat{r}\tfrac{\pi}{2})\sin^2(\hat{\theta}\tfrac{\pi}{2}) + \cos^2(\hat{r}\tfrac{\pi}{2})\left(\tfrac{\sqrt{3}}{3}\right)^2} - c\sqrt{\cos^2(\hat{r}\tfrac{\pi}{2})\left(\tfrac{\sqrt{3}}{3}\right)^2}$$

Let the a coefficient be equal to:

$$a = \sqrt{\sin^2(\hat{r}\tfrac{\pi}{2})\cdot 1 + \cos^2(\hat{r}\tfrac{\pi}{2})\left(\tfrac{1}{\sqrt{1.5}}\right)^2}$$

Let b=db' and c=dc' where:

$$b' = \sqrt{\sin^2(\hat{r}\tfrac{\pi}{2})\cdot 0 + \cos^2(\hat{r}\tfrac{\pi}{2})\left(\tfrac{0.5}{\sqrt{1.5}}\right)^2}$$

$$c' = \sqrt{\sin^2(\hat{r}\tfrac{\pi}{2})\cdot 0 + \cos^2(\hat{r}\tfrac{\pi}{2})\left(\tfrac{0.5}{\sqrt{1.5}}\right)^2}$$

The above substitutions lead to:

$$\sqrt{\sin^2(\hat{r}\tfrac{\pi}{2})\cos^2(\hat{\theta}\tfrac{\pi}{2})} = \sqrt{\sin^2(\hat{r}\tfrac{\pi}{2}) + \cos^2(\hat{r}\tfrac{\pi}{2})\left(\tfrac{1}{\sqrt{1.5}}\right)^2}\sqrt{\sin^2(\hat{r}\tfrac{\pi}{2})\cos^2(\hat{\theta}\tfrac{\pi}{2}) + \cos^2(\hat{r}\tfrac{\pi}{2})\left(\tfrac{\sqrt{3}}{3}\right)^2} - d\sqrt{\cos^2(\hat{r}\tfrac{\pi}{2})\left(\tfrac{0.5}{\sqrt{1.5}}\right)^2}\sqrt{\sin^2(\hat{r}\tfrac{\pi}{2})\sin^2(\hat{\theta}\tfrac{\pi}{2}) + \cos^2(\hat{r}\tfrac{\pi}{2})\left(\tfrac{\sqrt{3}}{3}\right)^2} -$$

-continued $$d\sqrt{\cos^2\left(\hat{r}\frac{\pi}{2}\right)\left(\frac{0.5}{\sqrt{1.5}}\right)^2}\sqrt{\cos^2\left(\hat{r}\frac{\pi}{2}\right)\left(\frac{\sqrt{3}}{3}\right)^2}$$

Solving for d yields:

$$d=\frac{\sqrt{\sin^2\left(\hat{r}\frac{\pi}{2}\right)+\cos^2\left(\hat{r}\frac{\pi}{2}\right)\left(\frac{1}{\sqrt{1.5}}\right)^2}\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{3}}{3}\right)^2}-\sqrt{\sin^2\left(\hat{r}\frac{\pi}{2}\right)\cos^2\left(\hat{\theta}\frac{\pi}{2}\right)}}{\sqrt{\cos^2\left(\hat{r}\frac{\pi}{2}\right)\left(\frac{0.5}{\sqrt{1.5}}\right)^2}\left(\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{3}}{3}\right)^2}+\sqrt{\cos^2\left(\hat{r}\frac{\pi}{2}\right)\left(\frac{\sqrt{3}}{3}\right)^2}\right)}$$

The final a, b, and c coefficients can be simplified to expressions consisting only of the channel energy ratios:

$$a=\sqrt{1-\mu_3^2}$$

$$b=\frac{\mu_1\sqrt{1-\mu_3^2}-\sqrt{\mu_1^2-\mu_3^2}}{\mu_2+\mu_3}$$

$$c=\frac{\mu_1\sqrt{1-\mu_3^2}-\sqrt{\mu_1^2-\mu_3^2}}{\mu_2+\mu_3}$$

$C_2'$ Channel Synthesis

Let $$C_2'=aC_2-bC_1-cC_3$$

The goal is:

$$\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\cdot 0}=a\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{3}}{3}\right)^2}-b\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{3}}{3}\right)^2}-c\sqrt{\cos^2\left(\hat{r}\frac{\pi}{2}\right)\left(\frac{\sqrt{3}}{3}\right)^2}$$

Let the a coefficient be equal to:

$$a=\sqrt{\sin^2\left(\hat{r}\frac{\pi}{2}\right)\cdot 1+\cos^2\left(\hat{r}\frac{\pi}{2}\right)\left(\frac{1}{\sqrt{1.5}}\right)^2}$$

Let b=db' and c=dc' where:

$$b'=\sqrt{\sin^2\left(\hat{r}\frac{\pi}{2}\right)\cdot 0+\cos^2\left(\hat{r}\frac{\pi}{2}\right)\left(\frac{0.5}{\sqrt{1.5}}\right)^2}$$

$$c'=\sqrt{\sin^2\left(\hat{r}\frac{\pi}{2}\right)\cdot 0+\cos^2\left(\hat{r}\frac{\pi}{2}\right)\left(\frac{0.5}{\sqrt{1.5}}\right)^2}$$

The above substitutions lead to:

$$\sqrt{\sin^2\left(\hat{r}\frac{\pi}{2}\right)\sin^2\left(\hat{\theta}\frac{\pi}{2}\right)}=\sqrt{\sin^2\left(\hat{r}\frac{\pi}{2}\right)+\cos^2\left(\hat{r}\frac{\pi}{2}\right)\left(\frac{1}{\sqrt{1.5}}\right)^2}\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{3}}{3}\right)^2}-d\sqrt{\cos^2\left(\hat{r}\frac{\pi}{2}\right)\left(\frac{0.5}{\sqrt{1.5}}\right)^2}\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{3}}{3}\right)^2}-d\sqrt{\cos^2\left(\hat{r}\frac{\pi}{2}\right)\left(\frac{0.5}{\sqrt{1.5}}\right)^2}\sqrt{\cos^2\left(\hat{r}\frac{\pi}{2}\right)\left(\frac{\sqrt{3}}{3}\right)^2}$$

Solving for d yields:

$$d=\frac{\sqrt{\sin^2\left(\hat{r}\frac{\pi}{2}\right)+\cos^2\left(\hat{r}\frac{\pi}{2}\right)\left(\frac{1}{\sqrt{1.5}}\right)^2}\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{3}}{3}\right)^2}-\sqrt{\sin^2\left(\hat{r}\frac{\pi}{2}\right)\sin^2\left(\hat{\theta}\frac{\pi}{2}\right)}}{\sqrt{\cos^2\left(\hat{r}\frac{\pi}{2}\right)\left(\frac{0.5}{\sqrt{1.5}}\right)^2}\left(\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{3}}{3}\right)^2}+\sqrt{\cos^2\left(\hat{r}\frac{\pi}{2}\right)\left(\frac{\sqrt{3}}{3}\right)^2}\right)}$$

The final a, b, and c coefficients can be simplified to expressions consisting only of the channel energy ratios:

$$a=\sqrt{1-\mu_3^2}$$

$$b=\frac{\mu_2\sqrt{1-\mu_3^2}-\sqrt{\mu_2^2-\mu_3^2}}{\mu_1+\mu_3}$$

$$c=\frac{\mu_2\sqrt{1-\mu_3^2}-\sqrt{\mu_2^2-\mu_3^2}}{\mu_1+\mu_3}$$

$C_3'$ Channel Synthesis

Let $$C_3'=aC_3-bC_1-cC_2$$

The goal is:

$$0 = a\sqrt{\cos^2\left(\hat{r}\frac{\pi}{2}\right)\left(\frac{\sqrt{3}}{3}\right)^2} - b\sqrt{\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{3}}{3}\right)^2} - c\sqrt{\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{3}}{3}\right)^2}$$

Let the a coefficient be equal to:

$$a = \sqrt{\sin^2\left(\hat{r}\frac{\pi}{2}\right) + \cos^2\left(\hat{r}\frac{\pi}{2}\right)\left(\frac{1}{\sqrt{1.5}}\right)^2}$$

Let b=db' and c=dc' where:

$$b' = \sqrt{\sin^2\left(\hat{r}\frac{\pi}{2}\right)\cdot 0 + \cos^2\left(\hat{r}\frac{\pi}{2}\right)\left(\frac{0.5}{\sqrt{1.5}}\right)^2}$$

$$c' = \sqrt{\sin^2\left(\hat{r}\frac{\pi}{2}\right)\cdot 0 + \cos^2\left(\hat{r}\frac{\pi}{2}\right)\left(\frac{0.5}{\sqrt{1.5}}\right)^2}$$

The above substitutions lead to:

$$0 = \sqrt{\sin^2\left(\hat{r}\frac{\pi}{2}\right) + \cos^2\left(\hat{r}\frac{\pi}{2}\right)\left(\frac{1}{\sqrt{1.5}}\right)^2}\sqrt{\cos^2\left(\hat{r}\frac{\pi}{2}\right)\left(\frac{\sqrt{3}}{3}\right)^2} - d\sqrt{\cos^2\left(\hat{r}\frac{\pi}{2}\right)\left(\frac{0.5}{\sqrt{1.5}}\right)^2}\sqrt{\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{3}}{3}\right)^2} - d\sqrt{\cos^2\left(\hat{r}\frac{\pi}{2}\right)\left(\frac{0.5}{\sqrt{1.5}}\right)^2}\sqrt{\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{3}}{3}\right)^2}$$

Solving for d yields:

$$d = \frac{\sqrt{\sin^2\left(\hat{r}\frac{\pi}{2}\right) + \cos^2\left(\hat{r}\frac{\pi}{2}\right)\left(\frac{1}{\sqrt{1.5}}\right)^2}\sqrt{\cos^2\left(\hat{r}\frac{\pi}{2}\right)\left(\frac{\sqrt{3}}{3}\right)^2}}{\sqrt{\cos^2\left(\hat{r}\frac{\pi}{2}\right)\left(\frac{0.5}{\sqrt{1.5}}\right)^2}}\left(\sqrt{\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{3}}{3}\right)^2} + \sqrt{\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{3}}{3}\right)^2}\right)$$

The final a, b, and c coefficients can be simplified to expressions consisting only of the channel energy ratios:

$$a = \sqrt{1 - \mu_3^2}$$

-continued $$b = \frac{\mu_3\sqrt{1 - \mu_3^2}}{\mu_1 + \mu_2}$$

$$c = \frac{\mu_3\sqrt{1 - \mu_3^2}}{\mu_1 + \mu_2}$$

Triplet Inter-Channel Phase Difference (ICPD)

An inter-channel phase difference (ICPD) spatial property can be calculated for a triplet from the underlying pairwise ICPD values:

$$ICPD = \frac{|C_1||C_2|ICPD_{12} + |C_1||C_3|ICPD_{13} + |C_2||C_3|ICPD_{23}}{|C_1||C_2| + |C_1||C_3| + |C_2||C_3|}$$

where the underlying pairwise ICPD values are calculated using the following equation:

$$ICPD_{ij} = \frac{\mathrm{Re}\left\{\sum C_i \cdot C_j^*\right\}}{\sqrt{\sum |C_i|^2}\sqrt{\sum |C_j|^2}}.$$

Note that the triplet signal model assumes that a sound source has been amplitude-panned onto the triplet channels, implying that the three channels are fully correlated. The triplet ICPD measure can be used to estimate the total correlation of the three channels. When the triplet channels are fully correlated (or nearly fully correlated) the triplet framework can be employed to generate the four output channels with highly predictable results. When the triplet channels are uncorrelated, it may be desirable to use a different framework or method since the uncorrelated triplet channels violate the assumed signal model that may result in unpredictable results.

V.F. Quadruplet Matrixing Case

In accordance with embodiments of the codec 400 and method, when certain conditions of symmetry prevail the surplus channel (or channel-subband) may be advantageously considered to lie within a quadrilateral. In such a case, embodiments of the codec 400 and method include downmixing (and complementary upmixing) in accordance with a quadruplet-case set of relationships set forth below.

Downmixing Case

Figure 21:
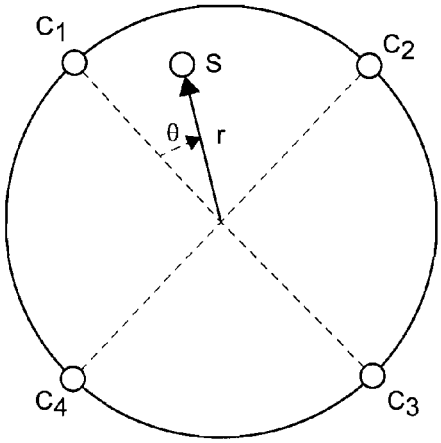
FIG. 21 is a diagram illustrating the panning of a signal source, S, onto a channel quadruplet.

A non-surviving channel is downmixed onto four surviving channels forming a quadrilateral. Mathematically, a signal source, S, is amplitude panned onto channel quadruplet $C_1/C_2/C_3/C_4$. FIG. 21 is a diagram illustrating the panning of a signal source, S, onto a channel quadruplet. Referring to FIG. 21, for a signal source S located between channels $C_1$ and $C_2$, it is assumed that channels $C_1/C_2/C_3/C_4$ are generated according to the following signal model:

$$C_1 = \sqrt{\sin^2\left(r\frac{\pi}{2}\right)\cos^2\left(\theta\frac{\pi}{2}\right) + \cos^2\left(r\frac{\pi}{2}\right)\left(\frac{\sqrt{4}}{4}\right)^2}\,S$$

-continued $$C_2 = \sqrt{\sin^2\left(r\frac{\pi}{2}\right)\sin^2\left(\theta\frac{\pi}{2}\right) + \cos^2\left(r\frac{\pi}{2}\right)\left(\frac{\sqrt{4}}{4}\right)^2}\,S$$

$$C_3 = \sqrt{\cos^2\left(r\frac{\pi}{2}\right)\left(\frac{\sqrt{4}}{4}\right)^2}\,S$$

$$C_4 = \sqrt{\cos^2\left(r\frac{\pi}{2}\right)\left(\frac{\sqrt{4}}{4}\right)^2}\,S$$

where r is the distance of the signal source from the origin (normalized to the range [0,1]) and θ is the angle of the signal source between channels $C_1$ and $C_2$ (normalized to the range [0,1]). Note that the above channel panning weights for channels $C_1/C_2/C_3/C_4$ are designed to preserve power of the signal S as it is panned onto $C_1/C_2/C_3/C_4$.

Upmixing Case

Figure 22:
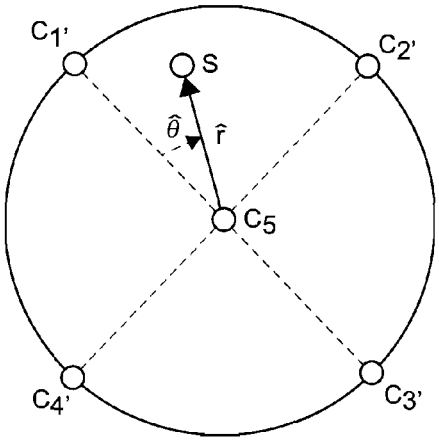
FIG. 22 is a diagram illustrating the extraction of a non-surviving fifth channel that has been panned onto a quadruplet.

The objective when upmixing the quadruplet is to obtain the non-surviving channel that was downmixed onto the quadruplet by creating five output channels $C_1'/C_2'/C_3'/C_4'/C_5$ from the input quadruplet $C_1/C_2/C_3/C_4$. FIG. 22 is a diagram illustrating the extraction of a non-surviving fifth channel that has been panned onto a quadruplet. Referring to FIG. 22, the location of the fifth output channel $C_5$ is assumed to be at the origin, while the location of the other four output channels $C_1'/C_2'/C_3'/C_4'$ is assumed identical to the input channels $C_1/C_2/C_3/C_4$. Embodiments of the multiplet-based spatial matrixing decoder 420 generate the five output channels such that the spatial location and signal energy of the original signal component S is preserved.

The original location of the sound source S is not transmitted to the embodiments of the decoder 420, and can only be estimated from the input channels $C_1/C_2/C_3/C_4$ themselves. Embodiments of the decoder 420 must be able to appropriately generate the five output channels for any arbitrary location of S.

For the remainder of the section, it can be assumed that the original signal component S has unit energy (in other words, |S|=1) to simplify derivations without loss of generality. The decoder first derives r̂ and θ̂ estimates from channel energies $C_1^2/C_2^2/C_3^2/C_4^2$:

$$\hat{r} = \frac{2}{\pi}\cdot\cos^{-1}\left(\sqrt{4\frac{\min(C_3^2, C_4^2)}{C_1^2 + C_2^2 + C_3^2 + C_4^2}}\right)$$

$$\hat{\theta} = \frac{2}{\pi}\cdot\cos^{-1}\left(\sqrt{\frac{C_1^2 - \min(C_3^2, C_4^2)}{C_1^2 + C_2^2 + C_3^2 + C_4^2 - 4\min(C_3^2, C_4^2)}}\right)$$

Note that the minimum energy of the $C_3$ and $C_4$ channels is used in the above equations (in other words, $\min(C_3^2, C_4^2)$) to handle situations when an input quadruplet $C_1/C_2/C_3/C_4$ breaks the signal model assumptions previously identified. The signal model assumes that the energy levels of $C_3$ and $C_4$ will be equal to each other. However, if this is not the case for an arbitrary input signal and $C_3$ is not equal to $C_4$, then it may be desirable to limit the re-panning of the input signal across the output channels $C_1'/C_2'/C_3'/C_4'/C_5$. This can be accomplished by synthesizing a minimal output channel $C_5$ and preserving the output channels $C_1'/C_2'/C_3'/C_4'$ as similarly to their corresponding input channels $C_1/C_2/C_3/C_4$ as possible. In this section, the use of a minimum function on the $C_3$ and $C_4$ channels attempts to achieve this objective.

Channel Energy Ratios

The following energy ratios will be used throughout the remainder of this section:

$$\mu_i^2 = \frac{C_i^2}{\sum_j C_j^2}$$

These four energy ratios are in the range [0,1] and sum to 1.

$C_5$ Channel Synthesis

Output channel $C_5$ will be generated via the following equation:

$$C_5 = aC_1 + bC_2 + cC_3 + dC_4$$

where the a, b, c, and d coefficients will be determined based on the estimated angle θ̂ and radius r̂.

Goal:

$$\sqrt{\cos^2\left(\hat{r}\frac{\pi}{2}\right)} = a\sqrt{\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{4}}{4}\right)^2} + b\sqrt{\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{4}}{4}\right)^2} + c\sqrt{\cos^2\left(\hat{r}\frac{\pi}{2}\right)\left(\frac{\sqrt{4}}{4}\right)^2} + d\sqrt{\cos^2\left(\hat{r}\frac{\pi}{2}\right)\left(\frac{\sqrt{4}}{4}\right)^2}$$

Let a=ea', b=eb', c=ec', and d=ed' where $$a' = \sqrt{\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{4}}{4}\right)^2}$$

$$b' = \sqrt{\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{4}}{4}\right)^2}$$

$$c' = \sqrt{\cos^2\left(\hat{r}\frac{\pi}{2}\right)\left(\frac{\sqrt{4}}{4}\right)^2}$$

$$d' = \sqrt{\cos^2\left(\hat{r}\frac{\pi}{2}\right)\left(\frac{\sqrt{4}}{4}\right)^2}$$

The above substitutions lead to:

$$\sqrt{\cos^2\left(\hat{r}\frac{\pi}{2}\right)} = e\left(\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{4}}{4}\right)^2\right) + e\left(\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{4}}{4}\right)^2\right) +$$

-continued $$e\left(\cos^2\left(\hat{r}\frac{\pi}{2}\right)\left(\frac{\sqrt{4}}{4}\right)^2\right)+e\left(\cos^2\left(\hat{r}\frac{\pi}{2}\right)\left(\frac{\sqrt{4}}{4}\right)^2\right)$$

Solving for e yields:

$$e=\cos\left(\hat{r}\frac{\pi}{2}\right)$$

The a, b, c, and d coefficients are thus:

$$a=\cos\left(\hat{r}\frac{\pi}{2}\right)\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{4}}{4}\right)^2}$$

$$b=\cos\left(\hat{r}\frac{\pi}{2}\right)\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{4}}{4}\right)^2}$$

$$c=\cos\left(\hat{r}\frac{\pi}{2}\right)\sqrt{\cos^2\left(\hat{r}\frac{\pi}{2}\right)\left(\frac{\sqrt{4}}{4}\right)^2}$$

$$d=\cos\left(\hat{r}\frac{\pi}{2}\right)\sqrt{\cos^2\left(\hat{r}\frac{\pi}{2}\right)\left(\frac{\sqrt{4}}{4}\right)^2}$$

Furthermore, the final a, b, c, and d coefficients can be simplified to expressions consisting only of the channel energy ratios:

$$a=2\mu_1\min(\mu_3,\mu_4)$$

$$b=2\mu_2\min(\mu_3,\mu_4)$$

$$c=2\min(\mu_3,\mu_4)\min(\mu_3,\mu_4)$$

$$d=2\min(\mu_3,\mu_4)\min(\mu_3,\mu_4)$$

$C_1'/C_2'/C_3'C_4'$ Channel Synthesis

Output channels $C_1'/C_2'/C_3'/C_4'$ will be generated from input channels $C_1/C_2/C_3/C_4$ such that the signal components already generated in output channel $C_5$ will be appropriately "removed" from input channels $C_1/C_2/C_3/C_4$.

$C_1'$ Channel Synthesis $$C_1'=aC_1-bC_2-cC_3-dC_4$$

Goal:

$$\sqrt{\sin^2\left(\hat{r}\frac{\pi}{2}\right)\cos^2\left(\hat{\theta}\frac{\pi}{2}\right)}=a\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{4}}{4}\right)^2}-$$
$$b\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{4}}{4}\right)^2}-$$
$$c\sqrt{\cos^2\left(\hat{r}\frac{\pi}{2}\right)\left(\frac{\sqrt{4}}{4}\right)^2}-d\sqrt{\cos^2\left(\hat{r}\frac{\pi}{2}\right)\left(\frac{\sqrt{4}}{4}\right)^2}$$

Let the a coefficient be equal to $$a=\sqrt{\sin^2\left(\hat{r}\frac{\pi}{2}\right)+\cos^2\left(\hat{r}\frac{\pi}{2}\right)\sqrt{\frac{3}{4}}^2}$$

Let b=eb', c=ec', and d=ed' where $$b'=\sqrt{\cos^2\left(\hat{r}\frac{\pi}{2}\right)\sqrt{\frac{1}{12}}^2}$$

$$c'=\sqrt{\cos^2\left(\hat{r}\frac{\pi}{2}\right)\sqrt{\frac{1}{12}}^2}$$

$$d'=\sqrt{\cos^2\left(\hat{r}\frac{\pi}{2}\right)\sqrt{\frac{1}{12}}^2}$$

The above substitutions lead to:

$$\sqrt{\sin^2\left(\hat{r}\frac{\pi}{2}\right)\cos^2\left(\hat{\theta}\frac{\pi}{2}\right)}=$$
$$\sqrt{\sin^2\left(\hat{r}\frac{\pi}{2}\right)+\cos^2\left(\hat{r}\frac{\pi}{2}\right)\left(\frac{3}{4}\right)}\sqrt{\sin^2\left(\hat{r}\frac{\pi}{2}\right)\cos^2\left(\hat{\theta}\frac{\pi}{2}\right)+\cos^2\left(\hat{r}\frac{\pi}{2}\right)\left(\frac{\sqrt{4}}{4}\right)^2}-$$
$$e\sqrt{\cos\left(\hat{r}\frac{\pi}{2}\right)\left(\frac{1}{12}\right)}\sqrt{\sin^2\left(\hat{r}\frac{\pi}{2}\right)\sin^2\left(\hat{\theta}\frac{\pi}{2}\right)+\cos^2\left(\hat{r}\frac{\pi}{2}\right)\left(\frac{\sqrt{4}}{4}\right)^2}-$$
$$e\sqrt{\cos^2\left(\hat{r}\frac{\pi}{2}\right)\left(\frac{1}{12}\right)}\sqrt{\cos^2\left(\hat{r}\frac{\pi}{2}\right)\left(\frac{\sqrt{4}}{4}\right)^2}-$$
$$e\sqrt{\cos^2\left(\hat{r}\frac{\pi}{2}\right)\left(\frac{1}{12}\right)}\sqrt{\cos^2\left(\hat{r}\frac{\pi}{2}\right)\left(\frac{\sqrt{4}}{4}\right)^2}$$

Solving for e yields:

$$e=\frac{\sqrt{\sin^2\left(\hat{r}\frac{\pi}{2}\right)+\frac{3\cos^2\left(\hat{r}\frac{\pi}{2}\right)}{4}}\sqrt{\sin^2\left(\hat{r}\frac{\pi}{2}\right)\cos^2\left(\hat{\theta}\frac{\pi}{2}\right)+\frac{\cos^2\left(\hat{r}\frac{\pi}{2}\right)}{4}}-\sqrt{\sin^2\left(\hat{r}\frac{\pi}{2}\right)\cos^2\left(\hat{\theta}\frac{\pi}{2}\right)}}{\sqrt{\frac{\cos^2\left(\hat{r}\frac{\pi}{2}\right)}{12}}\left(\sqrt{\sin^2\left(\hat{r}\frac{\pi}{2}\right)\sin^2\left(\hat{\theta}\frac{\pi}{2}\right)+\frac{\cos^2\left(\hat{r}\frac{\pi}{2}\right)}{4}}+\sqrt{\cos^2\left(\hat{r}\frac{\pi}{2}\right)}\right)}$$

The final a, b, c, and d coefficients can be simplified to expressions consisting only of the channel energy ratios:

$$a=\sqrt{1-\min(\mu_3^2,\mu_4^2)}$$

$$b=\frac{\mu_1\sqrt{1-\min(\mu_3^2,\mu_4^2)}-\sqrt{\mu_1^2-\min(\mu_3^2,\mu_4^2)}}{\mu_2+2\min(\mu_3,\mu_4)}$$

$$c=\frac{\mu_1\sqrt{1-\min(\mu_3^2,\mu_4^2)}-\sqrt{\mu_1^2-\min(\mu_3^2,\mu_4^2)}}{\mu_2+2\min(\mu_3,\mu_4)}$$

-continued $$d = \frac{\mu_1\sqrt{1-\min(\mu_3^2,\mu_4^2)} - \sqrt{\mu_1^2-\min(\mu_3^2,\mu_4^2)}}{\mu_2+2\min(\mu_3,\mu_4)}$$

$C_2'$ Channel Synthesis $$C_2' = aC_2 - bC_1 - cC_3 - dC_4$$

Goal:

$$\sqrt{\sin^2(\hat{r}\tfrac{\pi}{2})\cos^2(\hat{\theta}\tfrac{\pi}{2})} = a\sqrt{\sin^2(\hat{r}\tfrac{\pi}{2})\sin^2(\hat{\theta}\tfrac{\pi}{2})+\cos^2(\hat{r}\tfrac{\pi}{2})\left(\frac{\sqrt{4}}{4}\right)^2} - b\sqrt{\sin^2(\hat{r}\tfrac{\pi}{2})\cos^2(\hat{\theta}\tfrac{\pi}{2})+\cos^2(\hat{r}\tfrac{\pi}{2})\left(\frac{\sqrt{4}}{4}\right)^2} - c\sqrt{\cos^2(\hat{r}\tfrac{\pi}{2})\left(\frac{\sqrt{4}}{4}\right)^2} - d\sqrt{\cos^2(\hat{r}\tfrac{\pi}{2})\left(\frac{\sqrt{4}}{4}\right)^2}$$

Let the a coefficient be equal to $$a = \sqrt{\sin^2(\hat{r}\tfrac{\pi}{2})+\cos^2(\hat{r}\tfrac{\pi}{2})\sqrt{\frac{3}{4}}^2}$$

Let b=eb', c=ec', and d=ed' where $$b' = \sqrt{\cos^2(\hat{r}\tfrac{\pi}{2})\sqrt{\frac{1}{12}}^2}$$

$$c' = \sqrt{\cos^2(\hat{r}\tfrac{\pi}{2})\sqrt{\frac{1}{12}}^2}$$

$$d' = \sqrt{\cos^2(\hat{r}\tfrac{\pi}{2})\sqrt{\frac{1}{12}}^2}$$

The above substitutions lead to:

$$\sqrt{\sin^2(\hat{r}\tfrac{\pi}{2})\sin^2(\hat{\theta}\tfrac{\pi}{2})} = \sqrt{\sin^2(\hat{r}\tfrac{\pi}{2})+\cos^2(\hat{r}\tfrac{\pi}{2})\left(\frac{3}{4}\right)}\sqrt{\sin^2(\hat{r}\tfrac{\pi}{2})\sin^2(\hat{\theta}\tfrac{\pi}{2})+\cos^2(\hat{r}\tfrac{\pi}{2})\left(\frac{\sqrt{4}}{4}\right)^2} - e\sqrt{\cos(\hat{r}\tfrac{\pi}{2})\left(\frac{1}{12}\right)}\sqrt{\sin^2(\hat{r}\tfrac{\pi}{2})\cos^2(\hat{\theta}\tfrac{\pi}{2})+\cos^2(\hat{r}\tfrac{\pi}{2})\left(\frac{\sqrt{4}}{4}\right)^2} - e\sqrt{\cos^2(\hat{r}\tfrac{\pi}{2})\left(\frac{1}{12}\right)}\sqrt{\cos^2(\hat{r}\tfrac{\pi}{2})\left(\frac{\sqrt{4}}{4}\right)^2} - e\sqrt{\cos^2(\hat{r}\tfrac{\pi}{2})\left(\frac{1}{12}\right)}\sqrt{\cos^2(\hat{r}\tfrac{\pi}{2})\left(\frac{\sqrt{4}}{4}\right)^2}$$

Solving for e yields:

$$e = \frac{\sqrt{\sin^2(\hat{r}\tfrac{\pi}{2})+\frac{3\cos^2(\hat{r}\tfrac{\pi}{2})}{4}}\sqrt{\sin^2(\hat{r}\tfrac{\pi}{2})\sin^2(\hat{\theta}\tfrac{\pi}{2})+\frac{\cos^2(\hat{r}\tfrac{\pi}{2})}{4}} - \sqrt{\sin^2(\hat{r}\tfrac{\pi}{2})\sin^2(\hat{\theta}\tfrac{\pi}{2})}}{\sqrt{\frac{\cos^2(\hat{r}\tfrac{\pi}{2})}{12}}\left(\sqrt{\sin^2(\hat{r}\tfrac{\pi}{2})\cos^2(\hat{\theta}\tfrac{\pi}{2})+\frac{\cos^2(\hat{r}\tfrac{\pi}{2})}{4}} + \sqrt{\cos^2(\hat{r}\tfrac{\pi}{2})}\right)}$$

The final a, b, c, and d coefficients can be simplified to expressions consisting only of the channel energy ratios:

$$a = \sqrt{1-\min(\mu_3^2,\mu_4^2)}$$

$$b = \frac{\mu_2\sqrt{1-\min(\mu_3^2,\mu_4^2)} - \sqrt{\mu_2^2-\min(\mu_3^2,\mu_4^2)}}{\mu_1+2\min(\mu_3,\mu_4)}$$

$$c = \frac{\mu_2\sqrt{1-\min(\mu_3^2,\mu_4^2)} - \sqrt{\mu_2^2-\min(\mu_3^2,\mu_4^2)}}{\mu_1+2\min(\mu_3,\mu_4)}$$

$$d = \frac{\mu_2\sqrt{1-\min(\mu_3^2,\mu_4^2)} - \sqrt{\mu_2^2-\min(\mu_3^2,\mu_4^2)}}{\mu_1+2\min(\mu_3,\mu_4)}$$

$C_3'$ Channel Synthesis $$C_3' = aC_3 - bC_1 - cC_2 - dC_4$$

Goal:

$$0 = a\sqrt{\cos^2(\hat{r}\tfrac{\pi}{2})\left(\frac{\sqrt{4}}{4}\right)^2} - b\sqrt{\sin^2(\hat{r}\tfrac{\pi}{2})\cos^2(\hat{\theta}\tfrac{\pi}{2})+\cos^2(\hat{r}\tfrac{\pi}{2})\left(\frac{\sqrt{4}}{4}\right)^2} - c\sqrt{\sin^2(\hat{r}\tfrac{\pi}{2})\sin^2(\hat{\theta}\tfrac{\pi}{2})+\cos^2(\hat{r}\tfrac{\pi}{2})\left(\frac{\sqrt{4}}{4}\right)^2} - d\sqrt{\cos^2(\hat{r}\tfrac{\pi}{2})\left(\frac{\sqrt{4}}{4}\right)^2}$$

Let the a coefficient be equal to $$a = \sqrt{\sin^2(\hat{r}\tfrac{\pi}{2})+\cos^2(\hat{r}\tfrac{\pi}{2})\sqrt{\frac{3}{4}}^2}$$

Let b=eb', c=ec', and d=ed' where $$b' = \sqrt{\cos^2(\hat{r}\tfrac{\pi}{2})\sqrt{\frac{1}{12}}^2}$$

$$c' = \sqrt{\cos^2(\hat{r}\tfrac{\pi}{2})\sqrt{\frac{1}{12}}^2}$$

$$d' = \sqrt{\cos^2(\hat{r}\tfrac{\pi}{2})\sqrt{\frac{1}{12}}^2}$$

The above substitutions lead to:

$$0=\sqrt{\sin^2(\hat{r}\tfrac{\pi}{2})+\cos^2(\hat{r}\tfrac{\pi}{2})\left(\tfrac{3}{4}\right)}\sqrt{\cos^2(\hat{r}\tfrac{\pi}{2})\left(\tfrac{\sqrt{4}}{4}\right)^2}-e\sqrt{\cos(\hat{r}\tfrac{\pi}{2})\left(\tfrac{1}{12}\right)}\sqrt{\sin^2(\hat{r}\tfrac{\pi}{2})\cos^2(\hat{\theta}\tfrac{\pi}{2})+\cos^2(\hat{r}\tfrac{\pi}{2})\left(\tfrac{\sqrt{4}}{4}\right)^2}-e\sqrt{\cos^2(\hat{r}\tfrac{\pi}{2})\left(\tfrac{1}{12}\right)}\sqrt{\sin^2(\hat{r}\tfrac{\pi}{2})\sin^2(\hat{\theta}\tfrac{\pi}{2})+\cos^2(\hat{r}\tfrac{\pi}{2})\left(\tfrac{\sqrt{4}}{4}\right)^2}-e\sqrt{\cos^2(\hat{r}\tfrac{\pi}{2})\left(\tfrac{1}{12}\right)}\sqrt{\cos^2(\hat{r}\tfrac{\pi}{2})\left(\tfrac{\sqrt{4}}{4}\right)^2}$$

Solving for e yields:

$$e=\frac{\sqrt{\sin^2(\hat{r}\tfrac{\pi}{2})+\tfrac{3\cos^2(\hat{r}\tfrac{\pi}{2})}{4}}\sqrt{\tfrac{\cos^2(\hat{r}\tfrac{\pi}{2})}{4}}}{\sqrt{\tfrac{\cos^2(\hat{r}\tfrac{\pi}{2})}{12}}\left(\sqrt{\sin^2(\hat{r}\tfrac{\pi}{2})\cos^2(\hat{\theta}\tfrac{\pi}{2})+\tfrac{\cos^2(\hat{r}\tfrac{\pi}{2})}{4}}+\sqrt{\sin^2(\hat{r}\tfrac{\pi}{2})\sin^2(\hat{\theta}\tfrac{\pi}{2})+\tfrac{\cos^2(\hat{r}\tfrac{\pi}{2})}{4}}+\sqrt{\tfrac{\cos^2(\hat{r}\tfrac{\pi}{2})}{4}}\right)}$$

The final a, b, c, and d coefficients can be simplified to expressions consisting only of the channel energy ratios:

$$a=\sqrt{1-\min(\mu_3^2,\mu_4^2)}$$

$$b=\frac{\min(\mu_3,\mu_4)\sqrt{1-\min(\mu_3^2,\mu_4^2)}}{\mu_1+\mu_2+\min(\mu_3,\mu_4)}$$

$$c=\frac{\min(\mu_3,\mu_4)\sqrt{1-\min(\mu_3^2,\mu_4^2)}}{\mu_1+\mu_2+\min(\mu_3,\mu_4)}$$

$$d=\frac{\min(\mu_3,\mu_4)\sqrt{1-\min(\mu_3^2,\mu_4^2)}}{\mu_1+\mu_2+\min(\mu_3,\mu_4)}$$

$C_4'$ Channel Synthesis $$C_4'=aC_4-bC_1-cC_2-dC_3$$

Goal:

$$0=a\sqrt{\cos^2(\hat{r}\tfrac{\pi}{2})\left(\tfrac{\sqrt{4}}{4}\right)^2}-b\sqrt{\sin^2(\hat{r}\tfrac{\pi}{2})\cos^2(\hat{\theta}\tfrac{\pi}{2})+\cos^2(\hat{r}\tfrac{\pi}{2})\left(\tfrac{\sqrt{4}}{4}\right)^2}-c\sqrt{\sin^2(\hat{r}\tfrac{\pi}{2})\sin^2(\hat{\theta}\tfrac{\pi}{2})+\cos^2(\hat{r}\tfrac{\pi}{2})\left(\tfrac{\sqrt{4}}{4}\right)^2}-d\sqrt{\cos^2(\hat{r}\tfrac{\pi}{2})\left(\tfrac{\sqrt{4}}{4}\right)^2}$$

Let the a coefficient be equal to $$a=\sqrt{\sin^2(\hat{r}\tfrac{\pi}{2})+\cos^2(\hat{r}\tfrac{\pi}{2})\sqrt{\tfrac{3}{4}}^2}$$

Let b=eb', c=ec', and d=ed' where $$b'=\sqrt{\cos^2(\hat{r}\tfrac{\pi}{2})\sqrt{\tfrac{1}{12}}^2}$$

$$c'=\sqrt{\cos^2(\hat{r}\tfrac{\pi}{2})\sqrt{\tfrac{1}{12}}^2}$$

$$d'=\sqrt{\cos^2(\hat{r}\tfrac{\pi}{2})\sqrt{\tfrac{1}{12}}^2}$$

The above substitutions lead to:

$$0=\sqrt{\sin^2(\hat{r}\tfrac{\pi}{2})+\cos^2(\hat{r}\tfrac{\pi}{2})\left(\tfrac{3}{4}\right)}\sqrt{\cos^2(\hat{r}\tfrac{\pi}{2})\left(\tfrac{\sqrt{4}}{4}\right)^2}-e\sqrt{\cos^2(\hat{r}\tfrac{\pi}{2})\left(\tfrac{1}{12}\right)}\sqrt{\sin^2(\hat{r}\tfrac{\pi}{2})\cos^2(\hat{\theta}\tfrac{\pi}{2})+\cos^2(\hat{r}\tfrac{\pi}{2})\left(\tfrac{\sqrt{4}}{4}\right)^2}-e\sqrt{\cos^2(\hat{r}\tfrac{\pi}{2})\left(\tfrac{1}{12}\right)}\sqrt{\sin^2(\hat{r}\tfrac{\pi}{2})\sin^2(\hat{\theta}\tfrac{\pi}{2})+\cos^2(\hat{r}\tfrac{\pi}{2})\left(\tfrac{\sqrt{4}}{4}\right)^2}-e\sqrt{\cos^2(\hat{r}\tfrac{\pi}{2})\left(\tfrac{1}{12}\right)}\sqrt{\cos^2(\hat{r}\tfrac{\pi}{2})\left(\tfrac{\sqrt{4}}{4}\right)^2}$$

Solving for e yields:

$$e=\frac{\sqrt{\sin^2(\hat{r}\tfrac{\pi}{2})+\tfrac{3\cos^2(\hat{r}\tfrac{\pi}{2})}{4}}\sqrt{\tfrac{\cos^2(\hat{r}\tfrac{\pi}{2})}{4}}}{\sqrt{\tfrac{\cos^2(\hat{r}\tfrac{\pi}{2})}{12}}\left(\sqrt{\sin^2(\hat{r}\tfrac{\pi}{2})\cos^2(\hat{\theta}\tfrac{\pi}{2})+\tfrac{\cos^2(\hat{r}\tfrac{\pi}{2})}{4}}+\sqrt{\sin^2(\hat{r}\tfrac{\pi}{2})\sin^2(\hat{\theta}\tfrac{\pi}{2})+\tfrac{\cos^2(\hat{r}\tfrac{\pi}{2})}{4}}+\sqrt{\tfrac{\cos^2(\hat{r}\tfrac{\pi}{2})}{4}}\right)}$$

The final a, b, c, and d coefficients can be simplified to expressions consisting only of the channel energy ratios:

$$a=\sqrt{1-\min(\mu_3^2,\mu_4^2)}$$

$$b=\frac{\min(\mu_3,\mu_4)\sqrt{1-\min(\mu_3^2,\mu_4^2)}}{\mu_1+\mu_2+\min(\mu_3,\mu_4)}$$

$$c=\frac{\min(\mu_3,\mu_4)\sqrt{1-\min(\mu_3^2,\mu_4^2)}}{\mu_1+\mu_2+\min(\mu_3,\mu_4)}$$

$$d=\frac{\min(\mu_3,\mu_4)\sqrt{1-\min(\mu_3^2,\mu_4^2)}}{\mu_1+\mu_2+\min(\mu_3,\mu_4)}$$

Quadruplet Inter-Channel Phase Difference (ICPD)

An inter-channel phase difference (ICPD) spatial property can be calculated for a quadruplet from the underlying pairwise ICPD values:

$$ICPD = \frac{|C_1||C_2|ICPD_{12} + |C_1||C_3|ICPD_{13} + |C_1||C_4|ICPD_{14} + |C_2||C_3|ICPD_{23} + |C_2||C_4|ICPD_{24} + |C_3||C_4|ICPD_{34}}{|C_1||C_2| + |C_1||C_3| + |C_1||C_4| + |C_2||C_3| + |C_2||C_4| + |C_3||C_4|}$$

where the underlying pairwise ICPD values are calculated using the following equation:

$$ICPD_{ij} = \frac{\mathrm{Re}\{\sum C_i \cdot C_j^*\}}{\sqrt{\sum |C_i|^2}\sqrt{\sum |C_j|^2}}.$$

Note that the quadruplet signal model assumes that a sound source has been amplitude-panned onto the quadruplet channels, implying that the four channels are fully correlated. The quadruplet ICPD measure can be used to estimate the total correlation of the four channels. When the quadruplet channels are fully correlated (or nearly fully correlated) the quadruplet framework can be employed to generate the five output channels with highly predictable results. When the quadruplet channels are uncorrelated, it may be desirable to use a different framework or method since the uncorrelated quadruplet channels violate the assumed signal model which may result in unpredictable results.

V.G. Extended Rendering

Embodiments of the codec 400 and method render audio object waveforms over a speaker array using a novel extension of vector-based amplitude panning (VBAP) techniques. Traditional VBAP techniques create three-dimensional sound fields using any number of arbitrarily-placed loudspeakers on a unit sphere. The hemisphere on the unit sphere creates a dome over the listener. With VBAP, the most localizable sound that can be created comes from a maximum of 3 channels making up some triangular arrangement. If it so happens that the sound is coming from a point that lies on a line between two speakers, then VBAP will just use those two speakers. If the sound is supposed to be coming from the location where a speaker is located, then VBAP will just use that one speaker. So VBAP uses a maximum of 3 speakers and a minimum of 1 speaker to reproduce the sound. The playback environment may have more than 3 speakers, but the VBAP technique reproduces the sound using only 3 of those speakers.

The extended rendering technique used by embodiments of the codec 400 and method renders audio objects off the unit sphere to any point within the unit sphere. For example, assume a triangle is created using three speakers. By extending traditional VBAP methods that locate a source at a point along a line and extending those methods to use three speakers, a source can be located anywhere within the triangle formed by those three speakers. The goal of the rendering engine is to find a gain array to create the sound at the correct position along the 3D vectors created by this geometry with the least amount of leakage to neighboring speakers.

Figure 23:
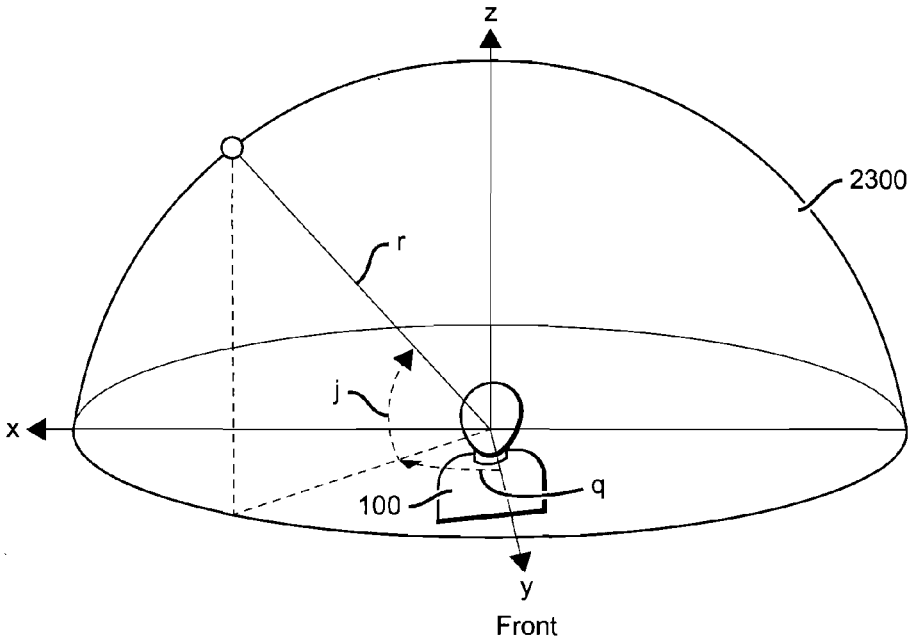
FIG. 23 is an illustration of the playback environment and the extended rendering technique.

FIG. 23 is an illustration of the playback environment 485 and the extended rendering technique. The listener 100 is located with the unit sphere 2300. It should be noted that although only half the unit sphere 2300 is shown (the hemisphere), the extended rendering technique supports rendering on and within the full unit sphere 2300. FIG. 23 also illustrates the spherical coordinate system x-y-z used including the radial distance, r, the azimuthal angle, q, and the polar angle, j.

The multiplets and the sphere should cover the locations of all waveforms in the bitstream. This idea can be extended to four or more speakers if needed, thus creating rectangles or other polygons to work within, to accurately achieve the correct position in space on the hemisphere of the unit sphere 2300.

The DTS-UHD rendering engine performs 3D panning of point and extended sources to arbitrary loudspeaker layouts. A point source sounds as though it is coming from one specific spot in space, whereas extended sources are sounds with 'width' and/or 'height'. Support for spatial extension of a source is done by means of modeling contributions of virtual sources covering the area of the extended sound.

Figure 24:
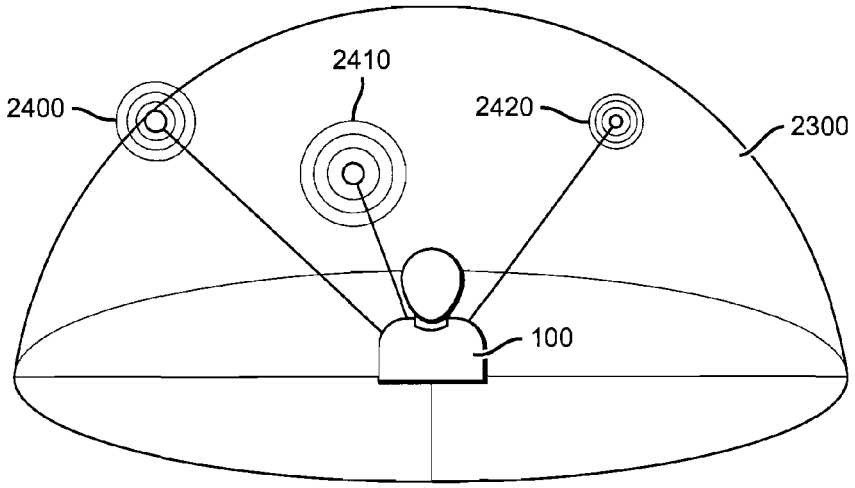
FIG. 24 illustrates the rendering of audio sources on and within a unit sphere using the extended rendering technique.

FIG. 24 illustrates the rendering of audio sources on and within the unit sphere 2300 using the extended rendering technique. Audio sources can be located anywhere on or within this unit sphere 2300. For example, a first audio source can be located on the unit sphere 2400, while a second audio source 2410 and a third audio source may be located within the unit sphere by using the extended rendering technique.

The extended rendering technique renders a point or extended sources that are on the unit sphere 2300 surrounding the listener 100. However, for point sources that are inside the unit sphere 2300, the sources must be moved off the unit sphere 2300. The extended rendering technique uses three methods to move objects off the unit sphere 2300.

First, once the waveform is positioned on the unit sphere 2300 using the VBAP (or similar) technique, it is cross faded with a source positioned at the center of the unit sphere 2300 in order to pull the sound in along the radius, r. All of the speakers in the system are used to perform the cross-fade.

Second, for elevated sources, the sound is extended in the vertical plane in order to give the listener 100 the impression that it is moving closer. Only the speakers needed to extend the sound vertically are used. Third, for sources in the horizontal plane that may or may not have zero elevation, the sound is extended horizontally again to give the impression that it is moving closer to the listener 100. The only active speakers are those needed to do the extension.

V.H. An Exemplary Selection of Surviving Channels

Given the category of the input layout, the selected number of surviving channels (M), and the following rules, specify the matrixing of each non-surviving channel in a unique way regardless of the actual input layout. FIGS. 22-25 are lookup tables that dictate the mapping of matrix multiplets for any speakers in the input layout that is not present in the surviving layout.

Note that the following rules apply to FIGS. 25-28. The input layout is classified into 5 categories:

1. Layouts without height channels;
2. Layouts with height channels only in front;
3. Layouts with encircling height channels (no separation between two height speakers >180°;
4. Layouts with encircling height channels and an overhead channel;
5. Layouts with encircling height channels, an overhead channel, and channels below the listener plane.

In addition, each non-surviving channel is pairwise matrixed between a pair of surviving channels. In some scenarios a triplet, quadruplet, or larger group of surviving channels may be used for matrixing a single non-surviving channel. Also whenever possible a pair of surviving channels is used for matrixing one and only one non-surviving channel.

If height channels are present in the input channel layout than at least one height channel shall exist among the surviving channels. Whenever appropriate at least 3 encircling surviving channels in each loudspeaker ring should be used (applies to the listener plane ring and the elevated plane ring).

When no object inclusion or embedded downmix are required, there are other possibilities for optimization of the proposed approach. First, non-surviving channels (N−M of them shall in this scenario be called "quasi-surviving channels") can be encoded with very limited bandwidth (say $F_c$=3 kHz). Second, content in the "quasi-surviving channels" above $F_c$ should be matrixed onto selected surviving channels. Third, the low bands of the "quasi-surviving channels" and all bands of the surviving channels get encoded and packed into a stream.

The above optimization allows for minimal impact on spatial accuracy with still significant reduction in bit-rate. To manage decoder MIPS a careful selection of the time-frequency representation for dematrixing is needed such that decoder subband samples can be inserted into the dematrixing synthesis filter bank. On the other hand relaxation on required frequency resolution for dematrixing is possible since dematrixing is not applied below $F_c$.

V.I. Further Information

In the above discussion it should be appreciated that "re-panning" refers to the upmixing operation by which discrete channels numbering in excess of the downmixed channels (N>M) are recovered from the downmix in each channel set. Preferably this is performed in each of a plurality of perceptually critical subbands, for each set.

It should be appreciated that the optimum or near optimum results from this method will be best approximated when channel geometry is assumed by the recording artist or engineer (either explicitly or implicitly via software or hardware), and when in addition the geometry and assumed channel configurations and downmix parameters are communicated by some means to the decoder/receiver. In other words, if the original recording used a 22 channel discrete mix, based on a certain microphone/speaker geometry which was mixed down to a 7.1 channel downmix according to the matrixing methods set forth above, then these presumptions should be communicated to the receiver/decoder by some means to allow complementary upmix.

One method would be to communicate in file headers the presumed original geometry and the downmix configuration (22 with height channels in configuration X - - - downmix to 7.1 in conventional arrangement). This requires only minimal amounts of data bandwidth and infrequent updating in real-time. The parameters could be multiplexed into reserved fields in existing audio formats, for example. Other methods are available, including cloud storage, website access, user input, and the like.

In some embodiments of the codec 400 and method, the upmixing system 600 (or decoder) is aware of the channel layouts and mixing coefficients of both the original audio signal and the channel-reduced audio signal. Knowledge of the channel layouts and mixing coefficients allows the upmixing system 600 to accurately decode the channel-reduced audio signal back to an adequate approximation of the original audio signal. Without knowledge of the channel layouts and mixing coefficients the upmixer would be unable to determine the target output channel layout or the correct decoder functions needed to generate adequate approximations of the original audio channels.

As an example, an original audio signal may consist of 15 channels corresponding to the following channel locations: 1) Center, 2) Front Left, 3) Front Right, 4) Left Side Surround, 5) Right Side Surround, 6) Left Surround Rear, 7) Right Surround Rear, 8) Left or Center, 9) Right of Center, 10) Center Height, 11) Left Height, 12) Right Height, 13) Center Height Rear, 14) Left Height Rear, and 15) Right Height Rear. Due to bandwidth constraints (or some other motivation) it may desirable to reduce this high channel-count audio signal to a channel-reduced audio signal consisting of 8 channels.

The downmixing system 500 may be configured to encode the original 15 channels to an 8-channel audio signal consisting of the following channel locations: 1) Center, 2) Front Left, 3) Front Right, 4) Left Surround, 5) Right Surround, 6) Left Height, 7) Right Height, and 8) Center Height Rear. The downmixing system 500 may further be configured to use the following mixing coefficients when downmixing the original 15-channel audio signal:

| | C | FL | FR | LSS | RSS | LSR | RSR | LoC | RoC | CH | LH | RH | CHR | LHR | RHR |
|---|---|---|---|---|---|---|---|---|---|---|---|---|---|---|---|
| C | 1.0 | 0.0 | 0.0 | 0.0 | 0.0 | 0.0 | 0.0 | 0.707 | 0.707 | 0.0 | 0.0 | 0.0 | 0.0 | 0.0 | 0.0 |
| FL | 0.0 | 1.0 | 0.0 | 0.0 | 0.0 | 0.0 | 0.0 | 0.707 | 0.0 | 0.0 | 0.0 | 0.0 | 0.0 | 0.0 | 0.0 |
| FR | 0.0 | 0.0 | 1.0 | 0.0 | 0.0 | 0.0 | 0.0 | 0.0 | 0.707 | 0.0 | 0.0 | 0.0 | 0.0 | 0.0 | 0.0 |
| LS | 0.0 | 0.0 | 0.0 | 1.0 | 0.0 | 0.924 | 0.383 | 0.0 | 0.0 | 0.0 | 0.0 | 0.0 | 0.0 | 0.0 | 0.0 |
| RS | 0.0 | 0.0 | 0.0 | 0.0 | 1.0 | 0.383 | 0.924 | 0.0 | 0.0 | 0.0 | 0.0 | 0.0 | 0.0 | 0.0 | 0.0 |
| LH | 0.0 | 0.0 | 0.0 | 0.0 | 0.0 | 0.0 | 0.0 | 0.0 | 0.0 | 0.707 | 1.0 | 0.0 | 0.0 | 0.707 | 0.0 |
| RH | 0.0 | 0.0 | 0.0 | 0.0 | 0.0 | 0.0 | 0.0 | 0.0 | 0.0 | 0.707 | 0.0 | 1.0 | 0.0 | 0.0 | 0.707 |
| CHR | 0.0 | 0.0 | 0.0 | 0.0 | 0.0 | 0.0 | 0.0 | 0.0 | 0.0 | 0.0 | 0.0 | 0.0 | 1.0 | 0.707 | 0.707 |

where the top row corresponds to the original channels, the left-most column corresponds to the downmixed channels, and the numerical coefficients correspond to the mixing weights that each original channel contributes to each downmixed channel.

For the above example scenario, in order for the upmixing system 600 to optimally or near optimally decode an approximation of the original audio signal from the channel-reduced signal, the upmixing system 600 may have knowledge of the original and downmixed channel layouts (i.e., C, FL, FR, LSS, RSS, LSR, RSR, LoC, RoC, CH, LH, RH, CHR, LHR, RHR and C, FL, FR, LS, RS, LH, RH, CHR, respectively) and the mixing coefficients used during the downmix process (i.e., the above mixing coefficient matrix). With knowledge of this information, the upmixing system 600 can accurately determine the decoding functions needed for each output channel using the matrixing/dematrixing mathematical frameworks set forth above since it will be fully aware of the actual downmix configuration used. For example, the upmixing system 600 will know to decode the output LSR channel from the downmixed LS and RS channels, and it will also know the relative channel levels between the LS and RS channels that will imply a discrete LSR channel output (i.e., 0.924 and 0.383, respectively).

If the upmixing system 600 is unable to obtain the relevant channel layout and mixing coefficient information about the original and channel-reduced audio signals, for example if a data channel is not available for transmitting this information from the downmixing system 500 to the upmixer or if the received audio signal is a legacy or non-downmixed signal where such information is undetermined or unknown, then it still may be possible to perform a satisfactory upmix by using heuristics to select suitable decoding functions for the upmixing system 600. In these "blind upmix" cases, it may be possible to use the geometry of the channel-reduced layout and the target upmixed layout to determine suitable decoding functions.

By way of example, the decoding function for a given output channel may be determined by comparing that output channel's location relative to the nearest line segment between a pair of input channels. For instance, if a given output channel lies directly between a pair of input channels, it may be determined to extract equal intensity common signal components from that pair into the output channel. Likewise, if the given output channel lies nearer to one of the input channels, the decoding function may incorporate this geometry and favor a larger intensity for the nearer channel. Alternatively, it may be possible to use assumptions about the recording, mixing, or production techniques of the audio signal to determine suitable decoding functions. For example, it may be suitable to make assumptions about relationships between certain channels, such as assuming that height channel components may have been panned across the front and rear channel pairs (i.e. L-Lsr and R-Rsr pairs) of a 7.1 audio signal such as during a "flyover" effect from a movie.

It should also be appreciated that the audio channels used in the downmixing system 500 and the upmixing system 600 might not necessarily conform to actual speaker-feed signals intended for a specific speaker location. Embodiments of the codec 400 and method are also applicable to so-called "object audio" formats wherein an audio object corresponds to a distinct sound signal that is independently stored and transmitted with accompanying metadata information such as spatial location, gain, equalization, reverberation, diffusion, and so forth. Commonly, an object audio format will consist of many synchronized audio objects that need to be transmitted simultaneously from an encoder to a decoder.

In scenarios where data bandwidth is limited, the existence of numerous simultaneous audio objects can cause problems due to the necessity to individually encode each distinct audio object waveform. In this case, embodiments of the codec 400 and method are applicable to reduce the number of audio object waveforms needing to be encoded. For example, if there are N audio objects in an object-based signal, the downmix process of embodiments of the codec 400 and method can be used to reduce the number of objects to M, where N is greater than M. A compression scheme can then encode those M objects, requiring less data bandwidth than the original N objects would have required.

At the decoder side, the upmix process can be used to recover an approximation of the original N audio objects. A rendering system may then render those audio objects using the accompanying metadata information into a channel-based audio signal where each channel corresponds to a speaker location in an actual playback environment. For example, a common rendering method is vector-based amplitude panning, or VBAP.

VI. Alternate Embodiments and Exemplary Operating Environment

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the multiplet-based spatial matrixing codec 400 and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the multiplet-based spatial matrixing codec 400 and method described herein, or portions thereof, may be stored, received, transmitted, or read from any desired combination of computer or machine readable media or storage devices and communication media in the form of computer executable instructions or other data structures.

Embodiments of the multiplet-based spatial matrixing codec 400 and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

We claim:

1. A method performed by one or more processing devices for transmitting an input audio signal having N channels, comprising:

selecting M channels for a downmixed output audio signal based on a desired bitrate, where N and M are non-zero positive integers and N is greater than M;

downmixing and encoding the N channels to the M channels using the one or more processing devices and a combination of multiplet pan laws to obtain a pulse code modulation (PCM) bed mix containing M multiplet-encoded channels;

transmitting the PCM bed mix at or below the desired bitrate;

separating the M multiplet-encoded channels;

upmixing and decoding each of the M multiplet-encoded channels using the one or more processing devices and the combination of multiplet pan laws to extract the N channels from the M multiplet-encoded channels and obtain a resultant output audio signal having N channels, the upmixing further comprising:

selecting one of the M multiplet-encoded channels;

performing spatial analysis on the selected M multiplet-encoded channel and extracting an output channel based on the spatial analysis and using an associated M multiplet pan law;

repeating the spatial analysis and extraction for each remaining of the M multiplet-encoded channels to obtain the resultant output audio signal having N channels; and rendering the resultant output audio signal in a playback environment having a playback channel layout.

2. The method of claim 1, wherein the downmixing and encoding further comprises using a quadruplet pan law to downmix and encode one of the N channels onto four of the M channels to obtain a quadruplet-encoded channel.

3. The method of claim 1, wherein the downmixing and encoding further comprises using a quadruplet pan law to downmix and encode one of the N channels onto four of the M channels to obtain a quadruplet-encoded channel in combination with a triplet pan law to downmix and encode one of the N channels onto three of the M channels to obtain a triplet-encoded channel.

4. The method of claim 3, wherein at least some of the four M channels used in the quadruplet-encoded channel are the same as the three M channels used in the triplet-encoded channel.

5. The method of claim 1, further comprising:

mixing audio content in a content creation environment having a content creation environment channel layout; and multiplexing the content creation environment channel layout and the PCM bed mix containing M multiplet-encoded channels into a bitstream and transmitting the bitstream at or below the desired bitrate.

6. The method of claim 1, further comprising:

categorizing a content creation environment channel layout of the N channels of the input audio signal to obtain a category for the content creation environment channel layout; and mapping extracted multiplet-encoded channels to the playback channel layout based on the category and a lookup table.

7. The method of claim 6, further comprising categorizing the content creation environment channel layout into one or more of the following five categories: (a) layouts without height channels; (b) layouts with height channels only in front; (c) layouts with encircling height channels; (d) layouts with encircling height channels and an overhead channel; (e) layouts with encircling height channels, an overhead channel, and channels below a plane of a listener's ears.

8. The method of claim 1, further comprising scaling each of the M channels by a ratio of an input loudness to an output loudness to achieve a loudness normalization.

9. The method of claim 8, wherein the loudness normalization is a per-channel loudness normalization, and further comprising:

defining a given output channel as $y_i[n]$;

defining the per-channel loudness normalization as, $$y_i'[n]=d_i[n]\cdot y_i[n]$$

where $d_i[n]$ is a channel-dependent gain given as $$d_i[n]=\sqrt{\frac{(c_{i,1}L(x_1[n]))^2+(c_{i,2}L(x_2[n]))^2+\ldots+(c_{i,N}L(x_N[n]))^2}{(L(y_i[n]))^2}}$$

$x_j[n]$ are input channels, $c_{i,j}$ are downmix coefficients for an i-th output channel and a j-th input channel, where $1\leq j\leq N$, where $1\leq i\leq M$, and L(x) is a loudness estimation function.

10. The method of claim 9, wherein the loudness normalization is also a total loudness normalization, and further comprising:

defining the total loudness normalization as:

$$y_i''[n]=g[n]\cdot y_i'[n]$$

where g is a channel-independent gain given as $$g[n]=\sqrt{\frac{(L(x_1[n]))^2+(L(x_2[n]))^2+\ldots+(L(x_N[n]))^2}{(L(y_1'[n]))^2+(L(y_2'[n]))^2+\ldots+(L(y_M'[n]))^2}}.$$

11. A method performed by a computing device for matrix downmixing an audio signal having N channels, comprising:

selecting which of the N channels are surviving channels and which are non-surviving channels such that the surviving channels total M channels, where N and M are non-zero positive integers and N is greater than M;

downmixing each of the non-surviving channels onto multiplets of the surviving channels using the computing device and multiplet pan laws to obtain panning weights, the downmixing each of the non-surviving channels onto multiplets of the surviving channels further comprising:

downmixing some of the non-surviving channels onto surviving channel doublets containing two of the M channels using a doublet pan law;

downmixing some of the non-surviving channels onto surviving channel triplets containing three of the M channels using a triplet pan law;

downmixing some of the non-surviving channels onto surviving channel quadruplets containing four of the M channels using a quadruplet pan law; and encoding and multiplexing the surviving channel doublets, triplets, and quadruplets into a bitstream having M channels and transmitting the bitstream for rendering in a playback environment.

12. The method of claim 11, further comprising generating pan weights for the surviving channel quadruplets based on: (a) a distance r of a signal source S from an origin in the playback environment; and (b) an angle θ of the signal source S between a first channel and a second channel in the surviving channel quadruplets.

13. The method of claim 12, further comprising generating the pan weights for the surviving channel quadruplets, $C_1$, $C_2$, $C_3$, and $C_4$, using the equations:

$$C_1 = \sqrt{\sin^2\left(r\frac{\pi}{2}\right)\cos^2\left(\theta\frac{\pi}{2}\right) + \cos^2\left(r\frac{\pi}{2}\right)\left(\frac{\sqrt{4}}{4}\right)^2}\,S;$$

$$C_2 = \sqrt{\sin^2\left(r\frac{\pi}{2}\right)\sin^2\left(\theta\frac{\pi}{2}\right) + \cos^2\left(r\frac{\pi}{2}\right)\left(\frac{\sqrt{4}}{4}\right)^2}\,S;$$

$$C_3 = \sqrt{\cos^2\left(r\frac{\pi}{2}\right)\left(\frac{\sqrt{4}}{4}\right)^2}\,S;\text{ and}$$

$$C_4 = \sqrt{\cos^2\left(r\frac{\pi}{2}\right)\left(\frac{\sqrt{4}}{4}\right)^2}\,S.$$

14. A method performed by a computing device for matrix upmixing an audio signal having M channels, comprising:

separating the M channels into a doublet channel containing two of the M channels, a triplet channel containing three of the M channels, and a quadruplet channel containing four of the M channels;

performing a quadruplet spatial analysis on the quadruplet channel;

extracting a first channel from the quadruplet channel based on the quadruplet spatial analysis and using the computing device and a quadruplet pan law;

after the first channel has been extracted, performing a triplet spatial analysis on the triplet channel;

extracting a second channel from the triplet channel based on the triplet spatial analysis and using a triplet pan law;

after the second channel has been extracted, performing a doublet spatial analysis on the doublet channel;

extracting a third channel from the doublet channel based on the doublet spatial analysis and using a doublet pan law;

multiplexing the first channel, second channel, third channel, and M channels together to obtain an output signal having N channels; and rendering the output signal in a playback environment.

15. The method of claim 14, wherein the extracting the first channel further comprises obtaining the first channel as a sum of four channels of the quadruplet channel each weighted by coefficients.

16. The method of claim 15, further comprising obtaining the first channel, $C_5$, using the equation, $$C_5 = aC_1 + bC_2 + cC_3 + dC_4$$

where $C_1$, $C_2$, $C_3$, and $C_4$ are four channels of the quadruplet channel, where the a, b, c, and d coefficients are given by the equations, $$a = \cos\left(\hat{r}\frac{\pi}{2}\right)\sqrt{\sin^2\left(\hat{r}\frac{\pi}{2}\right)\cos^2\left(\hat{\theta}\frac{\pi}{2}\right) + \cos^2\left(\hat{r}\frac{\pi}{2}\right)\left(\frac{\sqrt{4}}{4}\right)^2}$$

$$b = \cos\left(\hat{r}\frac{\pi}{2}\right)\sqrt{\sin^2\left(\hat{r}\frac{\pi}{2}\right)\sin^2\left(\hat{\theta}\frac{\pi}{2}\right) + \cos^2\left(\hat{r}\frac{\pi}{2}\right)\left(\frac{\sqrt{4}}{4}\right)^2}$$

$$c = \cos\left(\hat{r}\frac{\pi}{2}\right)\sqrt{\cos^2\left(\hat{r}\frac{\pi}{2}\right)\left(\frac{\sqrt{4}}{4}\right)^2}$$

$$d = \cos\left(\hat{r}\frac{\pi}{2}\right)\sqrt{\cos^2\left(\hat{r}\frac{\pi}{2}\right)\left(\frac{\sqrt{4}}{4}\right)^2}$$

where $\hat{\theta}$ is an estimated angle of the $C_5$ between $C_1$ and $C_2$, and $\hat{r}$ is a distance of $C_5$ from an origin in the playback environment.

17. The method of claim 14, further comprising:

defining an imaginary unit sphere around a listener in the playback environment, wherein the listener is at the center of the unit sphere;

defining an imaginary spherical coordinate system on the unit sphere, including a radial distance r, an azimuthal angle q, and a polar angle j; and repanning the first channel to a location inside the unit sphere.

18. The method of claim 17, further comprising:

positioning the first channel on the unit sphere; and cross fading the first channel with a source positioned at the center of the unit sphere using all speakers in the playback environment in order to pull the first channel in along the radial distance r.

19. The method of claim 14, further comprising extracting a content creation environment speaker layout from the audio signal that sets forth a speaker layout that was used to mix audio content encoded in the audio signal.

20. A method performed by a computing device for matrix upmixing an audio signal having M channels, comprising:

separating the M channels into a doublet channel, a triplet channel, and a quadruplet channel;

extracting a first channel from the quadruplet channel using the computing device and a quadruplet pan law;

after the first channel has been extracted, extracting a second channel from the triplet channel using a triplet pan law;

after the second channel has been extracted, extracting a third channel from the doublet channel using a doublet pan law;

multiplexing the first channel, second channel, third channel, and M channels together to obtain an output signal having N channels;

rendering the output signal in a playback environment, the rendering further comprising:

defining an imaginary unit sphere around a listener in the playback environment, wherein the listener is at the center of the unit sphere;

defining an imaginary spherical coordinate system on the unit sphere, including a radial distance r, an azimuthal angle q, and a polar angle j;

repanning the first channel to a location inside the unit sphere;

positioning the first channel on the unit sphere; and cross fading the first channel with a source positioned at the center of the unit sphere using all speakers in the playback environment in order to pull the first channel in along the radial distance r.

* * * * *